US007512360B2

(12) United States Patent
Miller

(10) Patent No.: US 7,512,360 B2
(45) **Date of Patent: *Mar. 31, 2009**

(54) IMAGING CARTRIDGE HAVING A UNIVERSAL BODY

(75) Inventor: Steven Miller, Pinellas Park, FL (US)

(73) Assignee: Cartridge Corporation of America, Inc., Pinellas Park, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/013,387

(22) Filed: Jan. 11, 2008

(65) Prior Publication Data

US 2008/0145111 A1 Jun. 19, 2008

Related U.S. Application Data

(60) Continuation of application No. 11/382,589, filed on May 10, 2006, now Pat. No. 7,362,988, which is a division of application No. 10/742,323, filed on Dec. 19, 2003, now Pat. No. 7,136,608.

(51) Int. Cl.
*G03G 15/00* (2006.01)
*G03G 15/08* (2006.01)

(52) U.S. Cl. ..... 399/109; 399/120

(58) Field of Classification Search ..... 399/109, 399/113, 119, 120, 123, 262, 358, 360
See application file for complete search history.

(56) References Cited

U.S. PATENT DOCUMENTS

| | | | | | |
|---|---|---|---|---|---|
| 5,268,720 | A | * | 12/1993 | Saitoh et al. | 399/119 X |
| 5,298,952 | A | * | 3/1994 | Kamijo et al. | 399/123 |
| 5,331,377 | A | * | 7/1994 | Matsuura et al. | 399/120 X |
| 5,878,317 | A | * | 3/1999 | Masuda et al. | 399/120 X |
| 5,907,752 | A | * | 5/1999 | Kondoh | 399/120 |
| 6,904,248 | B2 | * | 6/2005 | Daniels | 399/109 |
| 7,136,608 | B2 | * | 11/2006 | Miller | 399/109 |

* cited by examiner

*Primary Examiner*—Sandra L Brase
(74) *Attorney, Agent, or Firm*—Jesse Delcamp

(57) ABSTRACT

Provided is an imaging cartridge with a universal body sculpted to mate with the imaging cartridge-receiving cavity of a plurality of imaging machine models. The universal body of the imaging cartridge enables the cartridge to be used with imaging machines made by different manufacturers, and different imaging machine models made by a common manufacturer. A plurality of recesses is formed in the leading end of the imaging cartridge body that accepts protuberances in an imaging machine's cartridge-receiving cavity and enables the cartridge to mate with a plurality of printers.

12 Claims, 55 Drawing Sheets

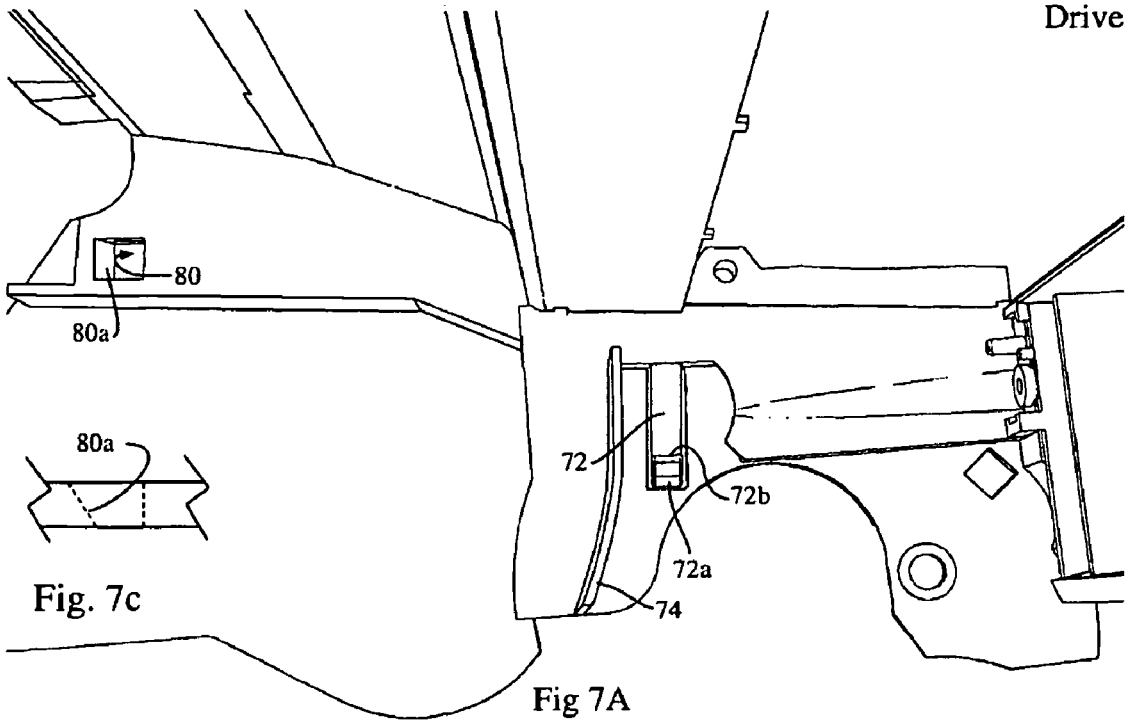
Fig. 7c
Fig 7A
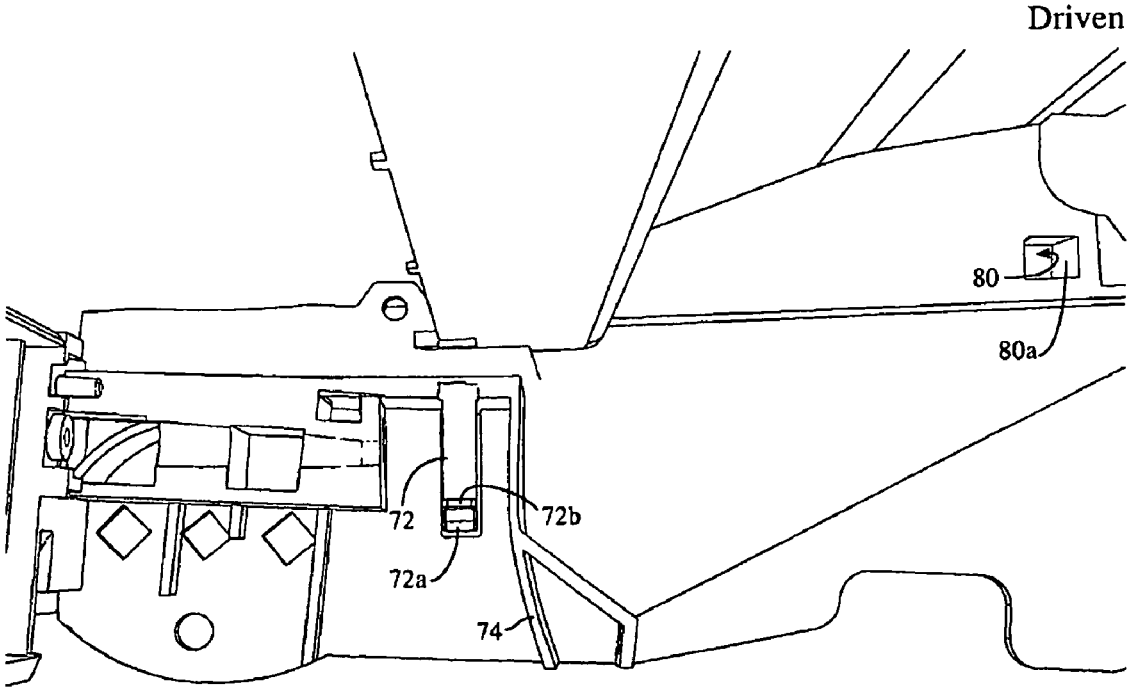
Fig 7B 53a
50
53b
57
57a 53a
50
53b
57
57a 50
53a
53b
57
57a 57
50
53a
53b
57a 57
50
53a
53b
57a 57
50
53a
53b
57a 53a
59c
53b
59b
59a
57
57a 59c
53a
57
59b
53b
59a
57a 59a
59b
59c
53a
53b
57
57a 59a
59b
59c
53a
53b
57
57a 57
59a
59b
59c
53a
53b
57
57a 53b
57
59a
53a
57a
59b
59c

IMAGING CARTRIDGE HAVING A UNIVERSAL BODY

CROSS REFERENCE TO RELATED APPLICATIONS

This application is a continuation of co-pending U.S. patent application Ser. No. 11/382,589, entitled "Universal Toner Cartridge Mounts for Attaching a Waste Bin to a Hopper," filed May 10, 2006, which is a divisional application of U.S. patent application Ser. No. 10/742,323, filed Dec. 19, 2003, now U.S. Pat. No. 7,136,608, entitled "Removeable Toner Cartridge Universal Adapter."

BACKGROUND OF THE INVENTION

1. Field of the Invention

This invention relates, generally, to toner cartridges. More particularly, it relates to a toner cartridge that fits a large plurality of printers of differing brands and models.

2. Description of the Prior Art

Printer manufacturers such as IBM, Lexmark, and the like also make the toner cartridges that fit their respective printers.

Some printer cartridges, such as those manufactured by Hewlett Packard, employ a single component design. However, most companies make a toner cartridge that includes a waste bin containing waste toner and a hopper containing the toner supply. The hopper is connected to the trailing end of the waste bin. The leading end of the waste bin is inserted into the printer first when a toner cartridge is being installed. The user holds the trailing end of the waste bin when the toner cartridge is installed and removed.

Each printer manufacturer designs its printers to accept toner cartridges manufactured by it and to reject the toner cartridges manufactured by others.

More particularly, to increase sales of their own toner cartridges, printer manufacturers have added structural features to the printers and to the toner cartridges that do not enhance the functional performance of the printer in any way but which serve to prevent use of a competitor's toner cartridge in the printer.

Printer manufacturers also prefer to sell new toner cartridges to replace empty toner cartridges. Therefore, they do not support the re-cycling industry.

Thus there is a need for a universal adapter that enables a single toner cartridge to be used with printers made by differing manufacturers and with differing printer models made by a common manufacturer. Such a universal adapter could be re-filled with toner when empty by the re-cycling industry.

The waste bin and hopper in conventional toner cartridges are pivotally interconnected to one another so that the hopper may move up and down in a vertical plane while the waste bin is secured into an immovable position. A full hopper has a weight sufficient to prevent it from pivotal movement, but as the hopper grows lighter as the toner therein is consumed, the hopper pivots upwardly under the influence of biasing means positioned at its opposite ends.

The pivotal interconnection ensures that a proper nip is formed between the photoconductive drum of the waste bin and the developer roller of the hopper. Such pivotal mounting requires the use of springs to interconnect the waste bin to the hopper. It also requires use of a shipping lock strap during shipping to prevent the hopper from bouncing inside the printer or toner cartridge shipping box during transportation.

There are several drawbacks to a pivotal interconnection of a waste bin and a hopper. The most obvious drawback is the need for an elongate spring at each end of the toner cartridge.

A first end of each spring must be secured to the waste bin and a second end thereof must be secured to the hopper. This makes the assembly of the toner cartridge more difficult and increases the time required to complete the assembly. Moreover, during remanufacturing of the toner cartridge, additional handling of the spring can cause the loss of necessary spring tension causing improper nip between the developer roller and the photoconductive drum.

Thus there is a need for an improved means for interconnecting a waste bin and a hopper. The improved interconnecting means should eliminate the pivotal mounting of the toner cartridge within the printer, eliminate the springs, and eliminate the need to use a shipping strap during transportation of the cartridge.

If the toner hopper and waste bin are not pivotally connected to one another, a new construction is required for holding the hopper and waste bin together.

The new construction must ensure that a proper nip is formed between the photoconductive drum that forms a part of the waste bin and the developer roller that forms a part of the hopper.

To insert a toner cartridge into a printer, the leading end of the waste bin is introduced into a waste bin-receiving cavity formed in the printer. A laterally extending wing, usually called a planar wing, is formed integrally with each side wall of the waste bin and is slidingly received within guide grooves formed on opposite sides of the waste bin-receiving cavity formed in the printer body.

The known planar wings are thin at their respective leading ends so that they can more easily enter into the guide grooves of the printer and thick at their respective trailing ends to provide more structural integrity. The leading ends are thus somewhat fragile and can be broken if a user does not exercise care when inserting a toner cartridge into a printer.

Thus there is a need for an improved, more robust planar wing design having a uniform thickness along its extent so that the leading end thereof is no thinner than the trailing end thereof. The more robust planar shape also improves installation and removal of the toner cartridge into and out of the printer.

A conventional waste bin may include a small circuit board that, if present, must enter into electrical communication with electrical contacts on the printer to activate the printer. More particularly, one or more connection pads are mounted on the circuit board. Electrical contacts mounted on the printer at a preselected location, such as a printer door, communicate electrically with said circuit board through said connection pads.

This invention also includes optical communication means that may replace any electrical communication means mentioned herein.

Some waste bins have a small, substantially horizontally-disposed mounting pad on a left edge of a top wall thereof that supports the circuit board that is aligned to mate with (through the aforementioned connection pads) the electrical contacts secured to an associated printer. Other waste bins have a small mounting pad just to the right of the left edge-mounted pad to mate with the electrical contacts of other printers. Still other waste bins have a small, vertically disposed mounting pad on a front wall of the waste bin.

Thus there is a need for a waste bin having both horizontally and vertically mounted pads that accommodate the circuit boards of all waste bins and which are positioned so that said circuit boards are properly positioned for electrical communication with the electrical contacts of the printer with which the waste bin is used. Such a waste bin does not appear in the prior art.

Conventional printers further include a microswitch that enables the printer to operate when its cartridge door is fully closed. More particularly, when the cartridge door is fully closed, it engages a door-closed microswitch-actuating tab having a thin, upstanding construction. As a printer ages, its hinges and latches become worn to the extent that the cartridge door no longer engages the actuating tab even when the cartridge door is fully closed. The microswitch is therefore not closed and no "door closed" signal is sent to activate the printer.

Thus there is a need for an improved tab that is engaged by a closed cartridge door even when the hinges and latches of a printer door have become worn. More particularly, when the hinges and latches of a printer door have become worn, the needed tab would act to better position the closing of the door by centering on the microswitch port.

Conventional toner cartridges are also difficult to insert into a printer. No dedicated gripping surface is provided so most users simply grasp the trailing end of the waste bin and hopper in a haphazard manner. The plastic on the trailing end of the waste bin has a lattice work or open mesh structure and a user is expected to place his or her fingers through various narrow slots provided by such lattice work when lifting and installing the toner cartridge. The fingers of many people cannot fit between the minimal clearance between the waste bin handle and hopper, thereby making the handling of the toner cartridge difficult. Since the cartridge has no dedicated handle, the user will most likely grasp the cartridge off center and the weight of the hopper and waste bin together will cause the toner cartridge to tilt relative to a horizontal plane as the user attempts to insert the toner cartridge into the printer. The toner cartridge often jams as a result.

Thus, there is a need for a toner cartridge with a dedicated gripping means that centers a user's hands relative to the trailing end of the toner cartridge so that it can be placed into the printer while being held in a horizontal plane. Nor should an improved handle rely on narrow slots as part of the gripping means.

Printers are also subject to jamming due to poorly designed media guides that are formed on the lower wall of the waste bin of a toner cartridge.

Accordingly, there is a need for an improved waste bin having improved media guides that reduce the frequency of paper jams.

Printers typically include downward forcing levers that bear against the toner cartridge after it has been inserted to keep the toner cartridge from rattling during printer operation. However, on the known cartridges, the levers bear against flat surfaces. Thus, if the toner cartridge is not installed properly, the levers bear against the cartridge and hold it in said improper position.

There is therefore a need for an improved design that would ensure that the toner cartridge is in its optimal position relative to the printer when the downward forcing levers of the printer engage the toner cartridge.

A toner cartridge is removed from a printer by manually lifting the trailing end of the toner cartridge relative to the stationary printer. However, in the known printer designs, very little clearance is provided for this lifting procedure, thereby increasing the degree of difficulty encountered when removing a toner cartridge. The small clearance also increases the difficulty associated with inserting a toner cartridge into a printer.

Thus there is a need for a design that increases the clearance to facilitate the introduction and removal of a toner cartridge into and from a printer, respectively.

The known toner cartridges also have a door, known as the shutter or upper shutter that is hingedly mounted to the top of the cartridge. The shutter pivots downwardly like a conventional door on a simple two pin hinge.

Thus a need is extant for an improved shutter construction.

However, in view of the prior art considered as a whole at the time the present invention was made, it was not obvious to those of ordinary skill in the pertinent art how the identified needs could be fulfilled.

SUMMARY OF THE INVENTION

The long-standing but heretofore unfulfilled need for a toner cartridge that is adapted to engage a large number of printers made by different manufacturers and which also includes improvements that overcome the limitations of prior art toner cartridges is now met by a new, useful, and non-obvious invention.

The novel toner cartridge is adapted to fit within a toner cartridge-receiving cavity of a printer. It includes a waste bin positioned at a leading end of the toner cartridge and a hopper connected to the waste bin at a trailing end of the waste bin.

The waste bin and hopper are fixedly interconnected to one another and are held against movement relative to one another when fully installed within the toner cartridge-receiving cavity.

The waste bin has a leading end sculpted to mate with the cartridge-receiving cavity of a plurality of printers. Therefore, the novel toner cartridge fits printers made by differing manufacturers and differing printer models made by a manufacturer.

The leading end of the waste bin has a hollow structure defined by a leading wall, a pair of sidewalls, a top wall, a bottom wall, and an open trailing end in open communication with the hopper. The leading wall has a transverse extent less than a transverse extent of the open trailing end so that the leading end of the waste bin mates with a printer having a toner cartridge receiving cavity having a relatively wide opening that tapers down to a relatively narrow opening.

A plurality of recesses is formed in the leading end of the waste bin to enable the leading end to mate with a plurality of printers. Some printers have no protrusions in their cartridge-receiving cavities, and others have one or more protrusions positioned at differing locations in said cavities. Significantly, each of the novel waste bins disclosed herein can mate with any printer. Thus it is appropriate to refer to the novel waste bin as a universal waste bin. Moreover, since a waste bin connected to a hopper forms a toner cartridge, it is appropriate to refer to the novel toner cartridge as a universal toner cartridge because it may be used with any printer among a plurality of printer families manufactured by differing companies that requires a removable toner cartridge.

The recesses may be provided in any shape that accepts the protuberances formed in the toner cartridge-receiving cavity. For example, a "V"-shaped protuberance in a printer's cartridge-receiving cavity may be accepted or received within a "V"-shaped recess formed in the waste bin of the toner cartridge that is at least slightly larger than the protuberance. However, a square or rectangular recess could also accept a "V"-shaped protuberance. The advantage to having a recess that closely mates with a protuberance is that such a recess maximizes the amount of toner that may be stored in a waste bin. If a recess formed in the waste bin is larger than it needs to be, then the space for toner within the waste bin is compromised.

In a first embodiment, the waste bin has a total of five recesses. Three equidistantly spaced apart recesses are formed in the leading end of the waste bin in laterally spaced relation to one another, and a recess is formed in each outboard corner of the waste bin. The three leading end recesses are hereinafter sometimes referred to as the first, second and third leading end recesses, and the two outboard recesses are sometimes hereinafter referred to as the first and second outboard recesses.

Another way of describing the respective positions of the recesses of the first embodiment, as well as the recesses of additional embodiments, is to define the leading end of the waste bin as having a first half and a second half. Thus, the first leading end recess is described as being positioned in the middle of the first half, the second leading end recess is described as being positioned at the mid-point or middle of the leading end, and the third recess is described as being positioned at the middle of the second half of the leading end.

In a second embodiment, the three leading edge recesses of the first embodiment are merged together to form a single elongate leading edge recess, and the two outboard recesses of the first embodiment are unchanged. Thus it can be said that the second embodiment includes first and second outboard recesses and an elongate leading end recess formed in the center of the leading end that has an extent sufficient to occupy almost all of the leading end.

A third embodiment of the waste bin includes an elongate step formed in the waste bin along the entire extent thereof. This may be understood as a merging together of all five recesses of the first embodiment.

A fourth embodiment merges together the first outboard recess and the first and second leading end recesses of the first embodiment. It further merges together the third leading end recess and the second outboard recess of the first embodiment. In other words, the fourth embodiment includes a first elongate recess that extends from a first outboard end of the leading end to a point about half-way along the extent of the first half of the leading end of the waste bin, and a second recess that extends from a second outboard end of the leading end to a point about half-way along the extent of the second half of the leading end of said waste bin.

In a fifth embodiment, the third leading end recess of the first embodiment is merged with the second outboard recess of the first embodiment. The first outboard recess and the first and second leading end recesses of the first embodiment are unchanged. Thus, this embodiment may be described as having said first outboard recess, said first and second leading end recesses, and a fourth recess that extends from the second outboard end of the leading end to a point about mid-length of the second half of said leading end.

A sixth embodiment merges together the first and second leading end recesses of the first embodiment. The first and second outboard recesses and the third leading end recess are unchanged from the first embodiment. This sixth embodiment therefore includes said first outboard recess, a second recess formed in said leading end that occupies almost all of the first half of the leading end from a mid-point of said leading end to a point near said first outboard recess, said third leading end recess, and said second outboard recess.

A seventh embodiment merges together the second and third leading end recesses of the first embodiment. The first and second outboard recesses and the first leading end recess are unchanged from the first embodiment. The seventh embodiment therefore may be said to include said first outboard recess, said first leading end recess, a second leading end recess that occupies the second half of said leading end, extending from about the mid-point of said second half to a point near the second outboard recess, and said second outboard recess.

An eighth embodiment merges together the first outboard recess and the first leading end recess of the first embodiment. The second and third leading end recesses and the second outboard recess are unchanged from the first embodiment. This embodiment thus includes a first recess that extends from a first outboard end of the leading end of the waste bin to a point about mid-length of the first half of said leading end, said second and third leading end recesses and the second outboard recess.

A ninth embodiment merges together the first outboard recess and the first leading end recess of the first embodiment. It further merges together the second and third leading end recesses and the second outboard recess of the first embodiment. Thus this embodiment includes a first recess that extends from a first outboard end of the leading end of the waste bin to a point about mid-length of the first half of said leading end, and a second recess that extends from said second outboard end of said leading end to a point about mid-length of said leading end of said waste bin.

A tenth embodiment merges together the first outboard recess and the first leading end recess of the first embodiment. It further merges together the third leading end recess and the second outboard recess of the first embodiment. The second leading end recess of the first embodiment is unchanged. It is therefore said that this tenth embodiment includes a first recess that extends from a first outboard end of the leading end of the waste bin to a point near said second leading end recess, said second leading end recess, and a third recess extending from said second end of said leading end to a point near said second leading end recess.

These ten (10) embodiments are illustrative of the invention and are not exhaustive thereof. As printer manufacturers add additional or different protuberances, still further recesses may be required in future embodiments of the invention but all such future embodiments are within the scope of this invention.

Moreover, as mentioned earlier, each embodiment of the ten (10) illustrative embodiments will fit into any printer cavity of certain brands and models, regardless of the number and placement of protrusions therein.

For example, the Optra® S printer has no protrusions in its cartridge-receiving cavity. Thus, none of the recesses formed in any of the ten embodiments are needed when the universal toner cartridge is inserted into the printer cavity of such printer.

The Optra® T printer, however, has one outboard protrusion.

Printers in the 520 family of printers include a center protrusion that mates with the second leading edge recess but such printer family includes no outboard protrusions.

Printers in the 620 printer family have no protrusions that mate with the three leading edge recesses, but they have two outboard protrusions.

Printers in the 630 printer family have one protrusion that mates with the first leading edge protrusion and no outboard protrusions.

Printers in the 632 and 634 sub-families have one protrusion that mates with the third leading edge recess and no outboard protrusions.

Thus, the various combination of leading end recesses and outboard recesses will work with all currently known printer families and sub-families and in view of this disclosure any future changes in printer-receiving cavity designs can be met.

In addition to the aforesaid embodiments of the sculpted leading end of the waste bin, the waste bin includes multiple additional improvements as well, none of which depend upon the sculpted leading end thereof.

A first improvement unrelated to the sculpted leading end of the waste bin is a first circuit board mounting pad formed in a substantially horizontal top wall of the waste bin. The mounting pad accommodates a user-operated selector switch that indicates a printer brand with which the novel universal toner cartridge is to be used. The first circuit board mounting pad has a size sufficient to hold a large circuit board with large electrical contacts that mates with printer-mounted contacts that may be in a first, left position or a second, right position. Thus it is understood that the circuit board is also a universal circuit board because it has a size sufficient to enter into electrical communication with printers having left-mounted contacts or right-mounted contacts.

A second improvement unrelated to the sculpted leading end includes a second circuit board mounting pad positioned on a vertical wall of the waste bin. The second circuit board mounting pad is smaller than the first circuit board mounting pad and is adapted to mate with a third group of printers that include relatively small circuit boards that mate with mounting pads positioned near the front left edge of the waste bin. However, the second circuit board mounting pad is also designed to accommodate a larger circuit board that supports larger components or a greater number of components. Thus, the second circuit board mounting pad is also universal in operation because it can receive small and large circuit boards.

Another improvement enhances the ergonomics of a toner cartridge. A thumb grip, dished to accept a thumb, is formed in the trailing end of the waste bin, centrally thereof. An arch extends transversely across the trailing end of the waste bin and rises to a height sufficient to accommodate a user's fingers when the user's thumb is positioned in the thumb grip.

A toner cartridge is further improved by enhancing the media guides formed in a bottom wall of the waste bin. Specifically, rounded surfaces are formed in each of the media guides to reduce friction as paper is dragged over them.

A hopper torque tab receptacle, having a relatively larger opening and rounded edges, is formed in the waste bin and is adapted to vertically receive a tab formed in the hopper when the waste bin is connected to the hopper. In this way, the hopper is keyed to the waste bin, preventing lateral movement between the hopper and waste bin when a driving force is applied to the hopper.

An improved microswitch actuating tab is formed in upstanding relation to a top wall of the waste bin. It is adapted to actuate a microswitch that is adapted to activate the printer when a printer door is fully closed. The microswitch-actuating tab has a height sufficient to actuate the microswitch even when the door of the printer has worn latches or hinges and therefore does not fully close. A first embodiment of the novel microswitch has a uniform thickness and is taller than a conventional actuating tab. It therefore provides a more positive engagement of the microswitch. A second embodiment is somewhat diamond-shaped, being thicker at mid-height than at its top and bottom. Both embodiments are structurally stronger than prior art microswitch actuating tabs and have greater height so that they remain effective even when the hinges and latches of the printer door are worn, loose, or on otherwise poor condition.

The printer therefore receives an activating signal when the door of the printer is closed even if the printer has worn latches and hinges.

The first embodiment of the microswitch-actuating tab has a uniform thickness and taller protrusion that provides for a more positive engagement of the microswitch.

The second embodiment of the microswitch-actuating tab has a top section, a mid-section, and a bottom section. The top section widens from top to bottom, the bottom section narrows from top to bottom, and the mid-section is wider than the top section and the bottom section.

The narrow top edge of the microswitch actuating tab facilitates its entry into a narrow opening formed in the bottom edge of the printer door and the widened middle section helps the microswitch actuating tab to positively engage the narrow opening. This structure therefore is operative to center a printer door having worn hinges.

Yet another improvement relates to a planar wing that is formed in each sidewall of the waste bin. Each planar wing is adapted to slidingly engage an associated guide groove formed in opposite sides of the printer. Advantageously, each planar wing has a uniform thickness along its extent, thereby providing structural integrity and preventing the planar wing from flexing when the waste bin is being installed into the printer. The reduction in rearward sloping angle of the planar wing allows for easier installation and removal of the cartridge from the printer.

A second embodiment of the planar wing includes three supporting wheels in lieu of a continuous plane. These wheels provide support at key positions to allow for support during installation, engagement and removal of the cartridge from the printer.

A concave depression adapted to receive downward forcing levers that form a part of the printer is formed in a top edge of each sidewall. The concave depression is effective to center downwardly directed force provided by the downward forcing levers.

A recess is also formed in a top edge of each waste bin sidewall to provide clearance for the waste bin when it is pivoted upwardly relative to the printer during removal.

A hopper pin-mounting hole is formed in each waste bin sidewall and is adapted to receive a mounting pin formed in the hopper with zero vertical clearance. Accordingly, the hopper does not move relative to the waste bin when the hopper and waste bin are interconnected to one another. Moreover, no shipping strap is required when the hopper and waste bin are transported as a unit in interconnected relation to one another.

A latching means for interconnecting the waste bin and the hopper to one another in a non-pivotal interconnection includes a hopper wheel horizontal retainer and a hopper wheel vertical lock formed integrally with the waste bin. The hopper wheel horizontal retainer and the hopper wheel vertical lock are disposed in cooperative relation to one another and are adapted to engage a hopper wheel that forms a part of the hopper. To assemble the toner cartridge, the waste bin is held above the hopper so that the hopper wheel horizontal retainer and the hopper wheel vertical lock are positioned directly above the hopper wheel. The waste bin is lowered until the hopper wheel horizontal retainer engages the hopper wheel and the hopper wheel vertical lock.

The hopper wheel horizontal retainer has an upwardly inclined surface, a concavity, and a hump between the upwardly inclined surface and the concavity. The hopper wheel engages the upwardly inclined surface and causes the hopper wheel horizontal retainer to momentarily deflect from its position of repose when the waste bin is lowered with respect to the hopper. The hopper wheel rolls over the hump and the resiliency of the hopper wheel horizontal retainer causes the hopper wheel horizontal retainer to return to its position of repose, thereby capturing the hopper wheel in the concavity. The hopper wheel simultaneously causes the hopper wheel vertical lock to deflect away from its position of repose as well. The hopper wheel vertical lock has a straight construction and a hook formed at a free leading end thereof.

The vertical lock returns to its position of repose, thereby capturing a bottom of the hopper wheel when the hopper wheel clears the hook. Accordingly, the hopper wheel is captured on a trailing side thereof by the concavity and on its bottom side by said hook.

The invention also includes an embodiment having the hopper wheel horizontal retainer but no hopper wheel vertical lock.

In another embodiment, the hopper wheel vertical lock is formed in depending relation to a preselected sidewall of the waste bin. A guide rail is integrally formed with a preselected sidewall of the waste bin. The hopper wheel rollingly engages the guide rail as the waste bin is lowered into interconnecting relation to the hopper. The hopper wheel rolls along the guide rail until the hook captures it.

An aperture adapted to receive a mounting pin from the hopper is formed in each sidewall of the waste bin near a trailing end thereof. A taper is formed in the aperture so that the aperture is smaller on the outside surface of the sidewall than on an inside surface thereof. When the waste bin is lowered onto the hopper to interconnect the waste bin and hopper together, the hopper mounting pin enters into the tapered aperture. The taper urges the hopper into abutting relation to the waste bin and eliminates play from the aperture and therefore eliminates any need for springs to urge the hopper into abutting relation with the waste bin.

In a further embodiment, the hopper wheel has an axle. A retainer is formed by a raised wall formed in a preselected sidewall of the waste bin that captures and guides the hopper wheel axle when the waste bin is lowered into interconnecting relation to the hopper. A lowermost end of the retainer has a forwardly extending bend formed therein so that as the taper urges the hopper into abutting relation to the waste bin, the hopper wheel axle is pushed into the forward bend. A nip formed by contact between the photoconductive drum of the waste bin and the developer roller of the hopper is thereby maintained.

In another embodiment, a straight, horizontally disposed slot is formed in the waste bin sidewalls on both the driving and the driven sides thereof. The hopper wheel axles are aligned with the slots and are slidingly introduced thereinto to join the waste bin and hopper to one another. The hopper mounting pins are inserted into the tapered aperture so that the respective tapered walls shove the hopper forward until the hopper wheel axles are fully pressed into said forward ends of the slots. This structure eliminates the hopper wheel horizontal retainer and the hopper wheel vertical lock. This structure also maintains a nip formed by contact between the photoconductive drum of the waste bin and the developer roller of the hopper.

To prevent piggybacking of an unauthorized circuit board over an authorized circuit board, a flat mounting surface adapted to receive a first circuit board is formed in a vertical wall of the waste bin, an upper arcuate member extends from a point just above the flat mounting surface to a lower surface of the planar wing and a lower arcuate member extends from a point just below the flat mounting surface to a preselected point at a still further lower elevation. The upper and lower arcuate blocking members obstruct the placing of an unauthorized circuit board over an authorized circuit board.

To improve the he construction of the upper shutter door, a slot is added to the inner and upper sidewall of the driven side of the waste bin. The shutter is made in the form of a bi-fold door and the two halves are hinged to one another by a hinge that extends into the slot and is therefore constrained to travel along the length of the slot. The driving side of the shutter travels freely.

More particularly, a substantially horizontal slot is formed in an interior sidewall of the toner cartridge on a driven side of the toner cartridge. The substantially horizontal slot is adapted to slidingly receive a hinge pin of a shutter door. In a first embodiment of the shutter assembly, the shutter has a bi-fold door construction. In a second embodiment, the shutter door assembly has an accordion construction. In further embodiments, it has a tri-fold construction, a sliding pocket door construction that is telescopically received within a pocket when retracted, and in a final illustrative embodiment, the shutter is flexible and is coiled about a reel when retracted and uncoiled from the reel when extended.

An important object of this invention is to provide a toner cartridge that can be used with substantially any commercially available printer of certain families.

Another important object is to provide a waste bin and hopper construction that positively engage one another in the absence of a pivotal connection.

Additional objects include the provision of a toner cartridge having improved planar wings, a plurality of circuit board mounts, an improved "door open" microswitch depressor, a dedicated gripping surface, enhanced media guides, an improved interface with the downward forcing levers of the printer, and improved clearance.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which:

FIG. 7A is a perspective view of an alternative embodiment of the novel interconnection means taken from the interior, driving side of the waste bin;

FIG. 7B is a perspective view of the alternative embodiment of the novel interconnection means of FIG. 7A taken from the interior, driven side of the waste bin;

FIG. 7C is a top plan view of a side wall of the driven side of the waste bin, depicting an opening formed therein that is adapted to receive a hopper mounting pin;

DETAILED DESCRIPTION OF THE PREFERRED EMBODIMENT

Figure 1A:
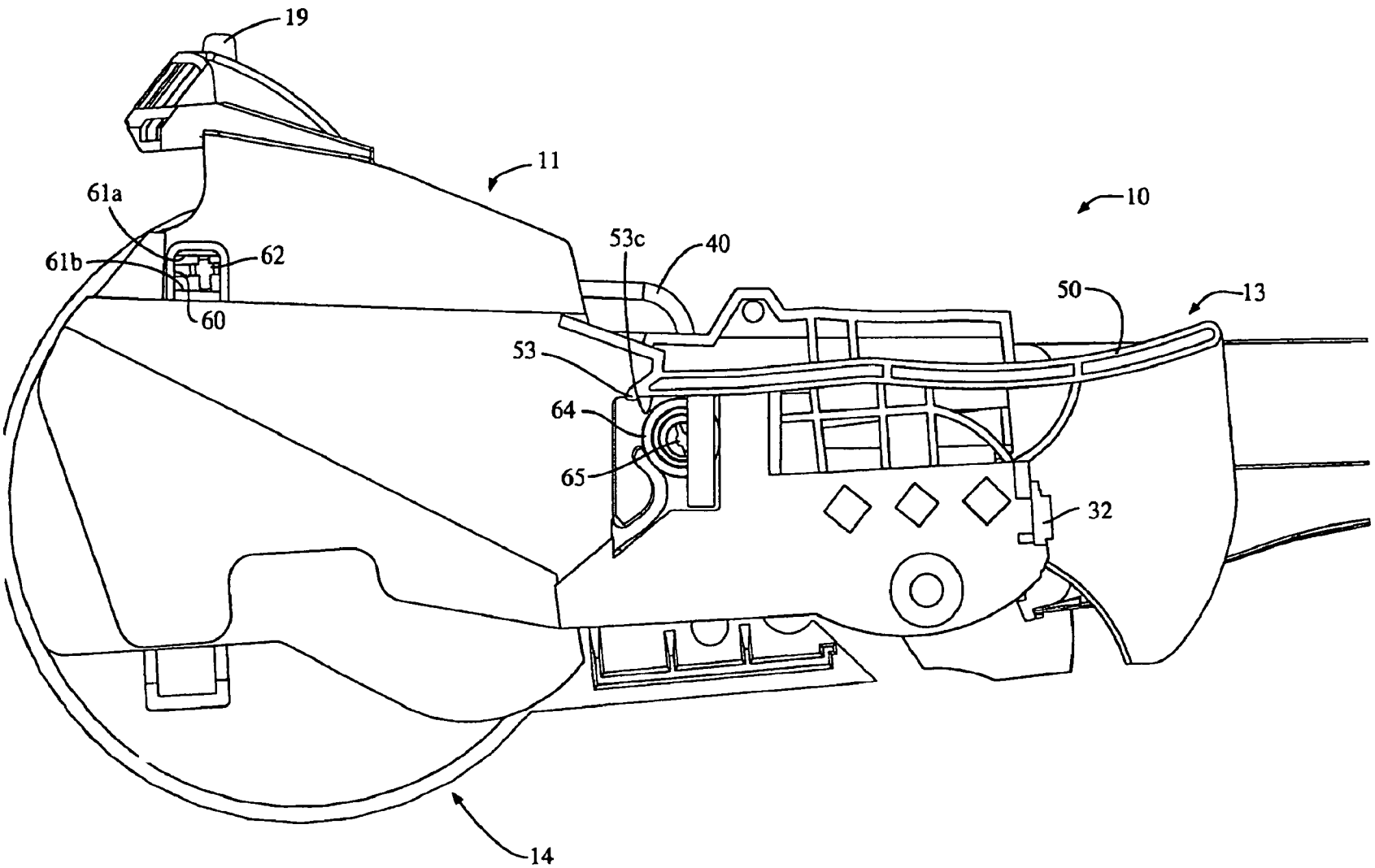
FIG. 1A is a side elevational view of the novel toner cartridge.

Referring now to FIG. 1A, it will there be seen that the reference numeral 10 denotes an illustrative embodiment of the novel toner cartridge as a whole. Novel toner cartridge 10 is made by interconnecting waste bin 12 of FIG. 1B to hopper 14 of FIG. 1C to one another. More particularly, as suggested by the alignment of parts in FIGS. 1B and 1C, trailing end 11 of waste bin 12 is positioned over hopper 14 and said waste bin is then lowered until said two parts are interconnected. The details of how the interconnection is accomplished are disclosed more fully hereinafter.

As best understood in connection with FIGS. 2A-J, leading end 13 of waste bin 12 is sculpted so that it can mate with a plurality of families of printers manufactured by differing manufacturers.

Leading end 13 includes flat top wall 15*a* that is disposed in a substantially horizontal plane when waste bin 12 is properly installed and flat vertical front wall 15*b*.

Figure 2A:
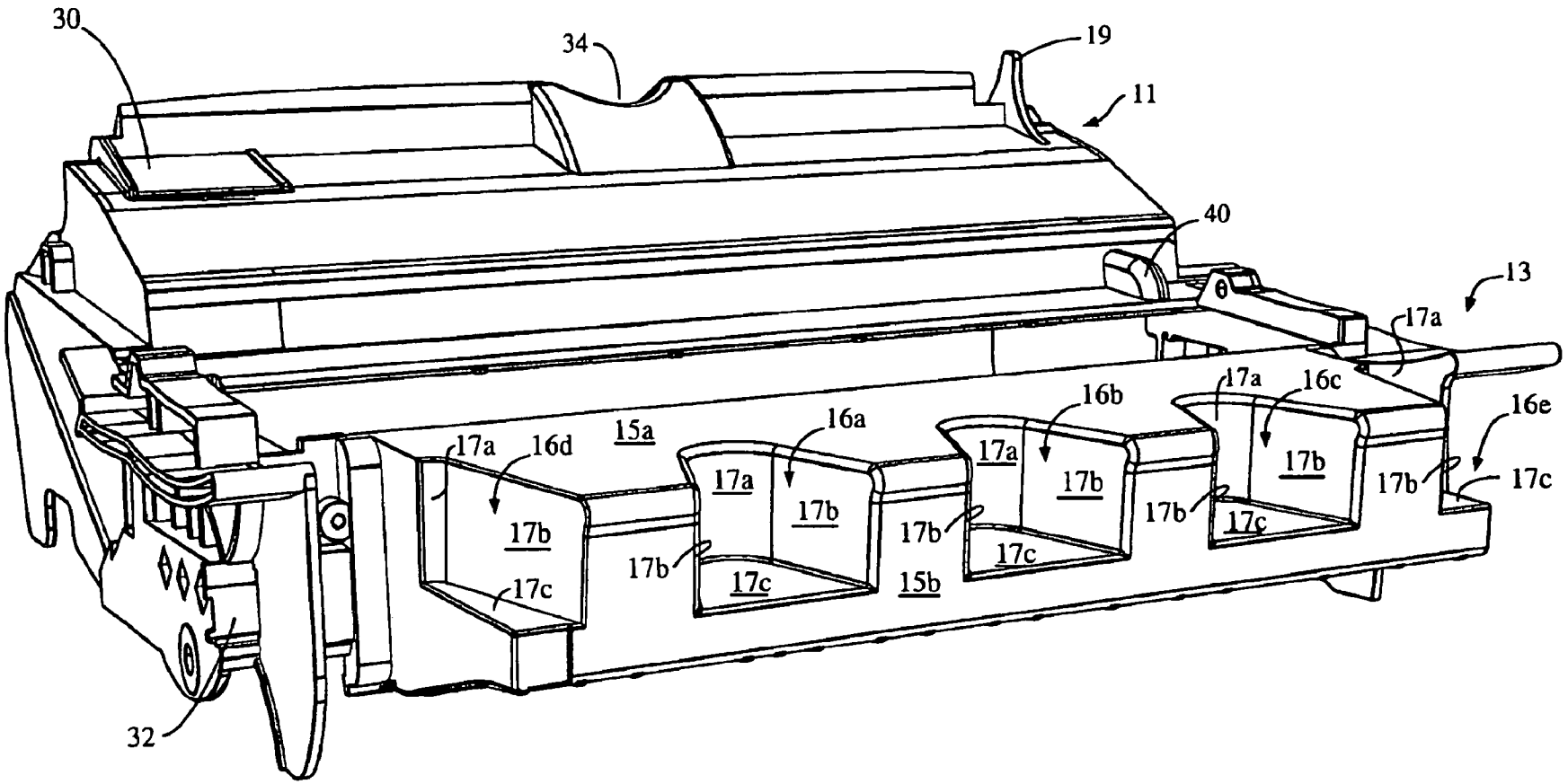
FIG. 2A is a front perspective view of a first embodiment of the novel toner cartridge universal adapter.

In FIG. 2A, leading end recesses 16*a*, 16*b*, and 16*c* having a common size and configuration are formed in leading end 13 in equidistantly spaced relation to one another and in centered relation with respect to said leading end.

Each of the leading end recesses includes an arcuate back wall 17*a*, flat vertical sidewalls 17*b*, and a flat bottom wall 17*c*. Two (2) outboard recesses having a common size and configuration 16*d* and 16*e* are formed in opposite ends of leading end 13. Both of the outboard recesses include an arcuate back wall 17*a* having less transverse extent than the respective arcuate back walls 17*a* of the full recesses, one vertical flat wall 17*b*, and a flat bottom wall 17*c* having less transverse extent than the respective flat bottom walls 17*c* of the leading end recesses.

A leading end sculptured in the manner of FIG. 2A mates with Lexmark printer models Optra S 1250, Optra S 1255, Optra S 1620, Optra S 1625, Optra S 1650, Optra S 1855, Optra S 2420, Optra S 2450, Optra S 2455, Optra SE 3455, Optra T610, Optra T612, Optra T614, Optra T616, Optra T520, Optra T522, Optra T620, Optra T622, Optra T630, Optra T632, and Optra T634, with IBM printer models Infoprint 1120, Infoprint 1125, Infoprint 1130, Infoprint 1140, Infoprint 1332, Infoprint 1352, and Infoprint 1372, with Source Technology printer models ST915, ST920, ST925, ST935, ST9120, ST9125, ST9130, ST 9140, ST 9325, ST9335, and ST9340, with Unisys printer models UDS 9712, UDS9716, UDS9718, UDS9724, UDS3034, UDS 15, UDS20, UDS25, UDS35, UDS 130, UDS 132, UDS 134, UDS 136, UDS 140, and UDS 142, with Toshiba printer models e-Studio20P, e-Studio25P, e-Studio30P, e-Studio 40P and e-Studio 400P, with Dell printer models M5200n and W5300n, Nashuatec P6220, Nashuatec P6225, Nashuatec P6230, and with the Nashuatec P6240.

There may be other printer models that are accommodated by the novel universal toner cartridge of this invention and the invention is not limited to use with the printer models expressly listed herein. The above lengthy list of printer models is provided merely to establish the universal nature of the present invention.

Figure 1B:
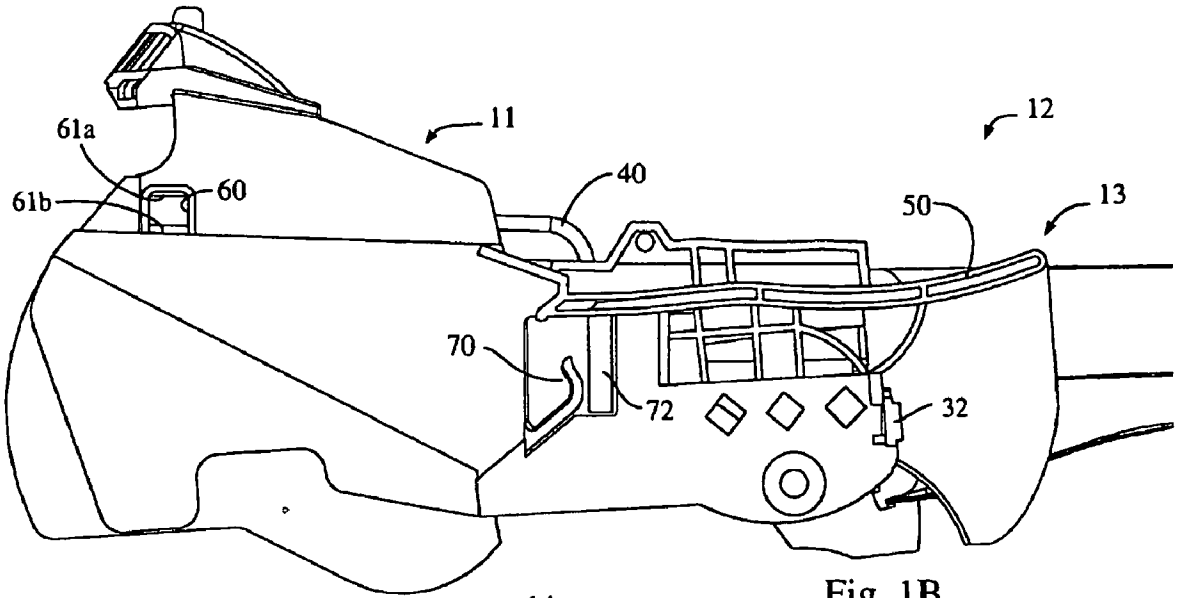
FIG. 1B is a side elevational view of the novel toner cartridge universal adapter.
Figure 2B:
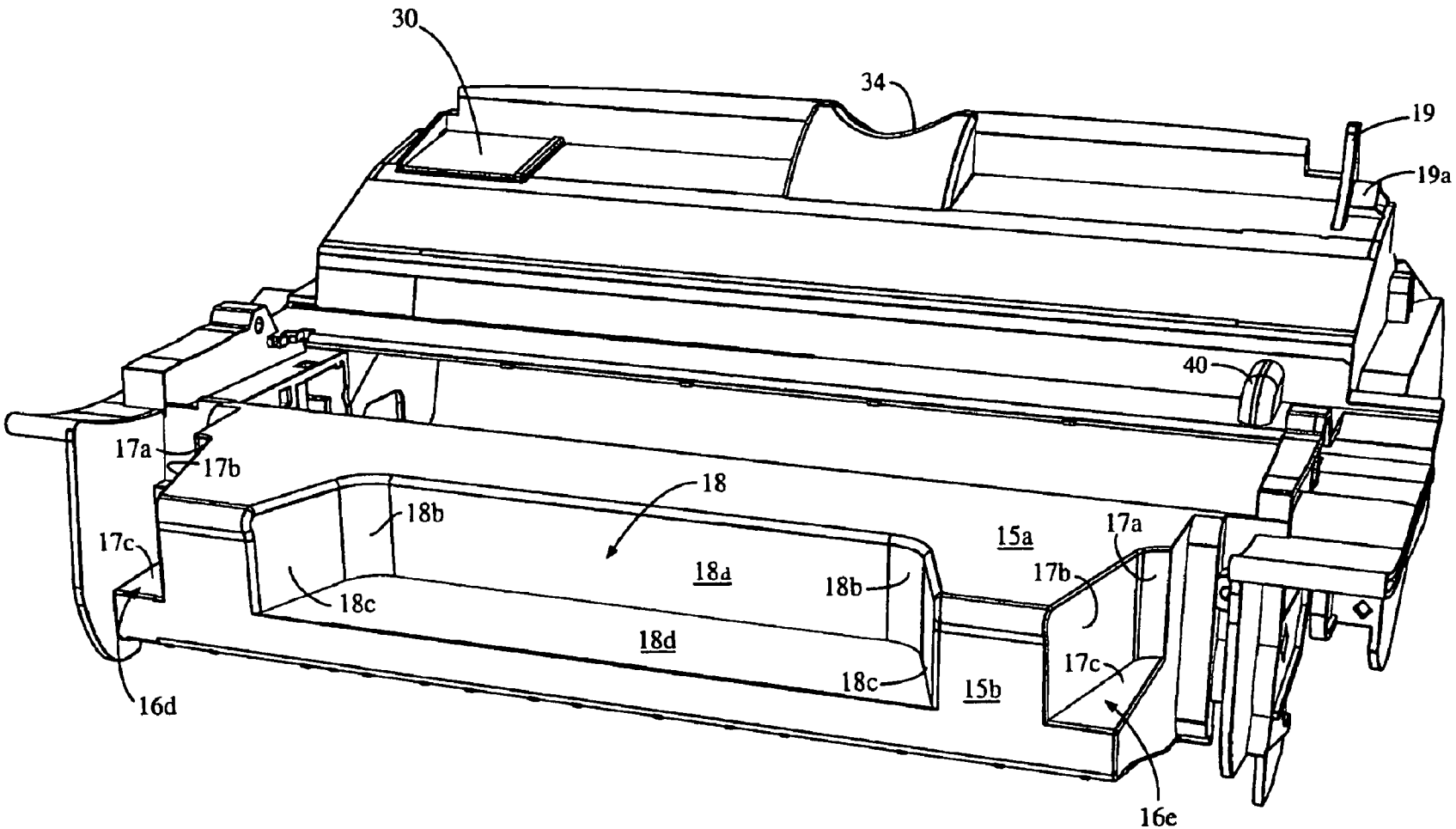
FIG. 2B is a side perspective view of a second embodiment of the novel toner cartridge universal adapter.

FIGS. 1A and 1B further depict the uppermost end of a first embodiment of an improved microswitch actuating tab 19. Tab 19 is thicker (wider) and taller than the tabs heretofore known; note from said FIGS. 1A and 1B that it is higher than the handle of waste bin 12. Tab 19, as best depicted in FIGS. 2B and 2D, is supported on the outboard side of its base by a structure 19*a* that includes a horizontal wall supported at its leading and trailing ends by a pair of vertical walls as best depicted in FIG. 2B. The increased height ensures that tab 19 continues to function in its intended manner even when the hinges and latches of the printer have become worn. Support structure 19*a* helps prevent flexing and breakage of tab 19 by a misaligned printer door having worn hinges and latches.

In FIG. 2B, leading end recesses 16*a*, 16*b*, 16*c* of the FIG. 1A embodiment are merged together to create one elongate centered leading end recess 18 having flat back wall 18*a*, arcuate walls 18*b*, 18*b* at opposite ends of said flat back wall, flat sidewalls 18*c*, 18*c*, and flat bottom wall 18*d*. Outboard recesses 16*d*, 16*e* of the FIG. 2A embodiment are retained in this second embodiment. A leading end sculptured in the manner of FIG. 2B mates with the printer models listed above in connection with the embodiment of FIG. 2A and with the above-mentioned printer models that may presently exist, or which may in the future be provided, that are not expressly included in said list.

Figure 2C:
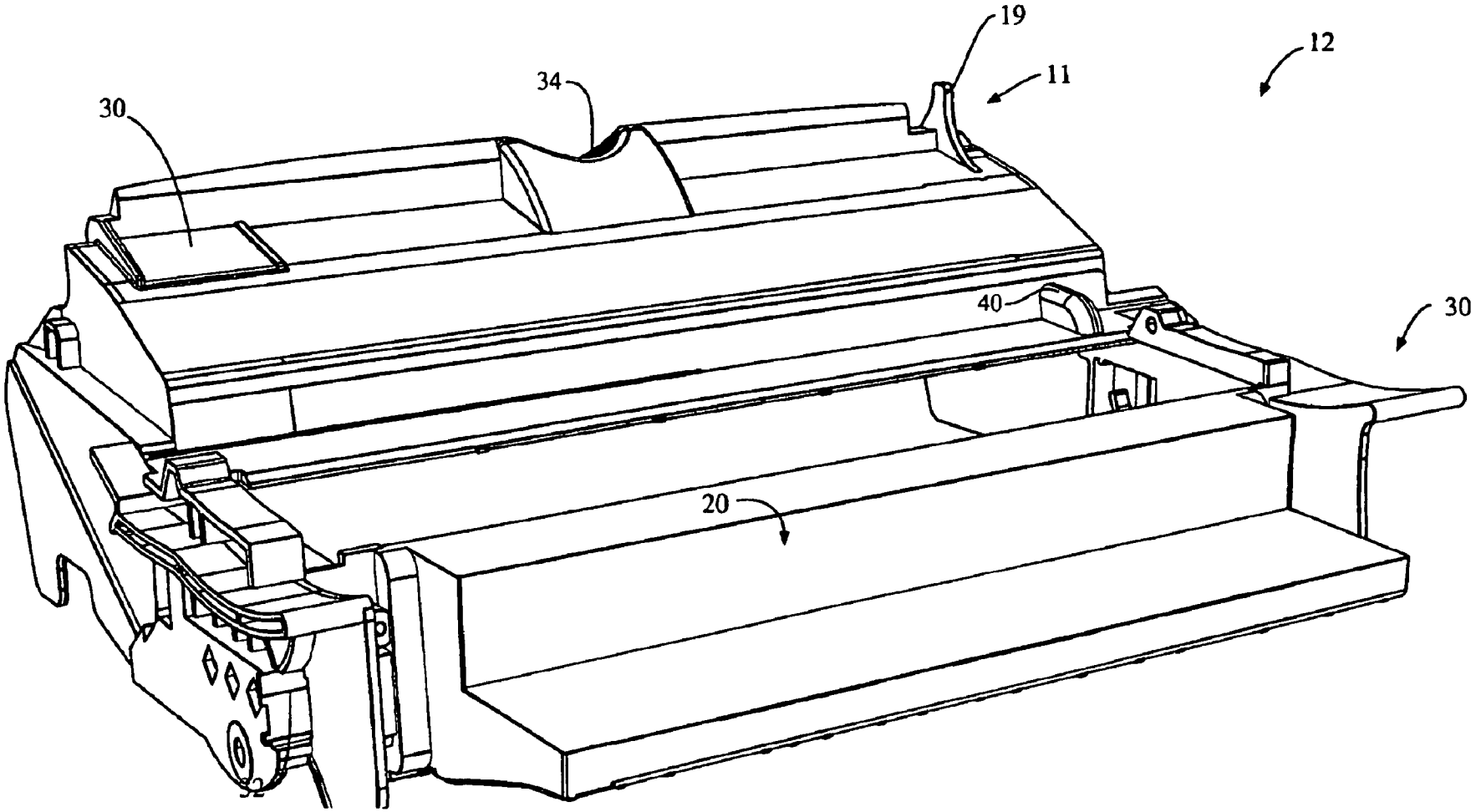
FIG. 2C is a side perspective view of a third embodiment of the novel toner cartridge universal adapter.
Figure 2D:
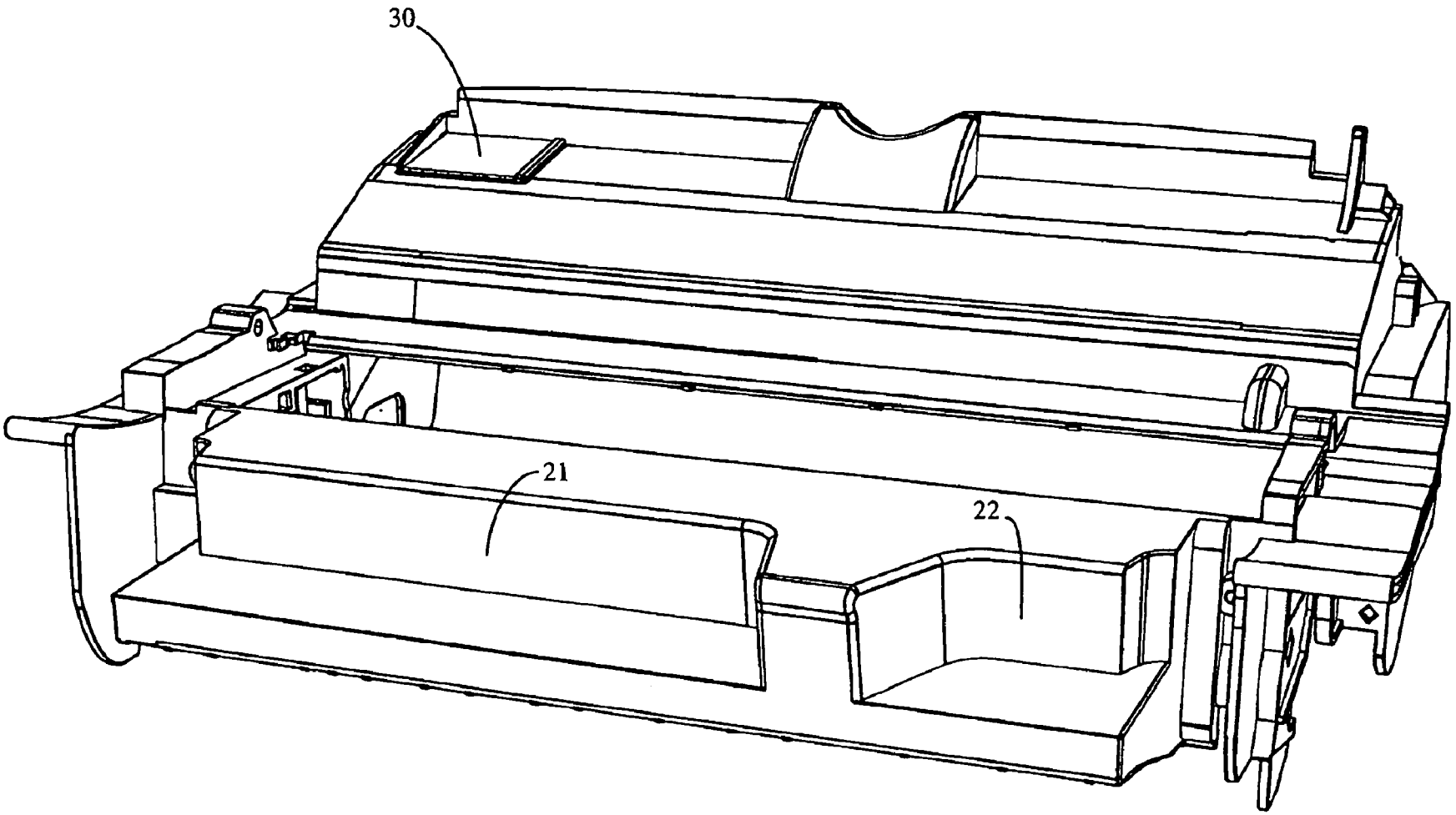
FIG. 2D is a front perspective view of a fourth embodiment of the novel toner cartridge universal adapter.

In FIG. 2C, leading end recesses 16*a*, 16*b*, 16*c*, and outboard recesses 16*d*, 16*e* of the FIG. 2A embodiment are merged with one another to create step-shaped recess 20 that extends the entire transverse extent of leading end 13 of waste bin 12. A leading end sculptured in the manner of FIG. 2C mates with the printer models listed above in connection with the embodiment of FIG. 2A and with the above-mentioned printer models that may presently exist, or which may in the future be provided, that are not expressly included in said list.

In FIG. 2D, outboard recess 16*d* and leading end recesses 16*a*, 16*b* are merged together to form elongate recess 21 as are leading end recess 16*c* and outboard recess 16*e* of the FIG. 2A embodiment to form recess 22. A leading end sculptured in the manner of FIG. 2D mates with the printer models listed above in connection with the embodiment of FIG. 2A and with the above-mentioned printer models that may presently exist, or which may in the future be provided, that are not expressly included in said list.

Figure 2E:
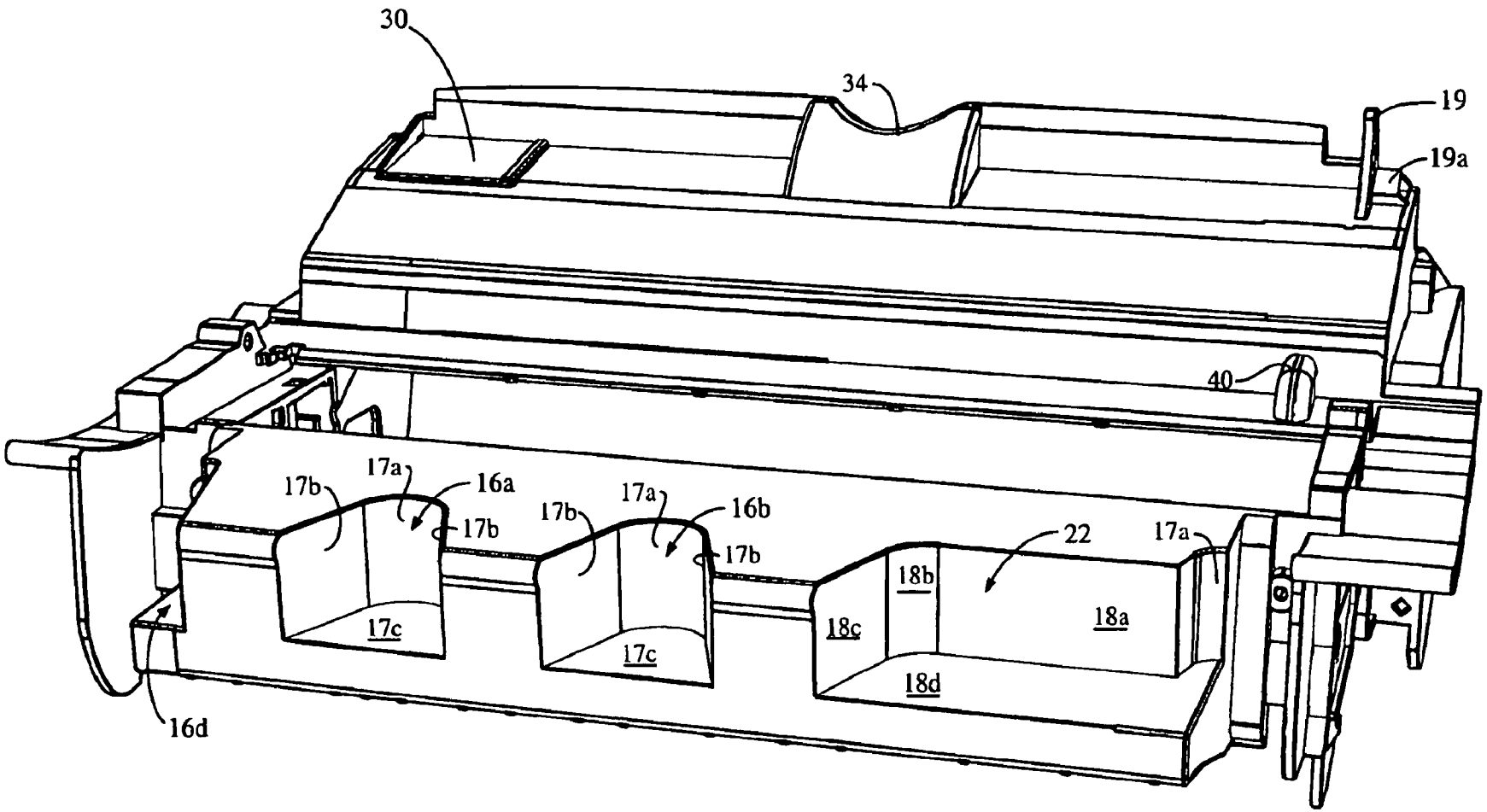
FIG. 2E is a side perspective view of a fifth embodiment of the novel toner cartridge universal adapter.

The embodiment of FIG. 2E is attained by modifying the embodiment of FIG. 2A by merging together leading end recess 16*c* and outboard recess 16*e* to form recess 22. Outboard recess 16*d* and leading end recesses 16*a* and 16*b* of said FIG. 2A embodiment are unchanged. A leading end sculptured in the manner of FIG. 2E mates with the printer models listed above in connection with the embodiment of FIG. 2A and with the above-mentioned printer models that may presently exist, or which may in the future be provided, that are not expressly included in said list.

Figure 2F:
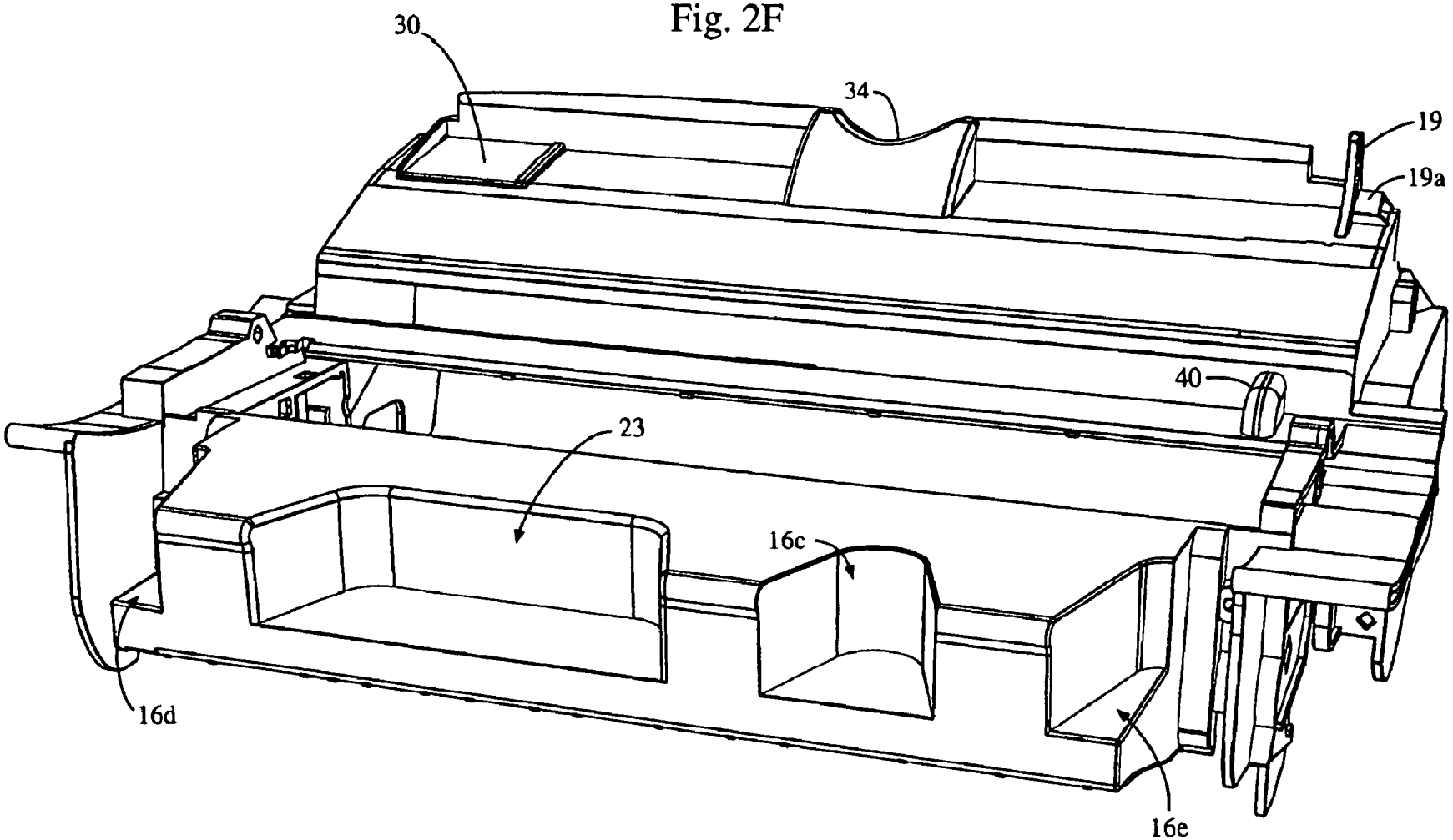
FIG. 2F is a side perspective view of a sixth embodiment of the novel toner cartridge universal adapter.

The embodiment of FIG. 2F is attained by modifying the embodiment of FIG. 2A by merging together leading end recesses 16*a* and 16*b* thereby creating elongate recess 23. Leading end recess 16*c* and outboard recesses 16*d* and 16*e* of the FIG. 2A embodiment are unchanged. A leading end sculptured in the manner of FIG. 2F mates with the printer models listed above in connection with the embodiment of FIG. 2A and with the above-mentioned printer models that may presently exist, or which may in the future be provided, that are not expressly included in said list.

Figure 2G:
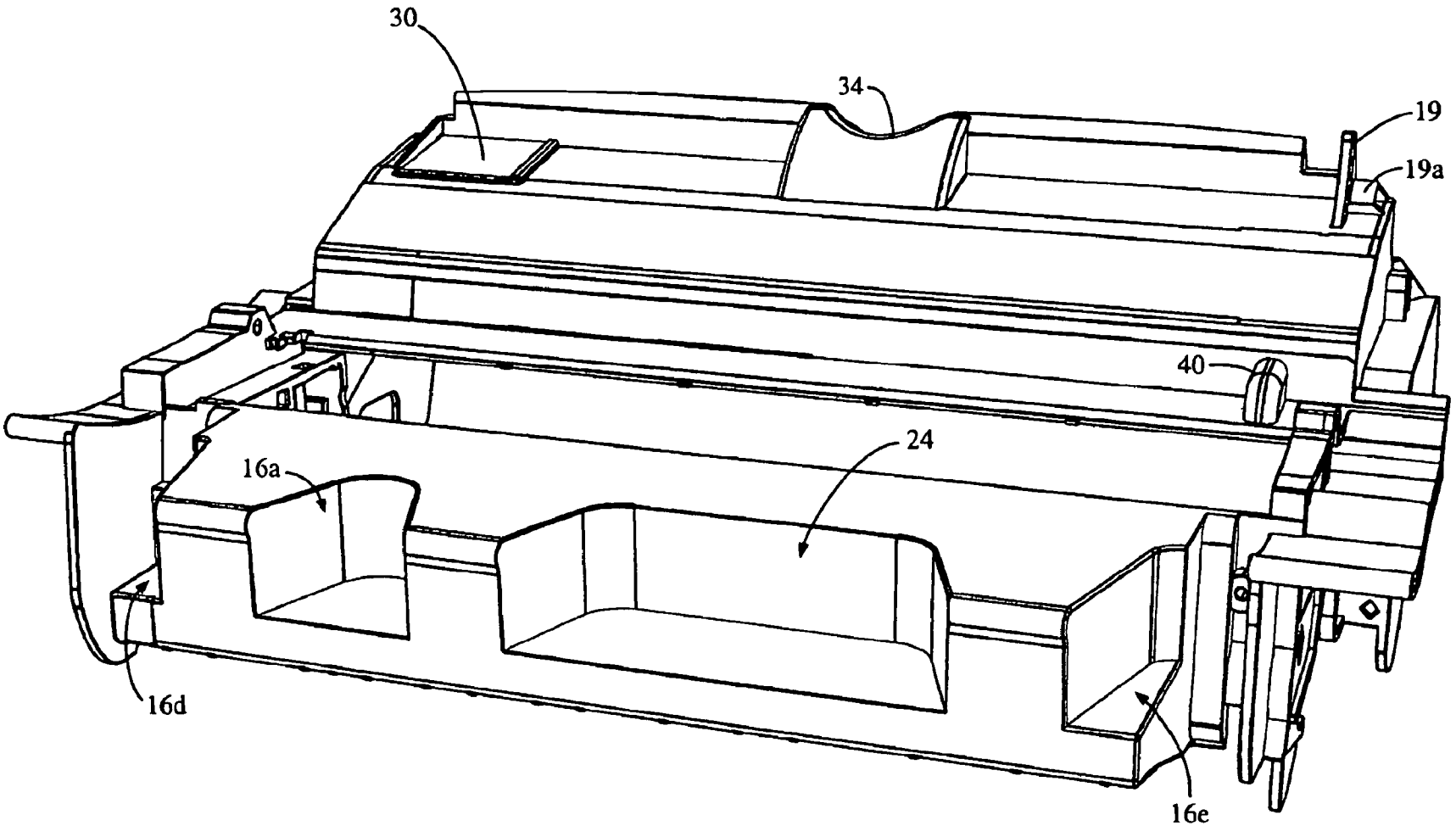
FIG. 2G is a side perspective view of a seventh embodiment of the novel toner cartridge universal adapter.

The embodiment of FIG. 2G is attained by modifying the embodiment of FIG. 2A by merging together leading end recesses 16*b* and 16*c*, thereby creating elongate recess 24. Leading end recess 16*a* and outboard recesses 16*d*, 16*e* of said FIG. 2A embodiment are unchanged. A leading end sculptured in the manner of FIG. 2G mates with the printer models listed above in connection with the embodiment of FIG. 2A and with the above-mentioned printer models that may presently exist, or which may in the future be provided, that are not expressly included in said list.

Figure 2H:
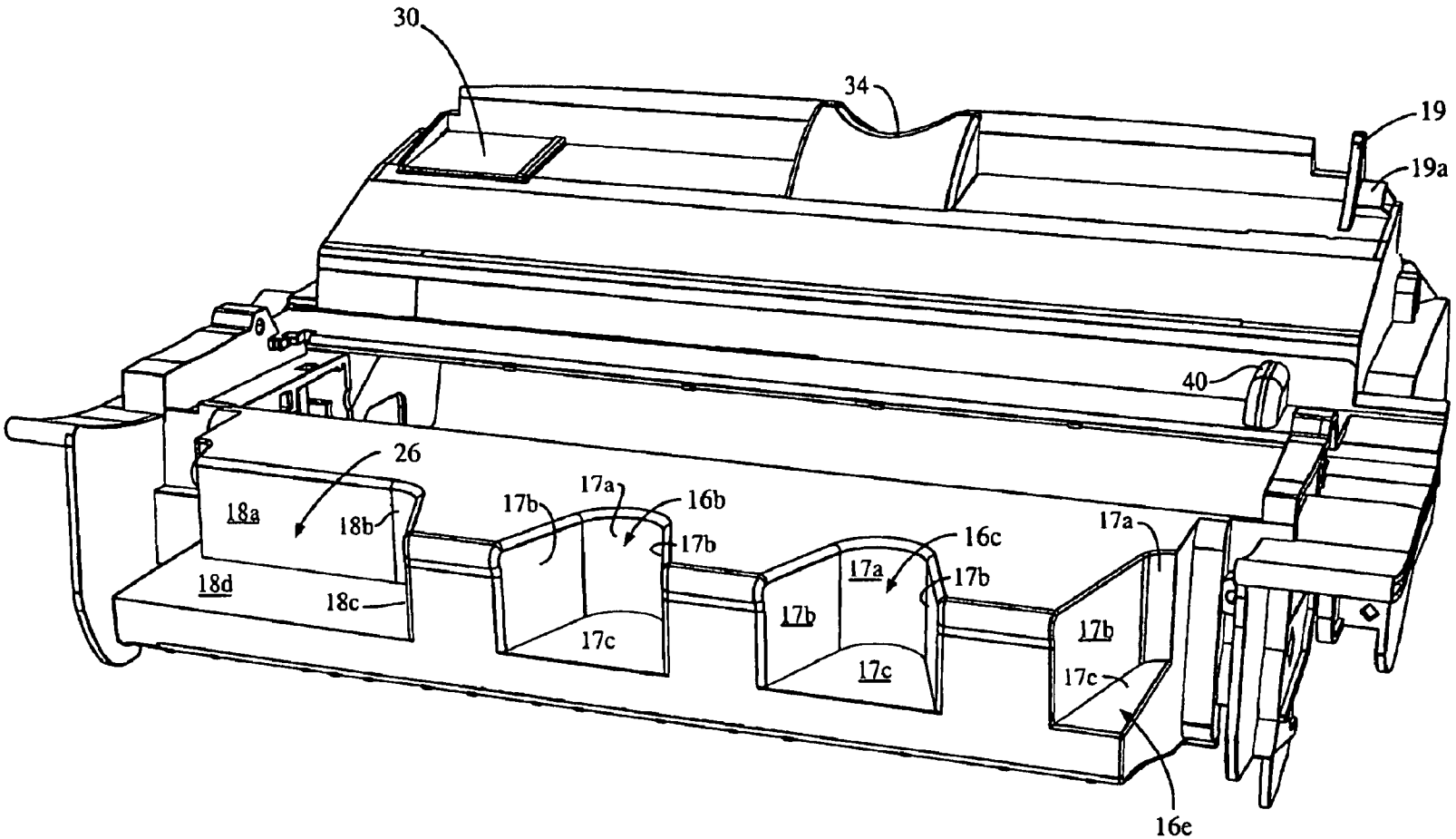
FIG. 2H is a side perspective view of an eighth embodiment of the novel toner cartridge universal adapter.

The embodiment of FIG. 2H is attained by modifying the embodiment of FIG. 2A by merging together outboard recess 16*d* and leading end recess 16*a*, thereby creating recess 26, Leading end recesses 16*b* and 16*c* and outboard recess 16*e* are unchanged. A leading end sculptured in the manner of FIG. 2H mates with the printer models listed above in connection with the embodiment of FIG. 2A and with the above-mentioned printer models that may presently exist, or which may in the future be provided, that are not expressly included in said list.

Figure 2I:
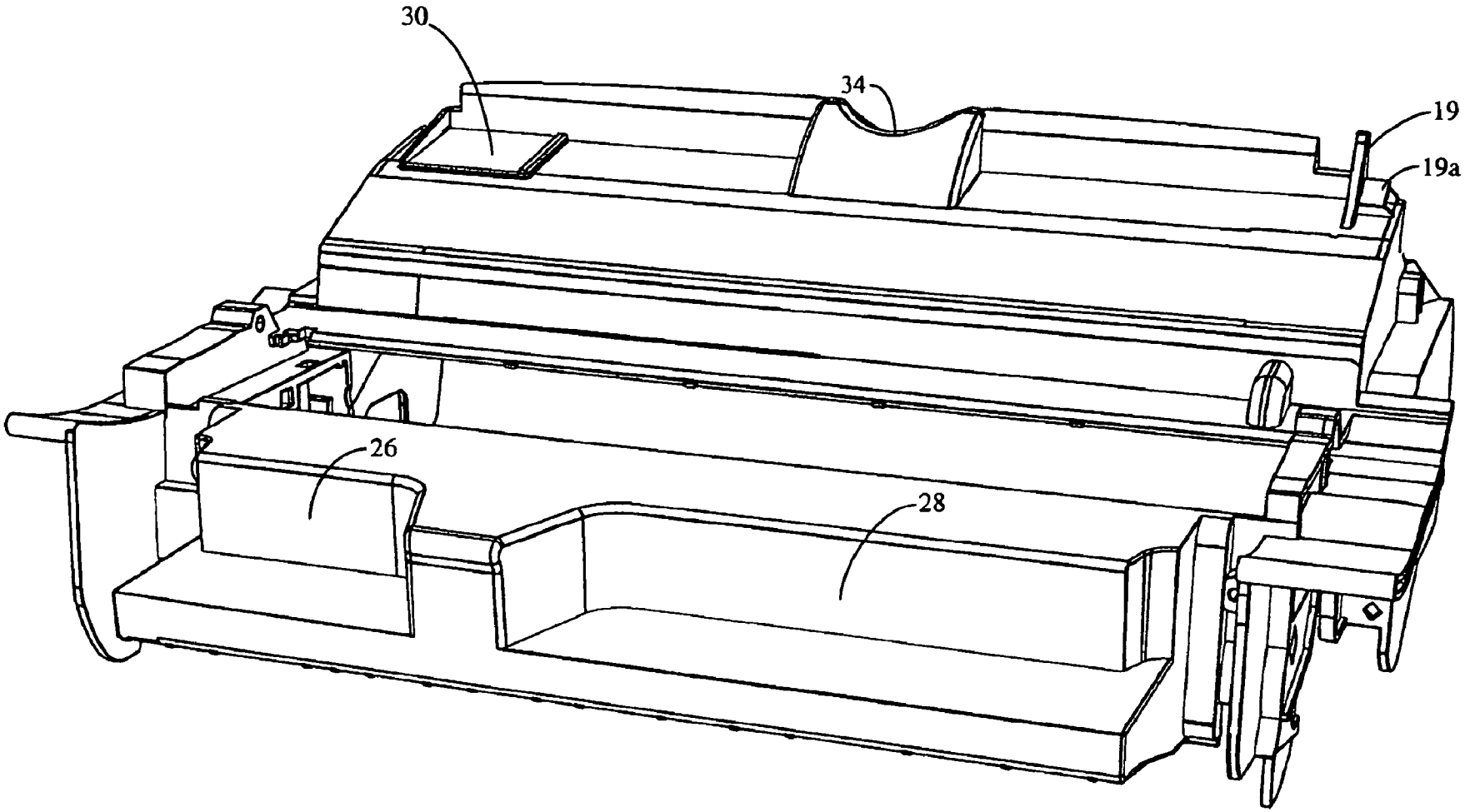
FIG. 2I is a side perspective view of a ninth embodiment of the novel toner cartridge universal adapter.

The embodiment of FIG. 2I is attained by modifying the embodiment of FIG. 2A by merging together outboard recess 16*d* and leading end recess 16*a* to form recess 26 and by merging together leading end recesses 16*b*, 16*c*, and outboard recess 16*e* to form elongate recess 28. A leading end sculptured in the manner of FIG. 2I mates with the printer models listed above in connection with the embodiment of FIG. 2A and with the above-mentioned printer models that may presently exist, or which may in the future be provided, that are not expressly included in said list.

Figure 2J:
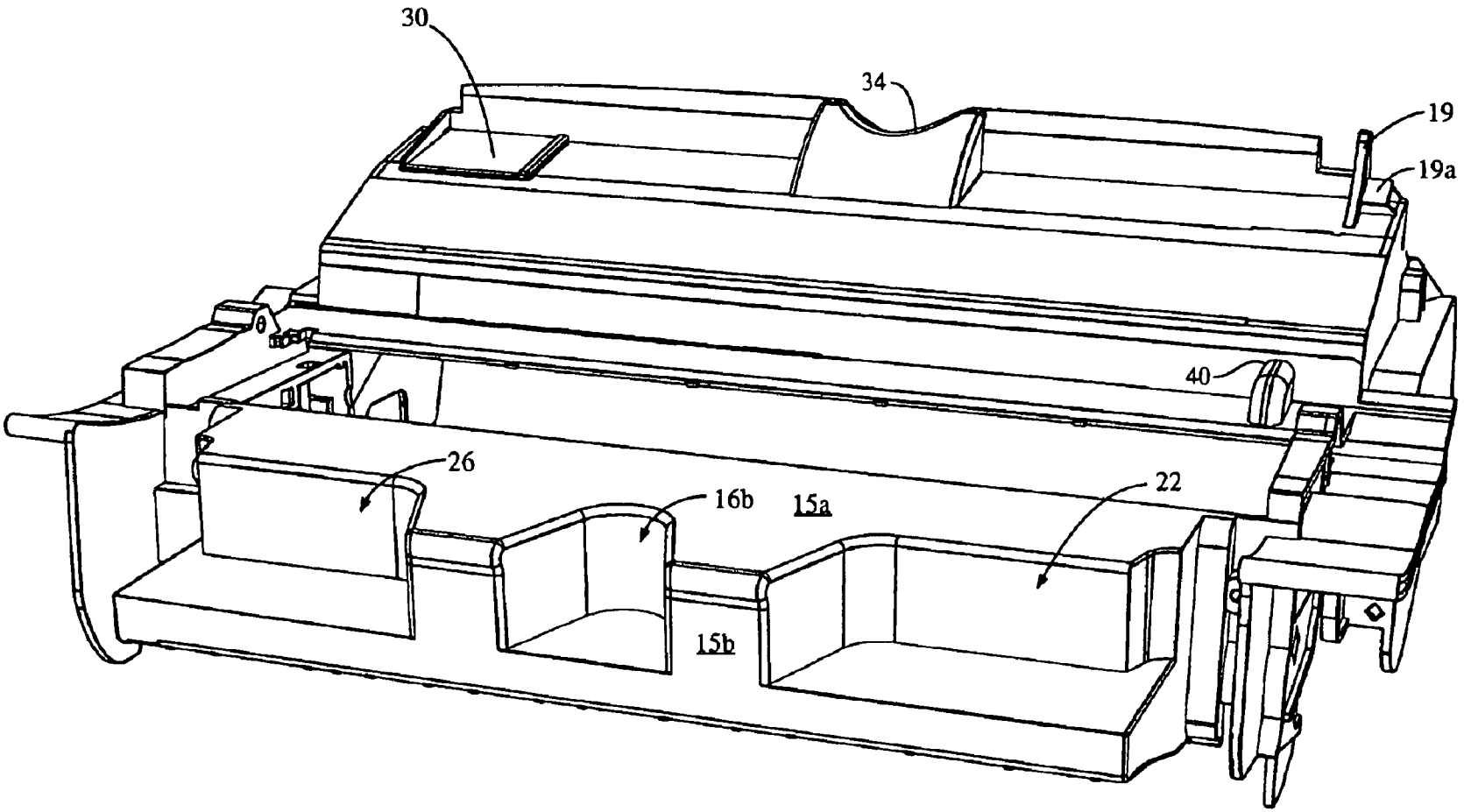
FIG. 2J is a side perspective view of a tenth embodiment of the novel toner cartridge universal adapter.

The embodiment of FIG. 2J is attained by modifying the embodiment of FIG. 2A by merging together outboard recess 16*d* and leading end recess 16*a* to form recess 26 and by merging together leading end recess 16*c* and outboard recess 16*e* to form recess 22. Leading end recess 16*b* of the FIG. 2A embodiment is unchanged. A leading end sculptured in the manner of FIG. 2J mates with the printer models listed above in connection with the embodiment of FIG. 2A and with the above-mentioned printer models that may presently exist, or which may in the future be provided, that are not expressly included in said list.

Returning now to FIG. 2A, it will there be seen that novel first circuit board mounting pad 30 is substantially larger than its prior art predecessors so that it can hold a circuit board having a width that is about twice the width of a common printer circuit board. (In FIGS. 17A and 17E, mounting pad 30 provides support for wide circuit board 110*a*). Accordingly, wide circuit board 110*a* mates with a first group of printers that include contact pins that engage contacts 111*a* and 113*a* positioned on wide circuit board 110*a* in position "30L" and it also mates with a second group of printers that include contact pins that engage contacts 111*a* and 113*a* positioned on wide circuit board 110*a* in position "30R."

Large circuit board mounting pad 30 also has sufficient size to accommodate a printer selector switch 120 or 120*a*, disclosed hereinafter in connection with FIGS. 16A-C.

Second circuit board mounting port 32 is smaller than first circuit board mounting pad 30. It mates with a third group of printers that include relatively small circuit boards that mate with mounting pads positioned near the front left edge of cleaner chamber 12.

Older printer models such as Optra Se and Optra T have contact pins that mate with a circuit board positioned on mounting pad 30 and newer printer models such as Optra T520, Optra T522, Optra T620, Optra T622, and Optra T63X, have contact pins that mate with a circuit board mounted in circuit board port 32. The Optra S models do not include a circuit board.

Still further novel features are perhaps best depicted in FIGS. 3A-F. Thumb grip 34 is formed in trailing end 11 of waste bin 12, centrally thereof. It is dished to comfortably accept a thumb and a user will recognize that said thumb grip 34 is dedicated to receiving the user's thumb. The cartridge is installed and removed without binding when a user's hand is centered thereon due to placement of the user's thumb in said thumb grip 34.

Figure 3A:
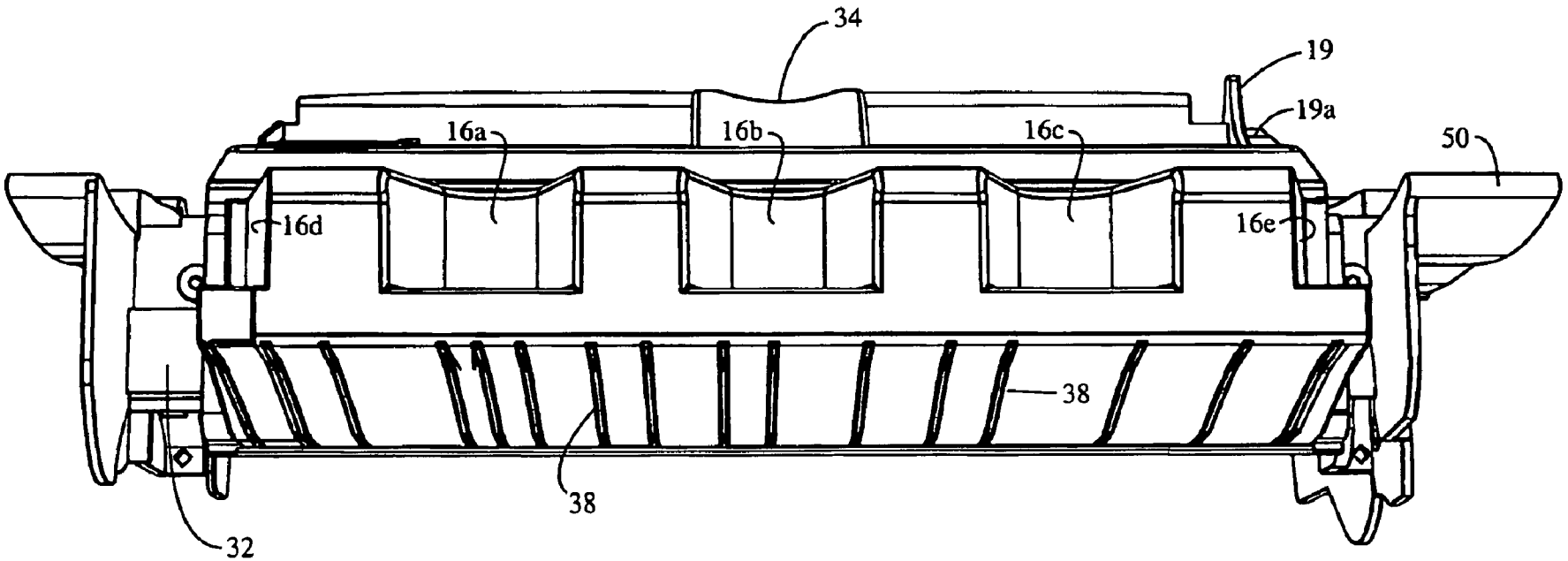
FIG. 3A is a front elevational view of the novel toner cartridge universal adapter.
Figure 3B:
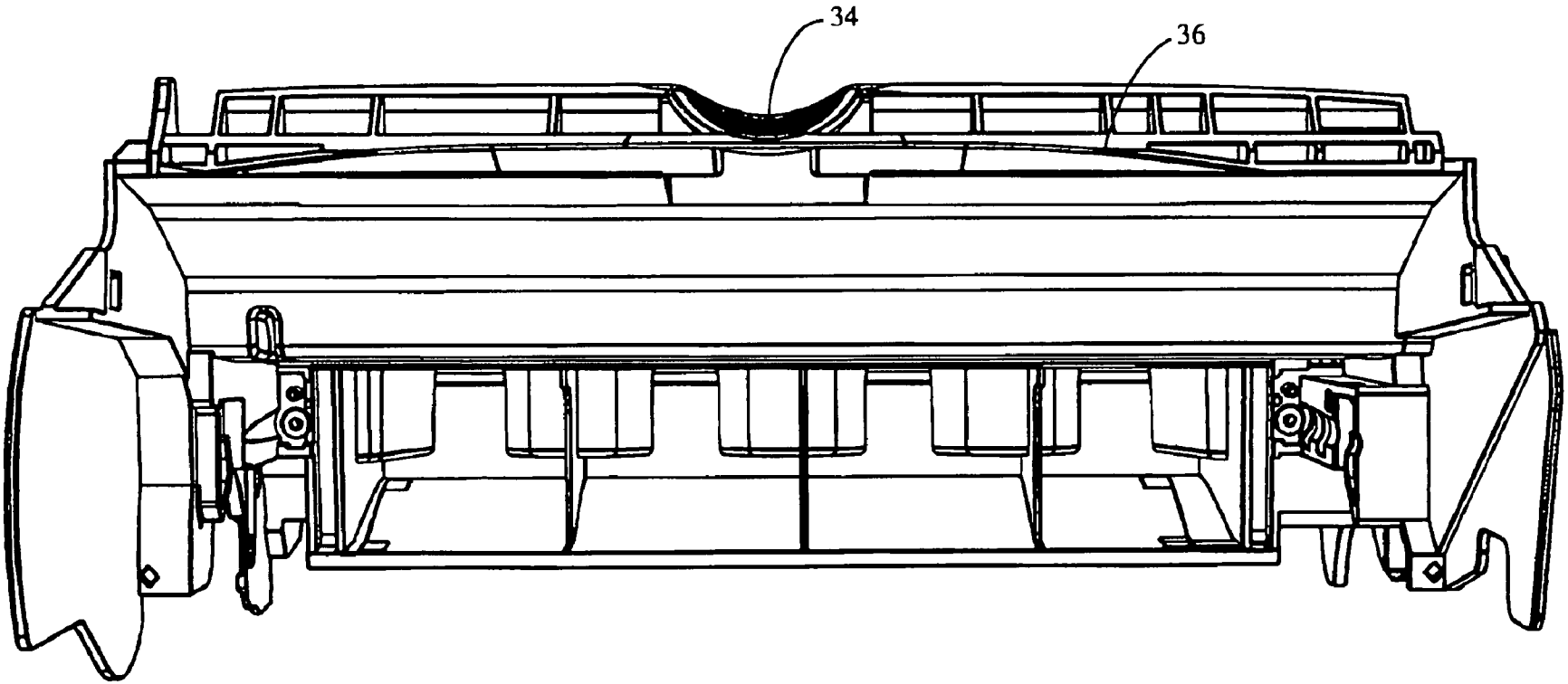
FIG. 3B is a rear elevational view of the novel toner cartridge universal adapter.
Figure 3C:
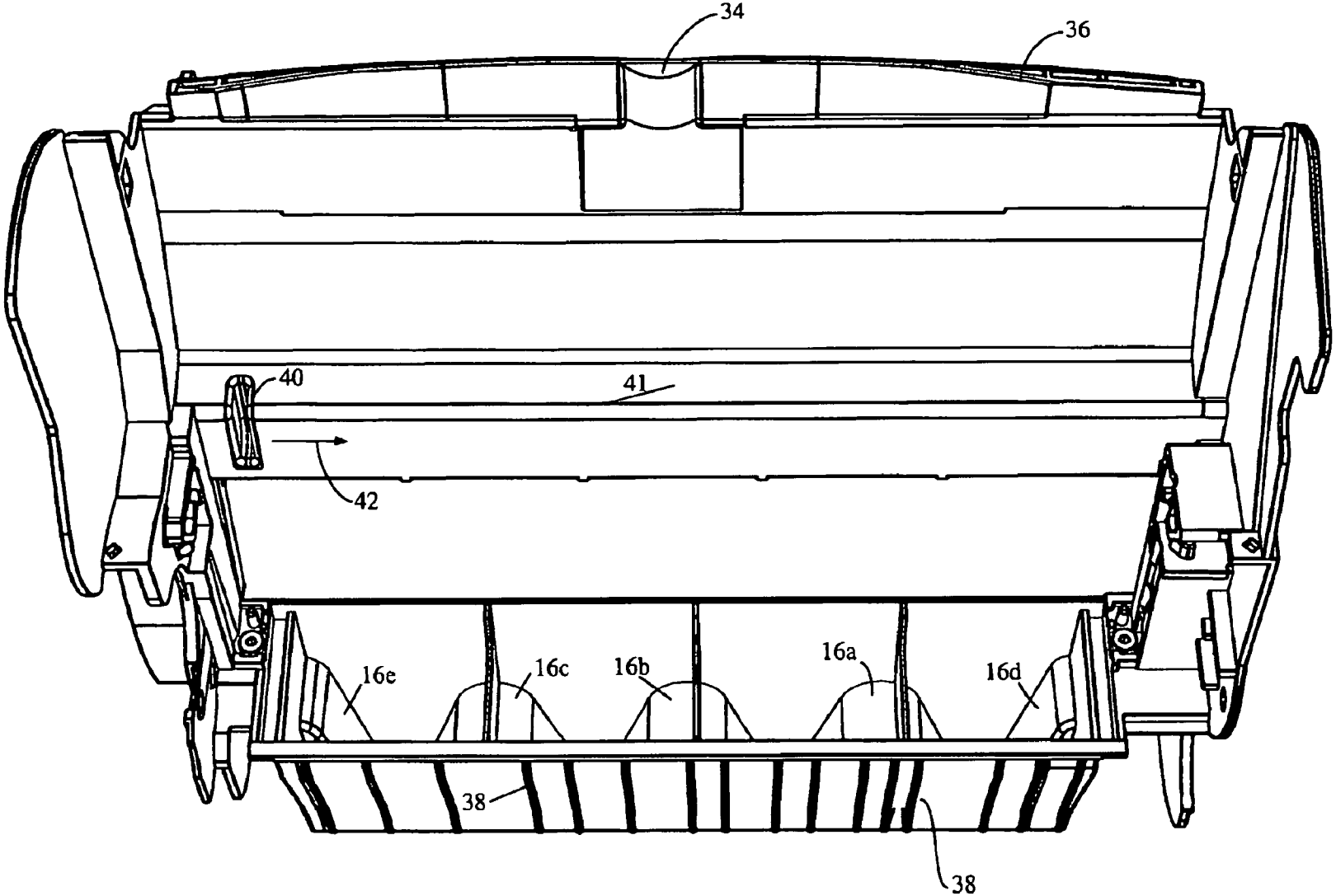
FIG. 3C is a rear perspective view of the novel toner cartridge universal adapter.
Figure 3D:
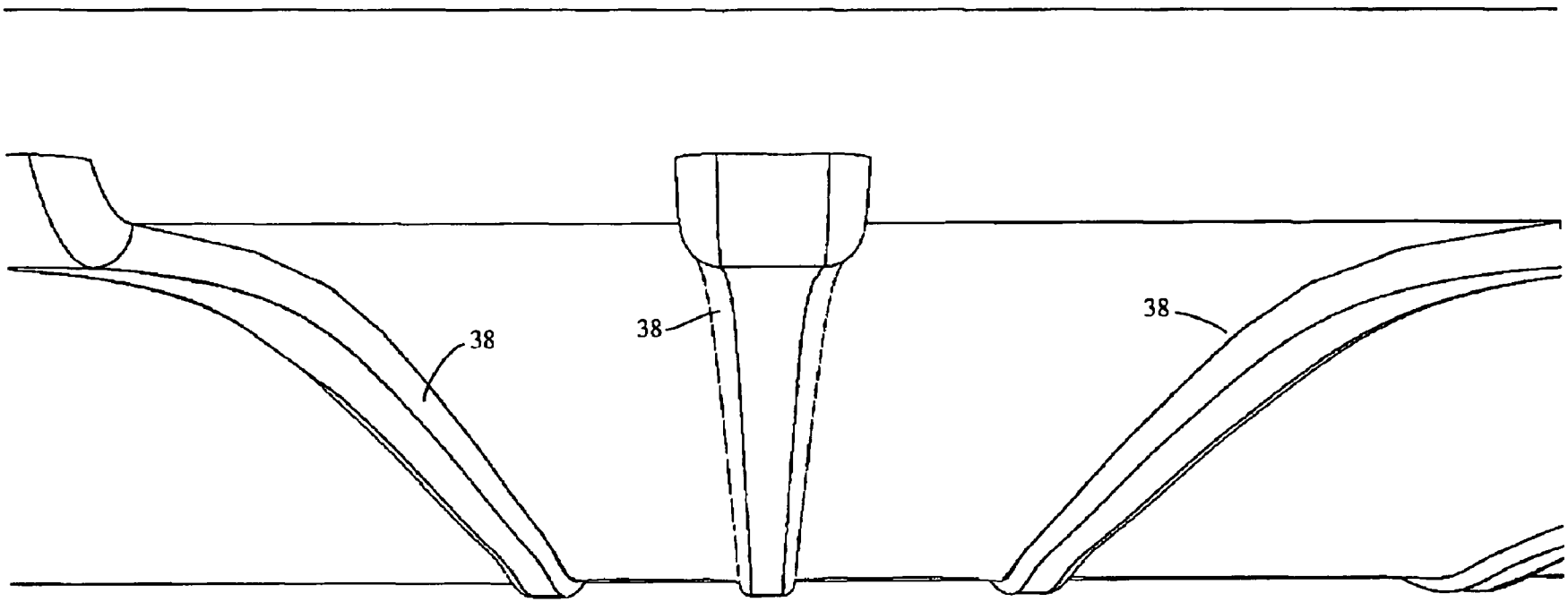
FIG. 3D is an enlarged perspective view of the novel reduced drag media guides that form a part of the cleaner chamber.

Moreover, as best indicated in FIGS. 3B and 3C, arch 36 extends transversely across trailing end 11, rising to a height sufficient to accommodate a user's fingers when the user's thumb is positioned in thumb grip 34. This structure ensures that toner cartridge 10 is held level when it is inserted into the printer. It also eliminates the narrow finger-receiving slots of the prior art.

A plurality of novel media guides, collectively denoted 38 in FIGS. 3A and 3C, are formed in a bottom wall of cleaner chamber 12. Media guides 38 are shown in enlarged configuration in FIG. 3D. They have rounded surfaces as best understood in connection with said FIG. 3D to reduce the friction as paper is dragged over them. The reduced friction substantially eliminates the jamming problem caused by the high friction media guides of the prior art.

Figure 5A:
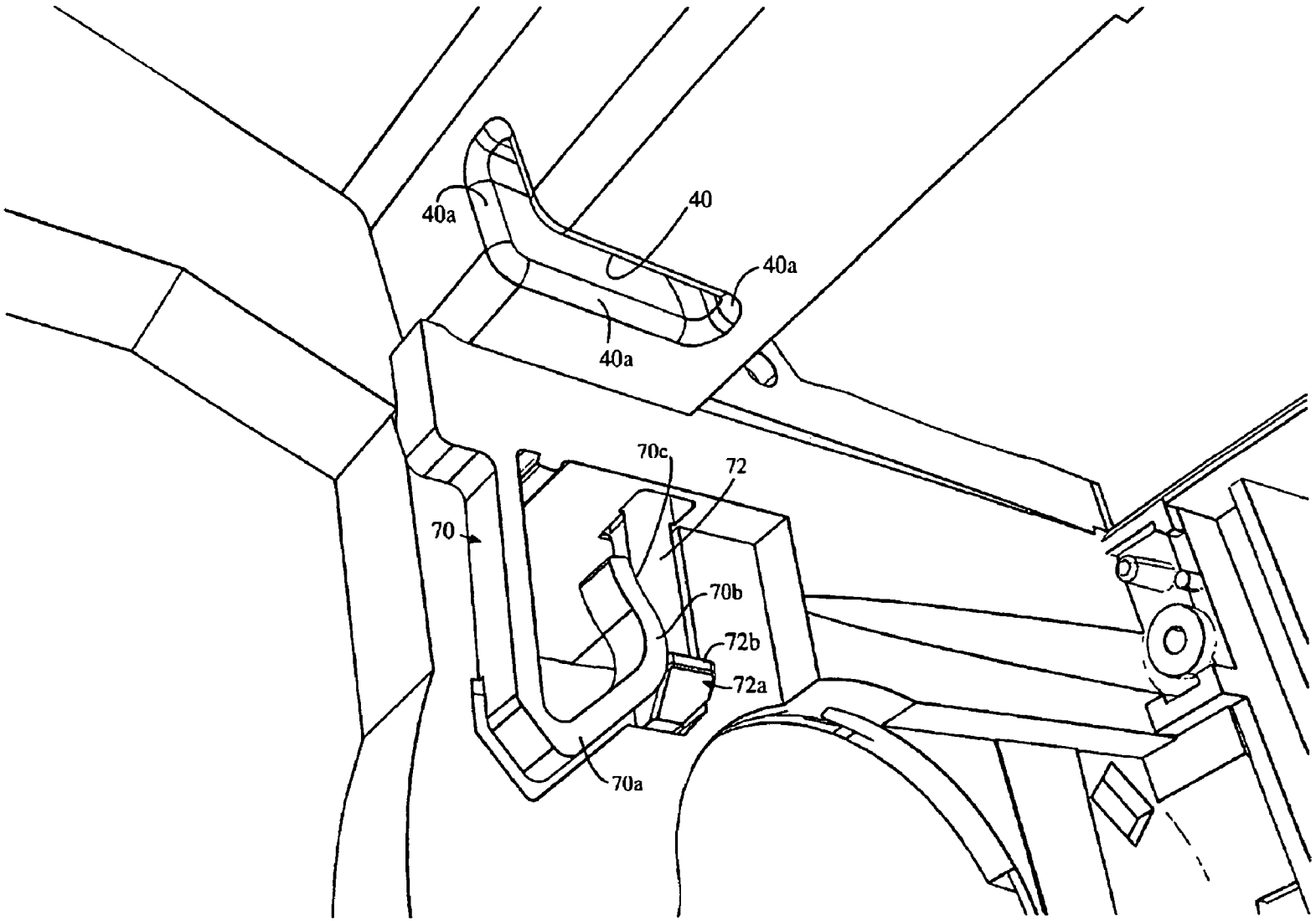
FIG. 5A is a first perspective inside view of the drive side of the novel toner cartridge universal adapter.

FIG. 3C depicts hopper torque tab receptacle 40 which is formed in cleaner chamber 12. When cleaner chamber 12 is lowered vertically to engage hopper 14, hopper torque tab 43 (FIG. 1C), is received within receptacle 40. This keys hopper 14 to waste bin 12, preventing lateral movement between said two parts when a driving force is applied to the hopper. More particularly, single-headed directional arrow 42 indicates the lateral direction hopper 14 is displaced when said hopper 14 is driven. Note that the plastic to the right of receptacle 40, denoted 41 as a whole, provides reinforcement where it is most needed, i.e., in the direction of said arrow 42. As best shown in FIG. 5A, a radius 40*a* is formed in waste bin 12 at the periphery of receptacle 40 to help canter and guide torque tab 43 into said receptacle 40. Moreover, receptacle 40 is wider than heretofore known to further facilitate vertical entry of torque tab 43 into said torque tab receptacle 40.

Figures 3E, 3F:
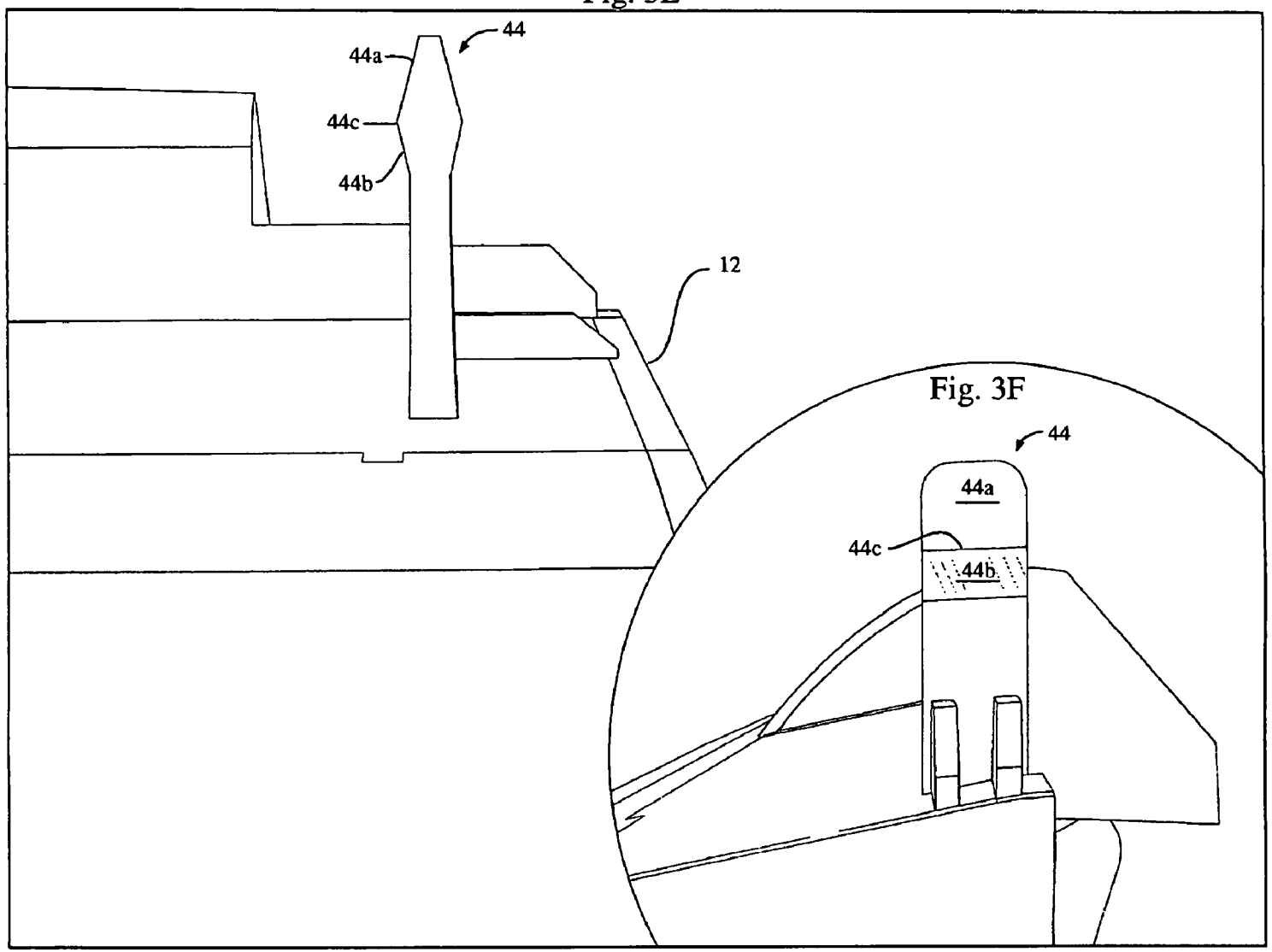
FIG. 3E is front perspective view of an improved microswitch actuating tab.
FIG. 3F is a side perspective view of said improved microswitch actuating tab.

As perhaps best understood in connection with FIGS. 3E and 3F, a second embodiment of microswitch actuating tab 19 is denoted in FIGS. 3E and 3F by the reference numeral 44 as a whole. Microswitch actuating tab 44 has a construction that extends to a higher elevation than the microswitch actuating tabs of the prior art. Moreover, top section 44*a* thereof widens from top to bottom and bottom section 44*b* narrows from top to bottom. Thus, mid-section 44*c* is the widest part of said tab 44. A "door closed" signal is generated and sent to activate the printer even if the printer has worn hinges and latches, due to the increased height of tab 44. The narrow top edge of tab 44 facilitates its entry into a narrow opening formed in the bottom edge of the printer door, not shown, and widened middle section 44*c* helps it positively engage said narrow opening while centering the printer door. The novel structure also provides additional protection against breakage of said tab 44.

A thicker and taller embodiment of microswitch actuating tab 44 is depicted in FIG. 2A and denoted by the reference numeral 19. Its increased height allows for even more wear in the hinges and latches and its increased thickness provides enhanced durability and structural strength to center the door.

Figure 4A:
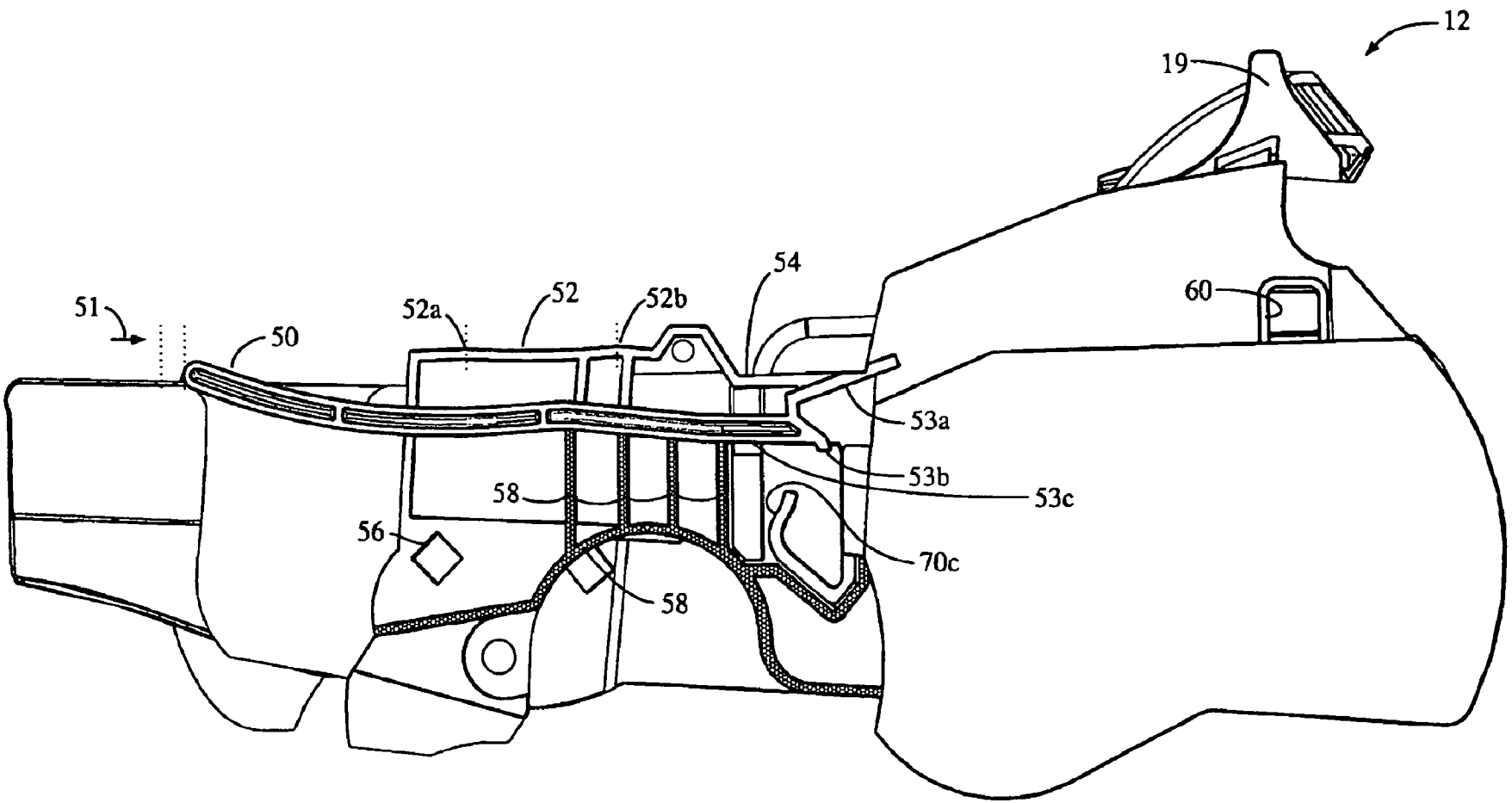
FIG. 4A is a side elevational view of the drive side of the novel toner cartridge universal adapter.

A number of additional novel features are depicted in FIG. 4A which provides an elevational view of the drive side of novel waste bin 12. Beginning at the left side of said Figure, it will first be observed that planar wing 50 is shorter than a conventional planar wing by about one-quarter inch as indicated as at 51. This shortening is required because planar wing 50 is thicker than a conventional planar wing at said leading end. Unlike conventional planar wings, planar wing 50 has a uniform thickness along its extent. This structure increases the strength of planar wing 50 and eliminates flexing that causes binding and cocking of the toner cartridge during its installation into a printer. The uniform thickness also makes the novel planar wing less prone to cracking and breaking than the planar wings heretofore known.

The trailing end of planar wing is bifurcated into upper section 53*a* and lower section 53*b*. Said parts cooperate with one another to form a latch member having a function disclosed in connection with FIGS. 12A-F.

Concave depression 52 helps to lock waste bin 12 into its functional position in the printer. Specifically, concave depression 52 extends from about point 52*a* to about point 52*b* and receives downward forcing levers that form a part of the printer. Concavity 52 thus helps to center the force provided by said downward forcing levers.

Wall 54 has a lower elevation than its prior art counterpart to provide additional clearance for waste bin 12 when it is pivoted upwardly relative to the printer during removal. This makes the novel toner cartridge easier to remove.

Vent 56 enhances cooling air flow to the photoconductor drum, not shown.

A plurality of strengthening ribs, collectively denoted 58, improve the structural integrity of waste bin 12.

Hopper pin mounting aperture 60 receives a mounting pin 62 (FIGS. 1A and 1C) mounted to hopper 14 with zero vertical clearance. Upper spacer 61*a* and lower spacer 61*b* reduce the vertical clearance of said mounting aperture 60. The hopper pin mounting aperture of the prior art provides vertical clearance because prior art hoppers are pivotally mounted to their associated waste bins. By eliminating the pivotal interconnection between waste bin 12 and hopper 14, various springs are eliminated. Moreover, the zero clearance locks novel hopper 14 into position relative to novel waste bin 12 so no shipping strap is required when novel toner cartridge 10 is shipped.

Figure 4B:
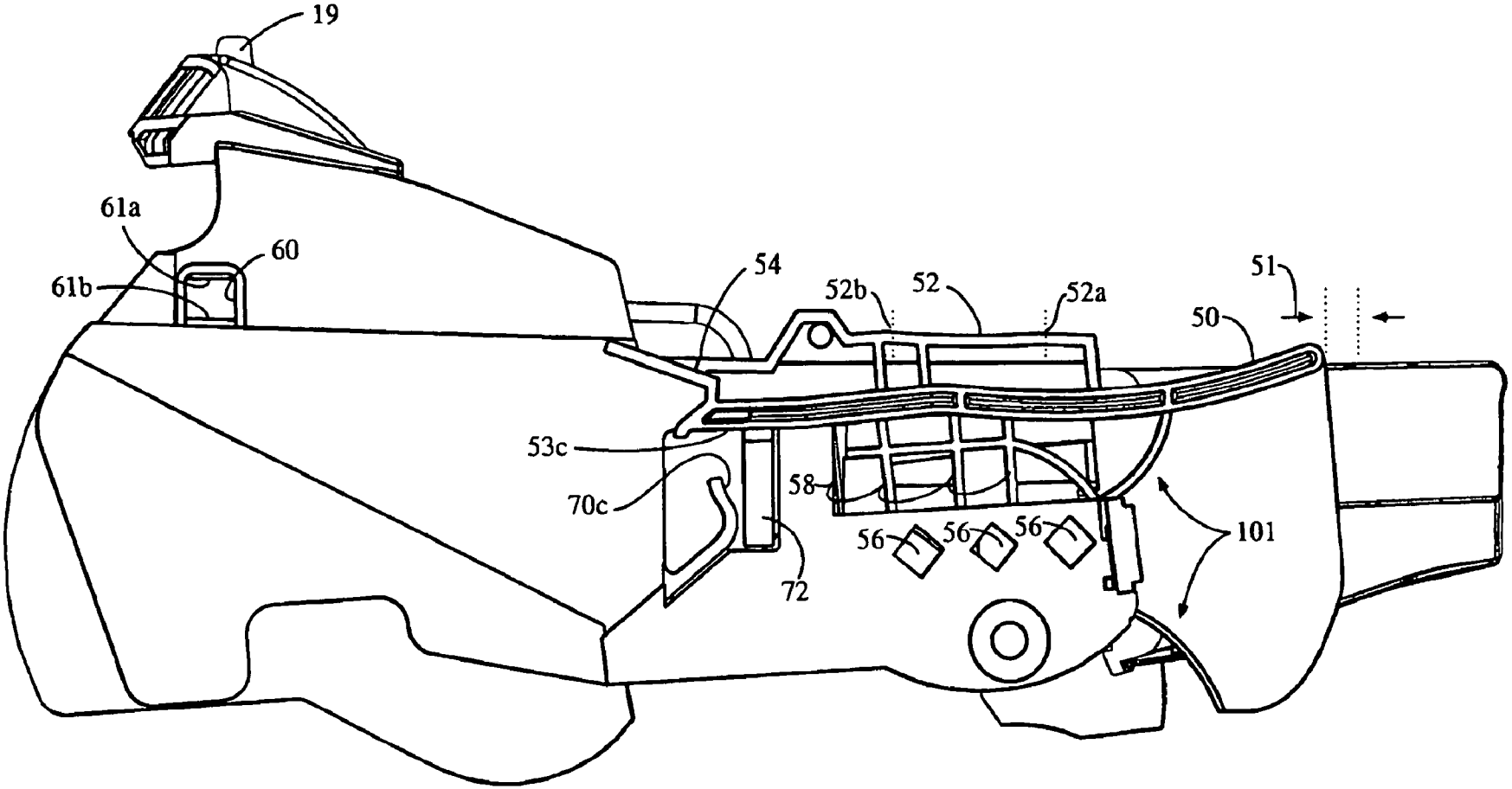
FIG. 4B is a side elevational view of the driven side of the novel toner cartridge universal adapter.

FIG. 4B is a side elevational view of the driven side of the toner cartridge. It therefore shows much of the same structure, as indicated by the common reference numerals. One difference is the three photoconductive drum cooling vent holes, collectively denoted 56, instead of the single vent hole formed in the drive side of waste bin 12.

Another difference is that a structure for preventing problematic "piggy backing" of circuit boards onto a host circuit board may be seen in said FIG. 4B, said structure not being present on the drive side of waste bin 12. This novel structure is denoted 101, generally, and is disclosed more fully in connection with FIGS. 10A-C.

Figures 4C, 4D, 4E:
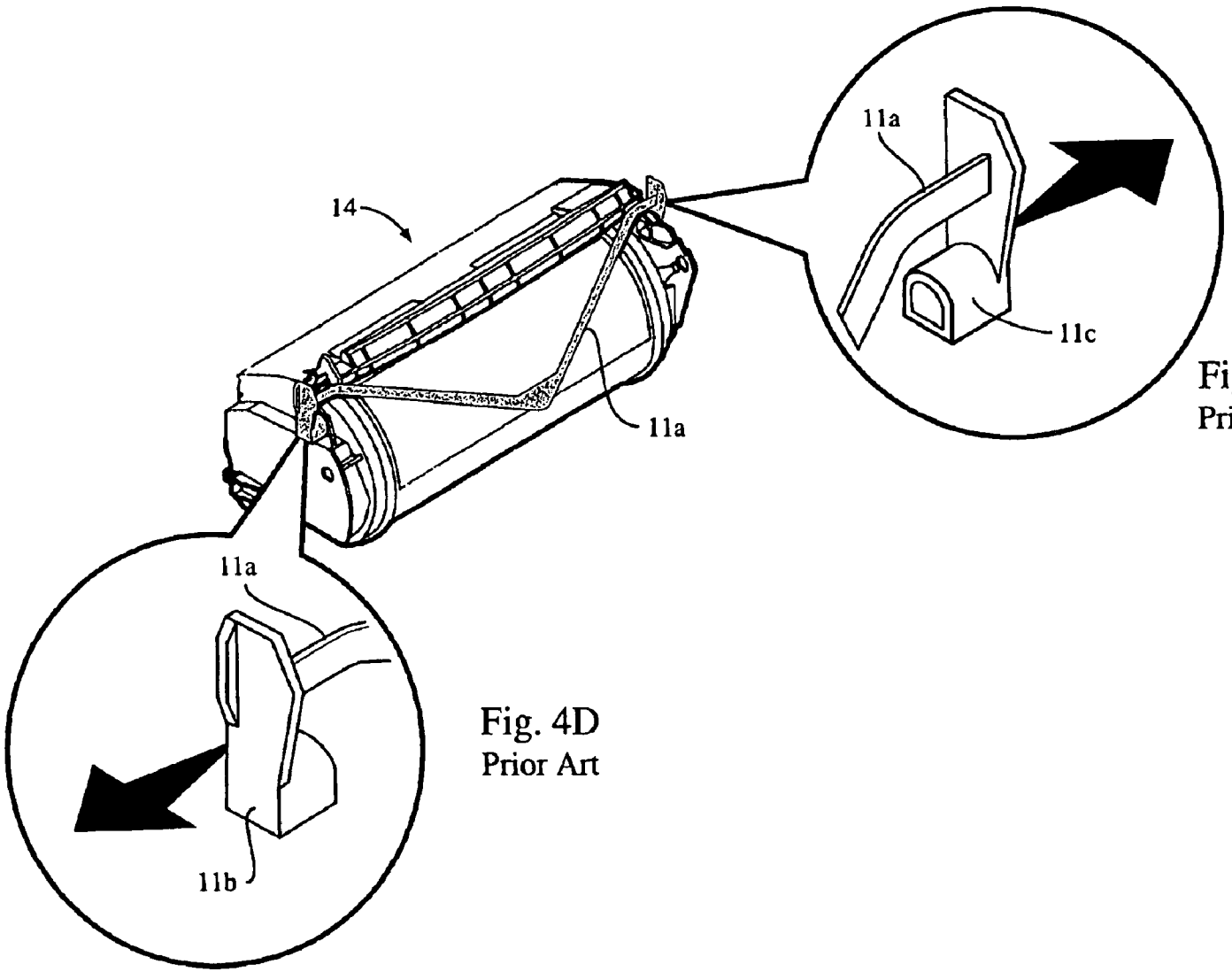
Fig. 4C Prior Art
Fig. 4D Prior Art
Fig. 4E Prior Art
FIG. 4C is a perspective view of a prior art hopper and its shipping lock strap.
FIG. 4D is a detailed perspective view of a first end of the prior art shipping lock strap.
FIG. 4E is a detailed perspective view of a second end of said prior art shipping lock strap.

FIGS. 4C-E depict the shipping lock strap mentioned above. Shipping lock strap 11*a* includes brackets 11*b* and 11*c* formed integrally at its opposite ends. Such brackets are secured to opposite ends of a prior art hopper 14 because the hopper pins of such prior art hopper is free to move about inside its mating aperture. Hence the need for hold-down strap 11*a* in prior art hopper 14, such need being eliminated by the absence of vertical clearance between said pin and aperture in the novel structure as aforesaid.

A first embodiment of the novel latching means for interconnecting waste bin 12 and hopper 14 to one another in a non-pivotal interconnection appears to some extent in FIGS. 4A-B but is best illustrated in FIGS. 5A-B and 6A-B.

Figure 1C:
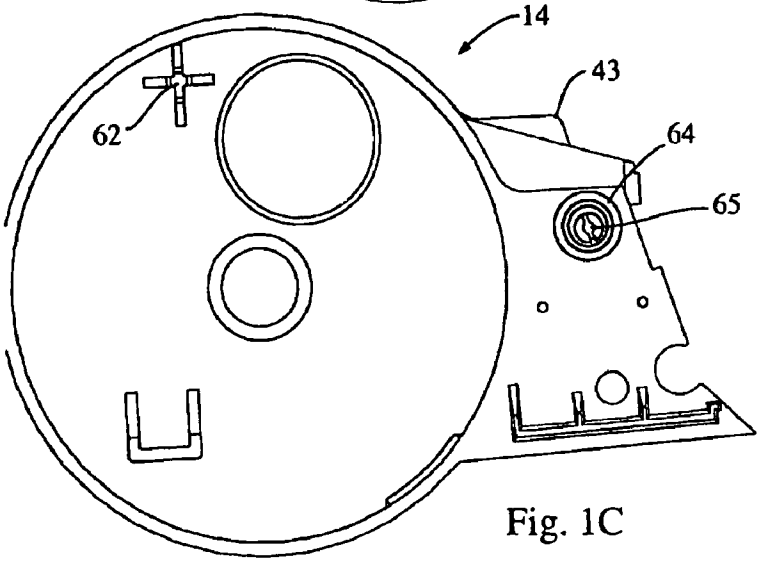
FIG. 1C is a side elevational view of a conventional hopper.

Hopper wheel horizontal retainer 70 and hopper wheel vertical lock 72 are formed integrally with waste bin 12 and cooperate with one another to engage hopper wheel 64 (FIGS. 1A and 1C) that is snapped onto hopper axle 65 near its leading end as best understood in connection with FIG. 1C.

When hopper wheel 64 is engaged in horizontal retainer 70 and hopper wheel vertical lock 72, its captured position dictates the elevation of the rear of planar wing 53*c* as depicted in FIGS. 1A and 4A. Horizontal retainer 70 exerts an upward force on hopper wheel 64, causing it to make snug contact at a point on the bottom side of level planar wing 53*c*. Such snug contact ensures proper alignment and orientation of cartridge components when the cartridge is installed into and removed from the printer.

The leveling of the planar wing provides for a smoother glide over printer guides during installation of the cartridge into and removal of the cartridge from the printer.

To assemble novel toner cartridge 10, waste bin 12 is held above hopper 14 as mentioned earlier in connection with FIGS. 1A-C so that hopper wheel horizontal retainer 70 and hopper wheel vertical lock 72 are positioned directly above hopper wheel 64. As waste bin 12 is lowered, hopper wheel 64 engages upwardly inclined surface 70*a* (FIGS. 5A-B) of horizontal retainer 70 and causes horizontal retainer 70 to deflect from its FIGS. 5A-B position of repose. Hopper wheel 64 rolls over hump 70*b* and the resiliency of horizontal retainer 70 causes it to move back toward its position of repose, thereby capturing hopper wheel 64 in concavity 70*c*.

Figure 5B:
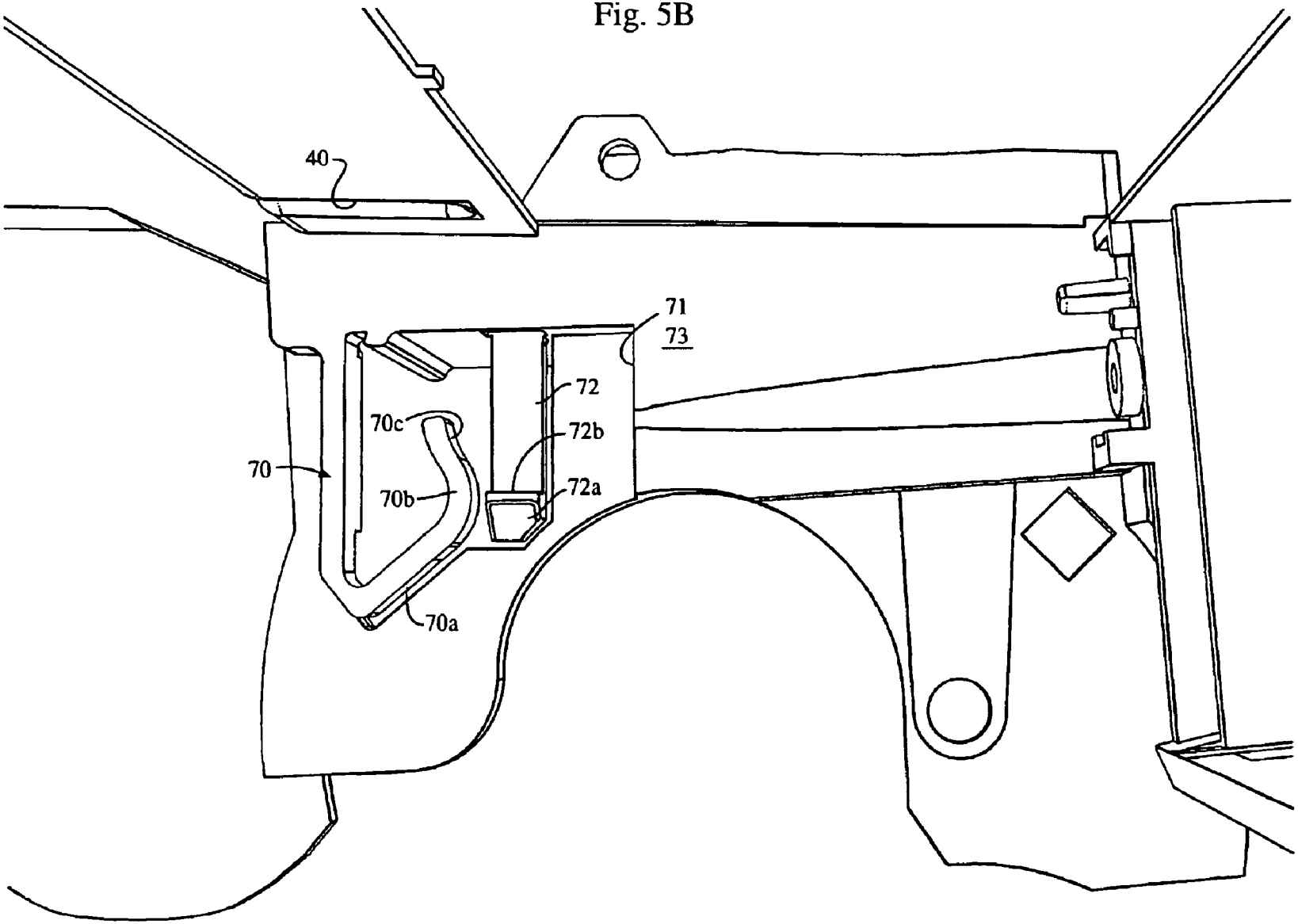
FIG. 5B is a second perspective inside view of the drive side of the novel toner cartridge universal adapter.

When hopper wheel 64 is causing horizontal retainer 70 to deflect away from its position of repose as aforesaid, said hopper wheel simultaneously causes hopper wheel vertical lock 72 to deflect away from its FIGS. 5A-B position of repose as well. When hopper wheel 64 clears hook 72*a* at the free end of vertical lock 72, said vertical lock moves back toward its position of repose, thereby capturing the bottom of hopper wheel 64. In this way, hopper wheel 64 is captured on a trailing side thereof by concavity 70*c* and on its bottom side by flat wall 72*b* of hook 72*a*.

The deflection of hopper wheel 64 toward cleaner chamber 12 is limited by contact of the developer roller (not shown) in the hopper and the photoconductor drum, not shown, in the removable toner cartridge universal adapter.

FIG. 5B illustrates hopper wheel horizontal retainer 70 and hopper wheel vertical lock 72 from a forward perspective relative to the rear perspective of FIG. 5A. It should be understood that both FIGS. 5A and 5B are taken from inside waste bin 12. FIG. 5B shows more clearly that said parts 70 and 72 are separate parts.

It is also best understood from FIG. 5B that neither part 70 or 72 is laterally supported by a wall; note opening 71 formed in sidewall 73 of waste bin 12. It is this lack or lateral support that requires the engagement of hopper torque tab 43 (FIG. 1C) and hopper torque tab receptacle 40.

Figure 5C:
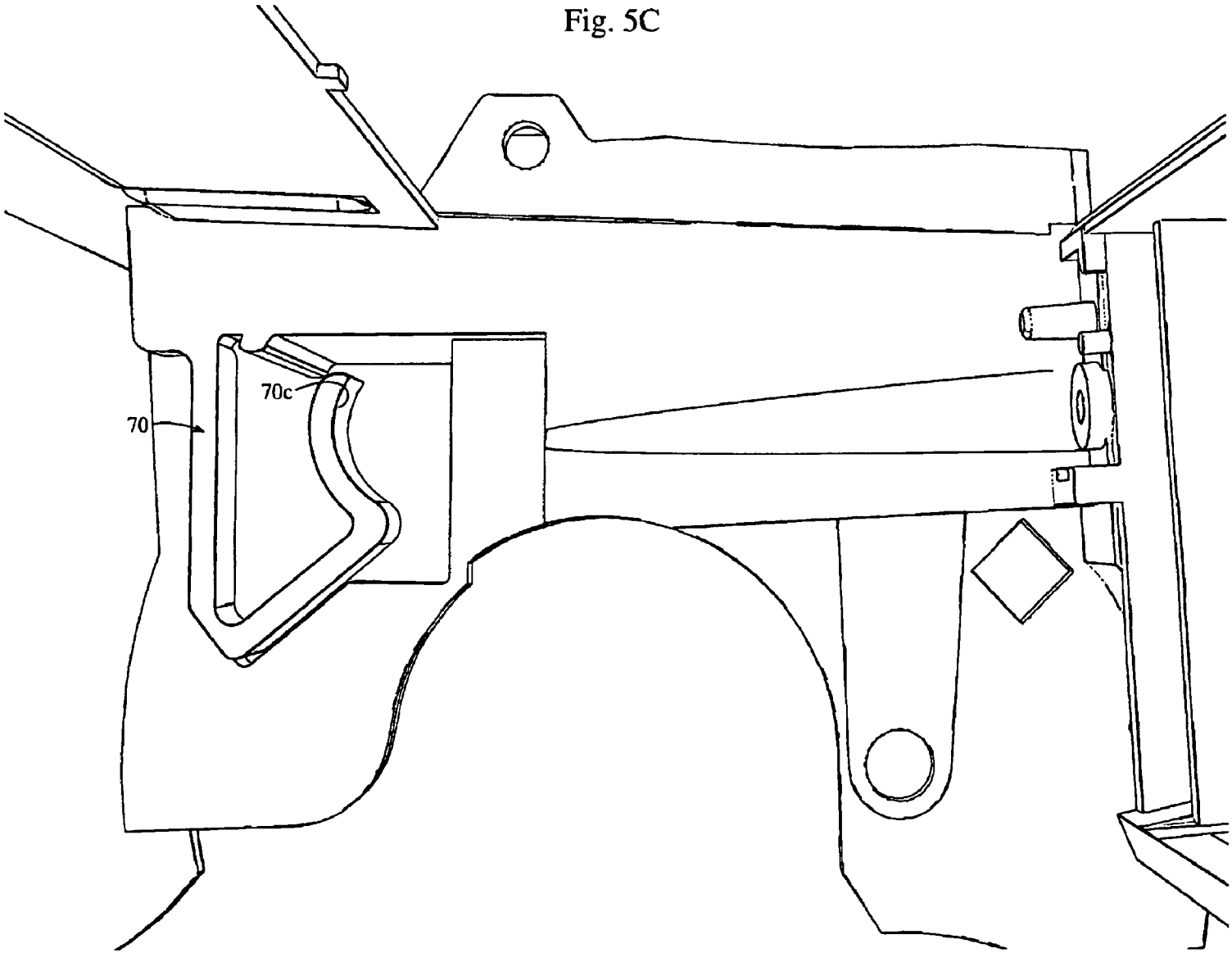
FIG. 5C is perspective inside view like that of FIG. 5B but depicting an embodiment having no hopper wheel vertical lock.

FIG. 5C depicts an improved hopper wheel horizontal retainer 70. Arcuate part 70*c* has a greater circumferential extent in this embodiment and thus more fully captures hopper wheel 64, thereby eliminating the need for hopper wheel vertical lock 72.

Figure 5D:
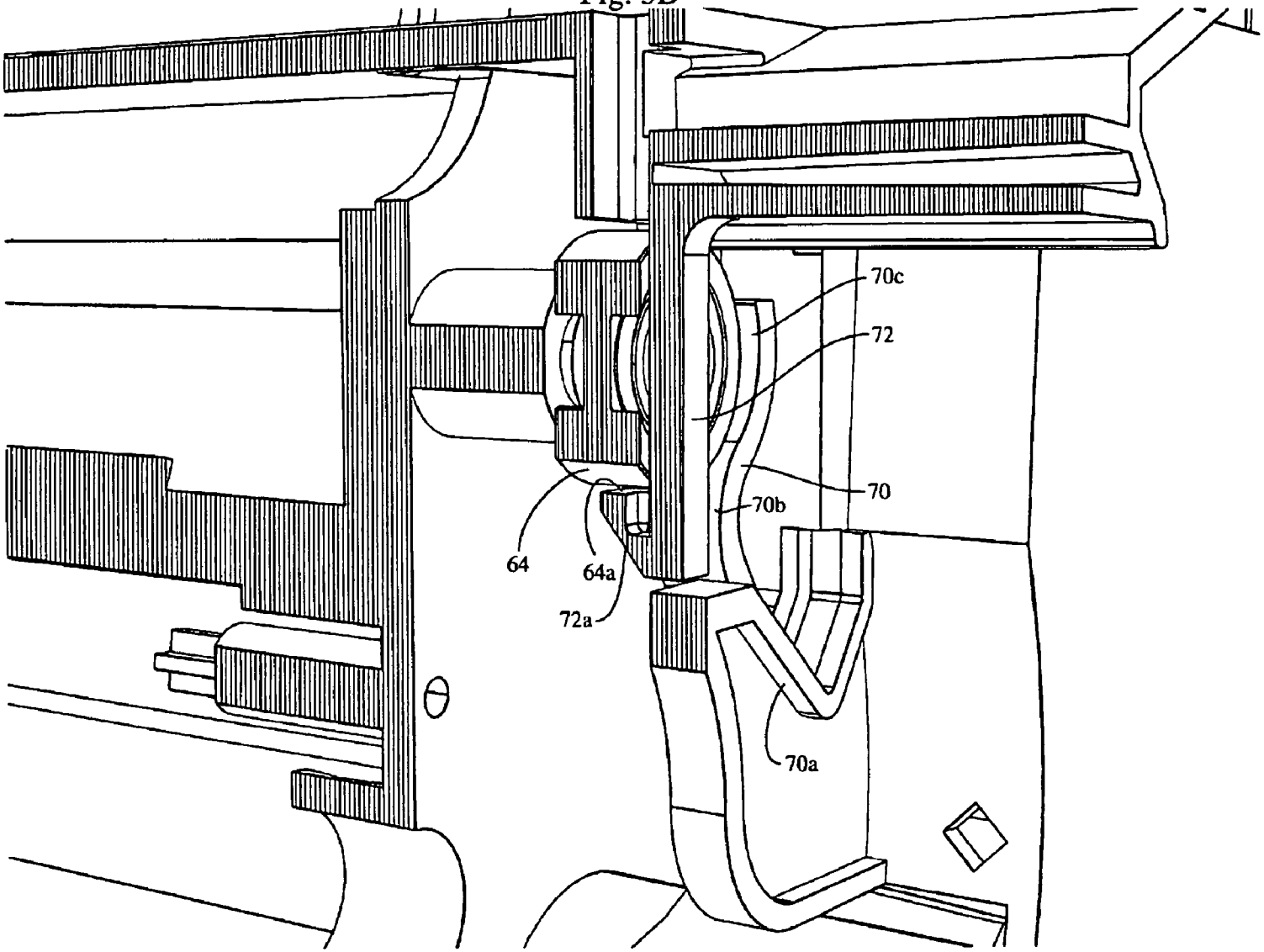
FIG. 5D is a cutaway perspective view of the driving side of the novel toner cartridge universal adapter.

Note in FIG. 5D how the bottom of hopper wheel 64 is supported by flat surface 64*a* of hopper wheel vertical lock 72.

Figure 6A:
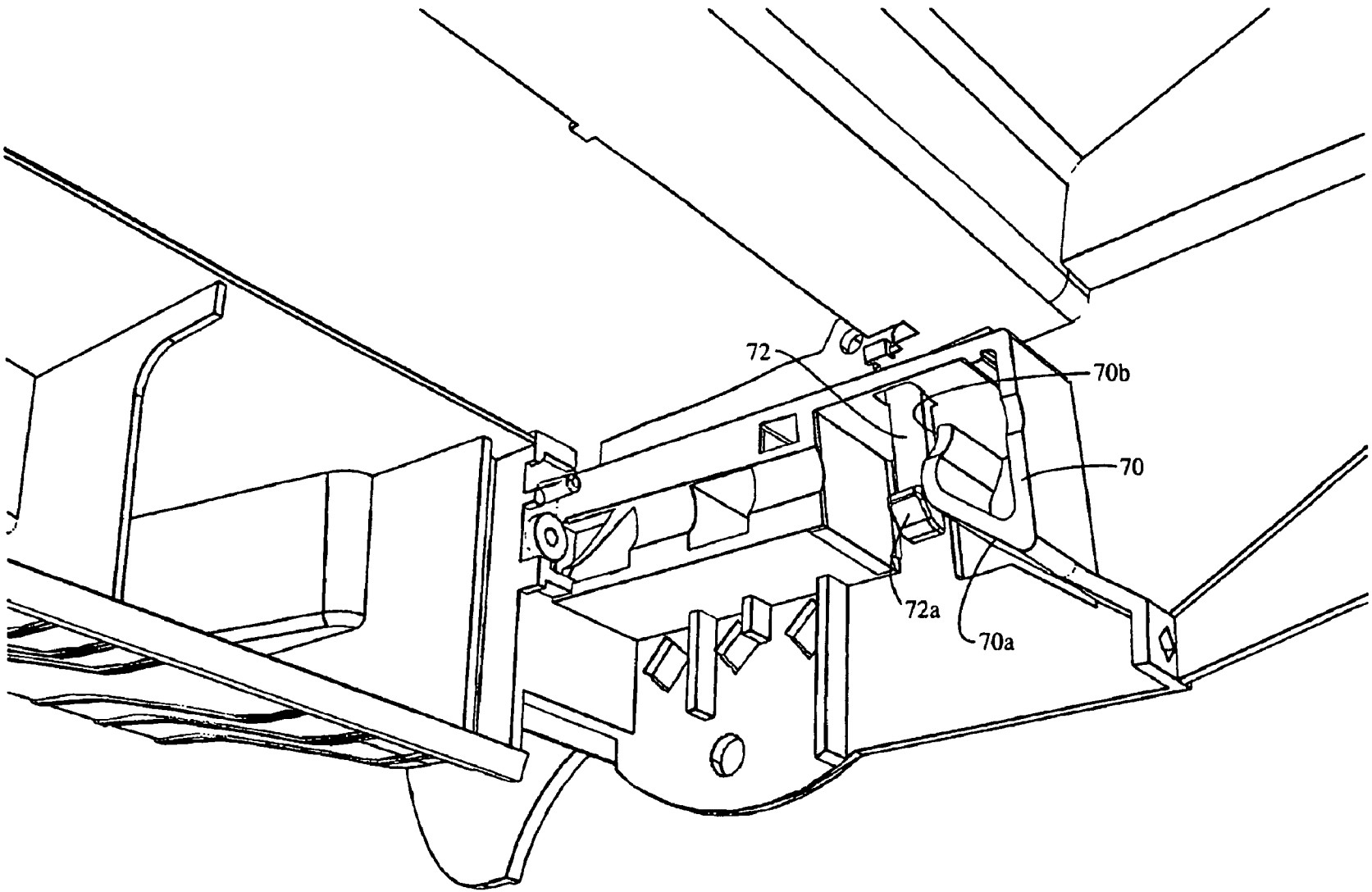
FIG. 6A is a first perspective inside view of the driven side of the novel toner cartridge universal adapter.
Figure 6B:
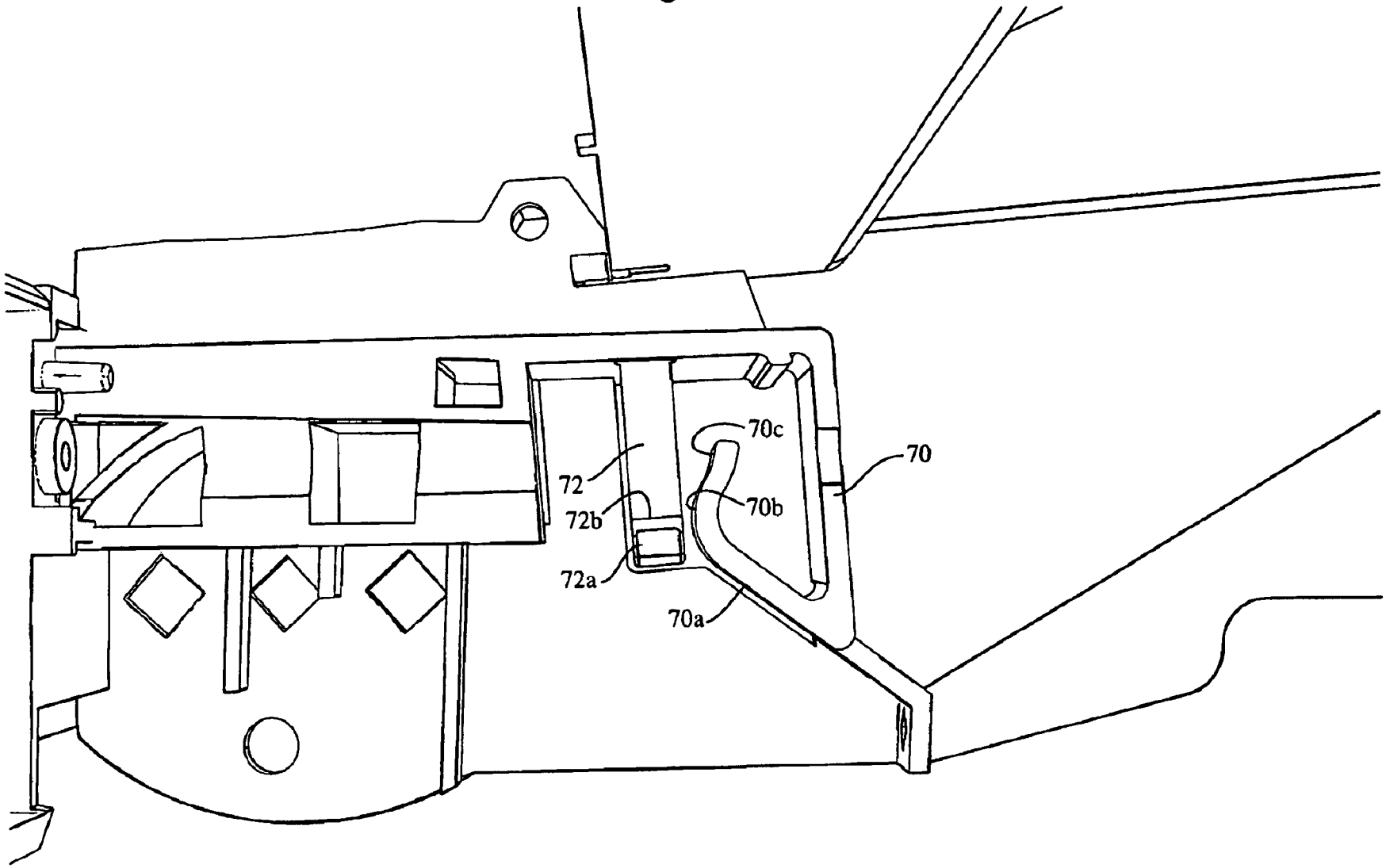
FIG. 6B is a second perspective inside view of the driven side of the novel toner cartridge universal adapter.

FIGS. 6A and 6B depict hopper wheel horizontal retainer 70 and hopper wheel vertical lock 72 that are positioned on the driven side of waste bin 12. They perform the same function as their drive side counterparts and engage and capture the hopper wheel associated with the non-drive side of waste bin 12.

FIGS. 7A and 7B depict an alternative structure for interlocking waste bin 12 and hopper 14. Both Figures are taken from the inside of said waste bin. FIG. 7A depicts the structure of the driving side and FIG. 7B depicts the structure of the driven side.

This alternative structure eliminates hopper wheel horizontal retainer 70 but it does not eliminate hopper wheel vertical lock 72. Guide rail 74 is integrally formed with a sidewall of the driving side of waste bin 12. As waste bin 12 is lowered toward hopper 14, hopper wheel 64 rollingly engages guide rail 74 and said hopper wheel continues to roll down said guide rail until it is captured by hook 72*a* of vertical lock 72.

In this embodiment, vertical lock 72 is supported from behind by a waste bin sidewall. Accordingly, hopper torque tab 43 is eliminated as is hopper torque tab receptacle 40. Hopper torque tab 43 must be cut off from the hopper before the hopper is inserted into the novel removable toner cartridge universal adapter.

Essentially the same structure is provided on the driven side of waste bin 12, as depicted in FIG. 7B.

FIGS. 7A-C depicts yet another important feature of novel waste bin 12. A thirty degree (30°) taper is formed in aperture 80 formed in a trailing end of a side wall of waste bin 12, said aperture being formed in both the driving and driven sides thereof as depicted in said FIGS. 7A and 7B. As perhaps best understood in connection with the top plan view of FIG. 7C, trailing wall 80*a* of aperture 80 is angled at a thirty degree (30°) angle so that aperture 80 is smaller on the outside surface of the sidewall than it is on the inside surface thereof. When the trailing end of waste bin 12 is lowered onto hopper 14 to interconnect said waste bin and hopper together, the flexible and resilient trailing ends of the waste bin sidewalls are slightly diverged from one another so that pins 62 that extend from opposite ends of hopper 14 may enter into the tapered aperture 80 formed in each of said side walls. As mentioned above, springs are used in prior art toner cartridges to urge the hopper forwardly toward cleaner chamber 12 so that the photoconductive drum of the waste bin will properly contact the developer roller of the hopper.

The untapered prior art aperture thus provides a mounting means for loosely securing the hopper to the waste bin, but such prior art untapered aperture performs no role in biasing the hopper toward the cleaner chamber.

Thus it is understood that the taper of trailing wall 80*a* urges hopper 14 forwardly, i.e., toward cleaner chamber 12. This eliminates the need for the prior art springs that perform such function.

Figure 8A:
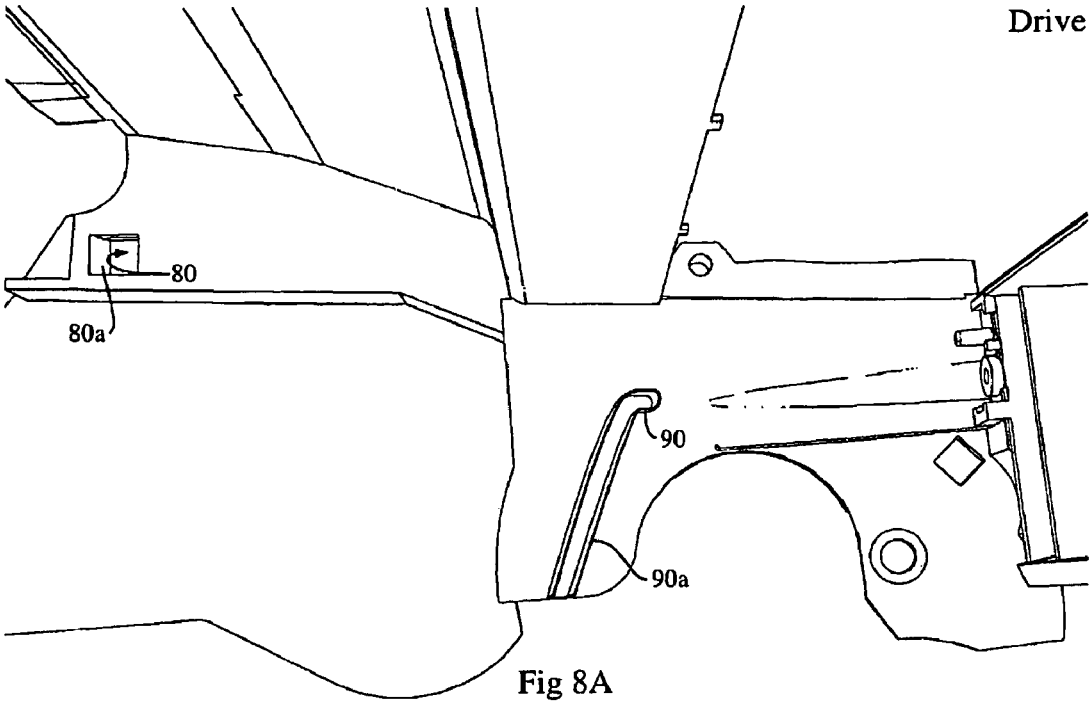
FIG. 8A is a perspective view of another alternative embodiment of the novel interconnection means taken from the interior, driving side of the waste bin.
Figure 8B:
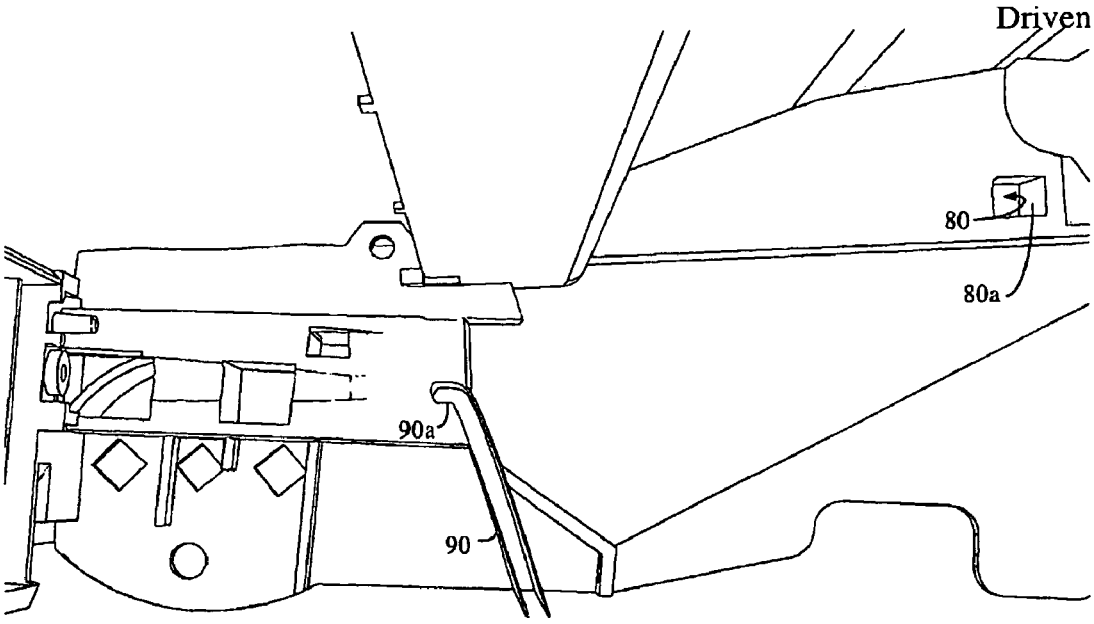
FIG. 8B is a perspective view of the alternative embodiment of the novel interconnection means of FIG. 8A taken from the interior, driven side of the waste bin.

Both hopper wheel horizontal retainer 70 and hopper wheel vertical lock 72 are eliminated in the embodiment of FIGS. 8A and 8B which depict the driving and driven sides of waste bin 12, respectively. Hopper wheel axle retainer 90 is formed on the inside surface of the driving and driven side walls of waste bin 12 and is adapted to slidingly receive axle 65 that extends from the hopper of FIG. 1C modified so that hopper wheel 64 is removed. More particularly, a raised wall forms retainer 90 that captures and guides said hopper wheel axle. The lowermost end of each retainer 90 has a forwardly extending bend 90*a* formed therein so that as trailing wall 80*a* urges hopper 14 in said forward direction, i.e., toward the leading end of waste bin 12 and thus toward the printer, said hopper wheel axle is pushed into said forward bend 90*a*. This maintains the nip formed by the contact between the photoconductive drum of waste bin 12 and the developer roller of hopper 14.

Note further that hopper wheel axle retainer 90 formed in the inner surface of the waste bin side wall at the driving side of the waste bin is supported by said side wall and thus there is no need for torque tab 43 to be formed in hopper 14 and thus there is no need for hopper torque tab receptacle 40.

Figure 9A:
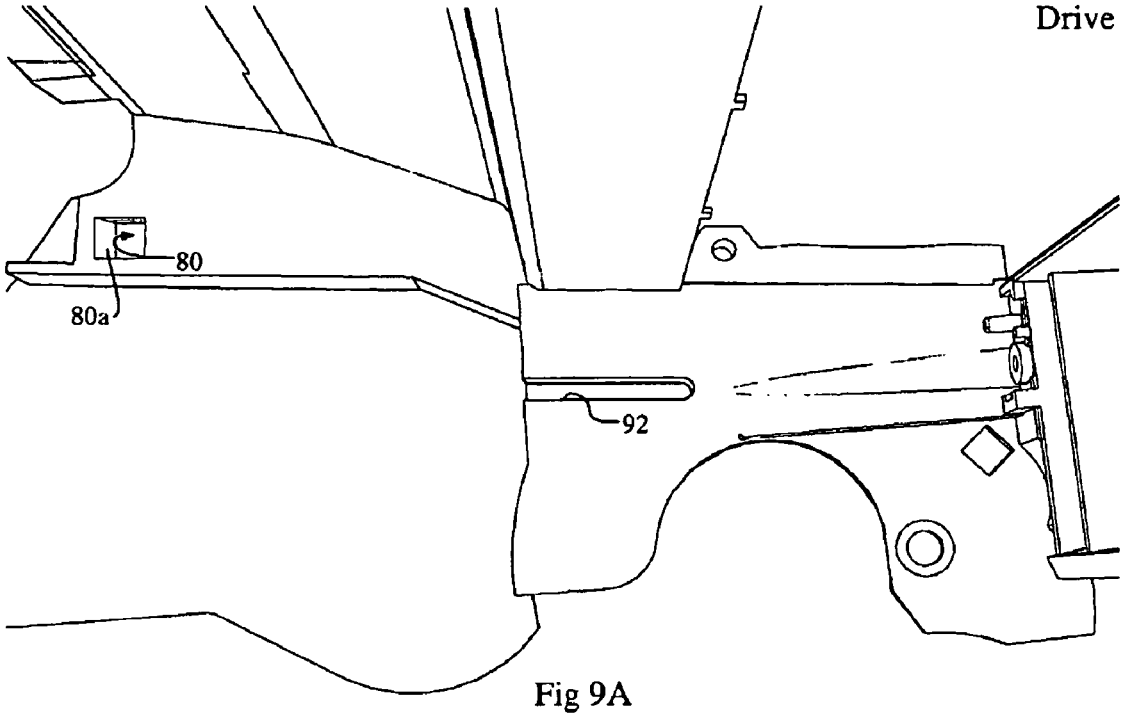
FIG. 9A is a perspective view of another alternative embodiment of the novel interconnection means taken from the interior, driving side of the waste bin.
Figure 9B:
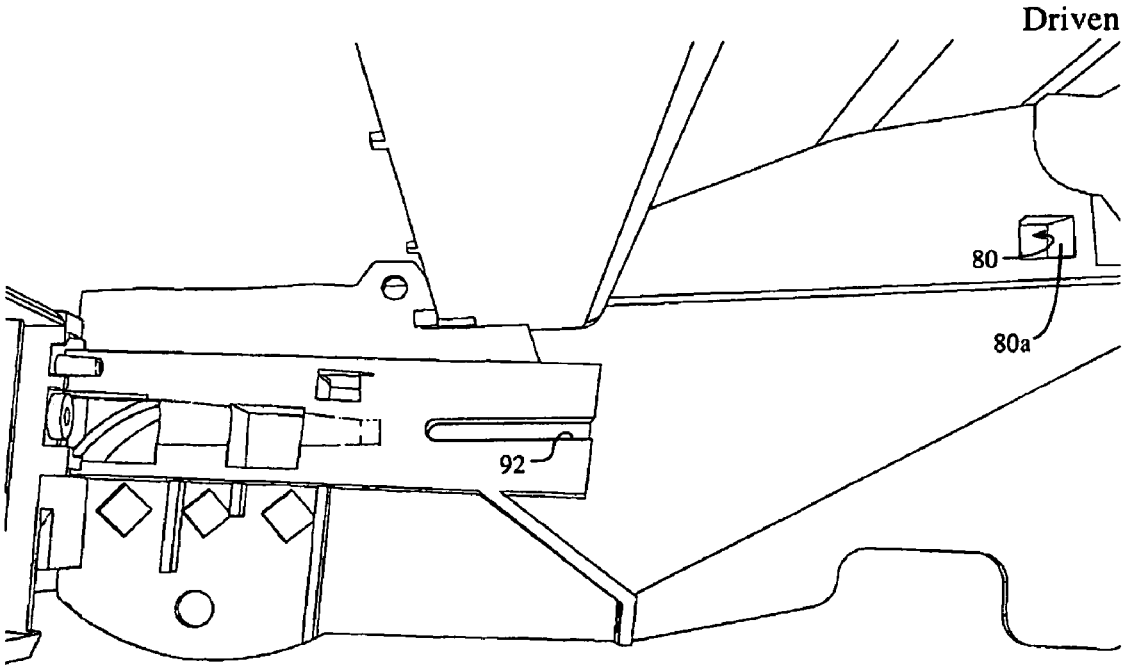
FIG. 9B is a perspective view of the alternative embodiment of the novel interconnection means of FIG. 9A taken from the interior, driven side of the waste bin.

Perhaps the best harnessing of the forward bias supplied by tapered wall 80*a* is disclosed in the embodiment of FIGS. 9A and 9B. In this embodiment, both hopper wheel horizontal retainer 70 and hopper wheel vertical lock 72 are again eliminated, as is hopper wheel axle retainer 90. In this alternative embodiment, the hopper wheel axle retainer is not a raised wall as in the embodiment of FIGS. 8A and 8B but is a straight, horizontally disposed slot 92 formed in the waste bin side walls on both the driving and the driven sides of waste bin 12. Hopper wheel axles 65 with wheel 64 removed are aligned with slots 92 and slidingly introduced thereinto. Hopper mounting pins 62, 62 (FIGS. 1A-C) on opposite ends of hopper 14 are then inserted into their respective apertures 80, 80. The respective tapered walls 80*a*, 80*a* shove hopper 14 forward until the developer roller in the hopper contacts the photoconductive drum in the removable toner cartridge universal adapter.

As in the preceding embodiment, there is no need for torque tab 43 formed in hopper 14 and thus there is no need for hopper torque tab receptacle 40.

Figure 10A:
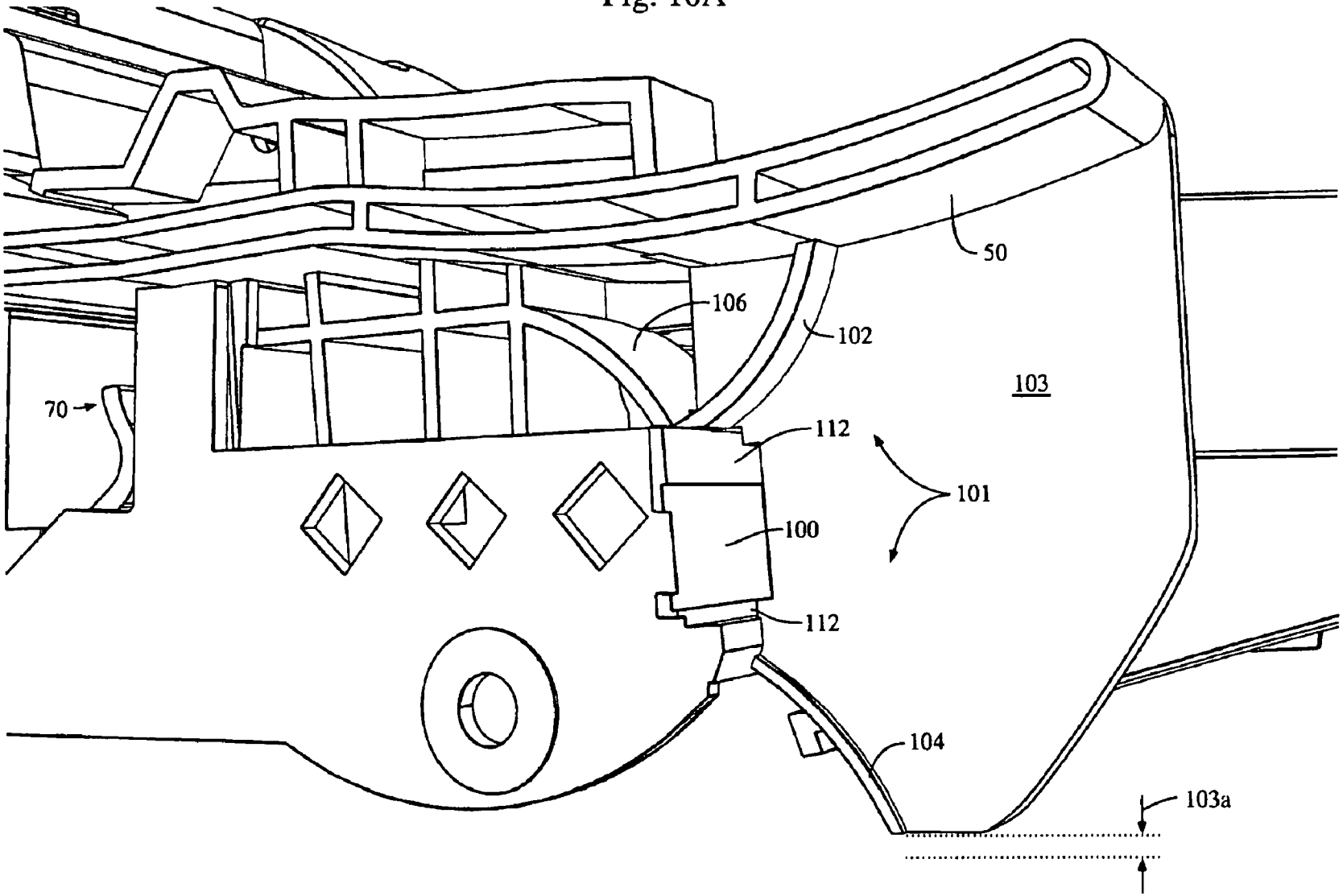
FIG. 10A is a perspective view of a structure that prevents installation of overlapping circuit boards.

FIG. 10A provides an enlarged view of the novel structure 101 that prevents "piggy backing" of a problematic circuit board over a vertically-mounted host circuit board. There is no "piggy backing" problem associated with horizontally-mounted circuit boards. Flat mounting surface 100 is recessed with respect to raised flat mounting surface 112 and said mounting surface 100 is therefore adapted to receive thereon a circuit board that is smaller than a circuit board supported by raised surface 112. Whether small or large, the circuit board is electrically contacted by spring-loaded contacts in the printer. When a "piggy back" circuit board is placed over the host circuit board, the spring-loaded contacts in the printer urge the contacts onto the "piggy back" circuit board with a force that can damage the spring-loaded contacts by over-compressing the contacts in the printer beyond their normal limits due to the double thickness of the two circuit boards.

A pair of arcuate blocking members is therefore provided. Upper arcuate member 102 extends from a point just above raised mounting surface 112 to a lower surface of planar wing 50. Lower arcuate member 104 extends from a point just below said raised mounting surface 112 to a preselected point at a still further lower elevation. Both arcuate members are preferably formed of a high impact plastic. Unauthorized circuit boards are substantially larger than the authorized board, so the presence of arcuate blocking members 102, 104 obstructs the placing of a "piggy back" circuit board over the host circuit board.

Wall 103 to which arcuate members 102 and 104 are mounted is called a skeg wall in the industry. More particularly, it is called the driven side skeg wall because it is positioned on the driven side of toner cartridge 10. Directional arrows 103*a* at the lower right corner of FIG. 10A indicate that the lower edge of skeg wall 103 has been cut so that it is flat. Specifically, about four millimeters (4 mm) have been shaved from the bottom edge of a skeg wall of the prior art. This enables the mated hopper and waste bin to sit in a stable position, i.e., without wobbling, on a flat surface external to a printer, i.e., when said mated waste bin and hopper are not positioned in a printer-receiving cavity. The skeg wall of prior art toner cartridges introduces instability and said prior art toner cartridges therefore wobble when placed on a flat surface external to a printer.

Plastic brace 106 is bent downwardly in an arc as shown to provide additional support to upper arcuate member 102 so that said arcuate member 102 cannot be displaced rearwardly to make room for a "piggy back" circuit board.

Figure 10B:
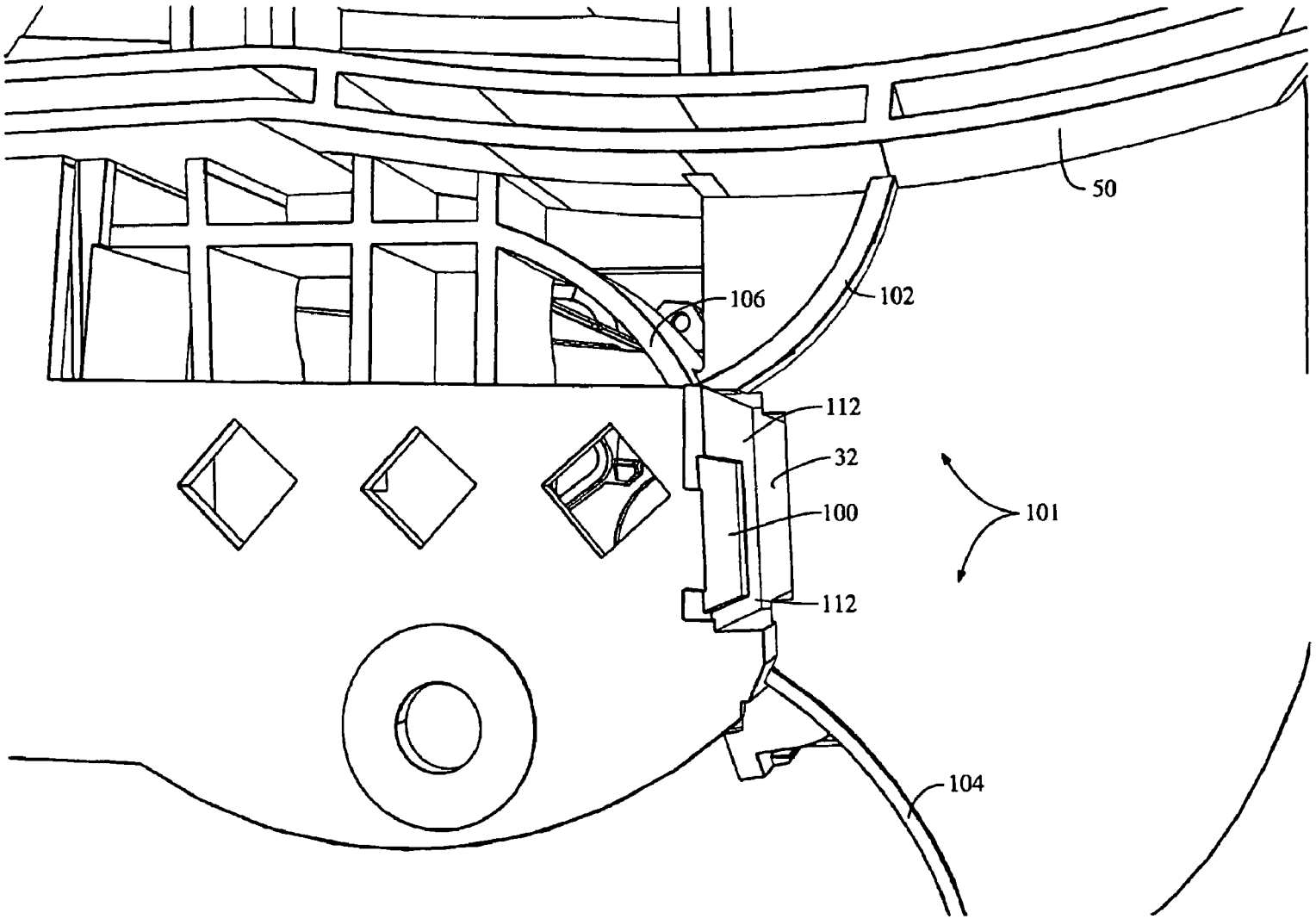
FIG. 10B is a perspective view of the FIG. 10A structure depicting a larger circuit board mounting surface positioned above a smaller circuit board mounting surface.
Figure 10C:
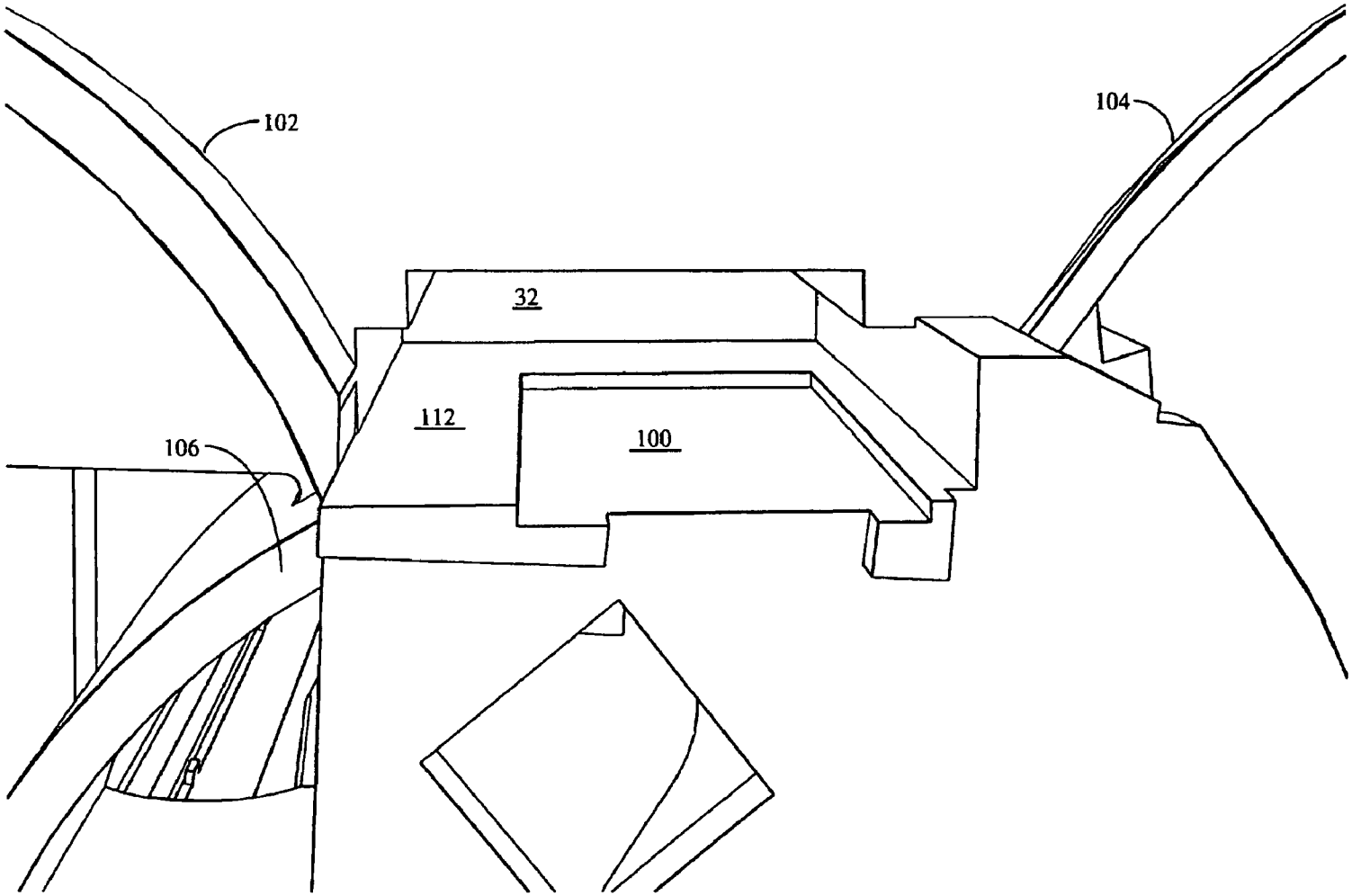
FIG. 10C is an enlarged perspective view of the novel circuit board mounting pad.

FIG. 10B is a perspective view of recessed surface 100 and raised surface 112. FIG. 10C provides an enlarged view of embodiment of FIG. 10B. Recess 100 is adapted to receive a small circuit board, not shown in this figure, and raised surface 112 receives a larger circuit board, not shown in this figure.

Figure 11:
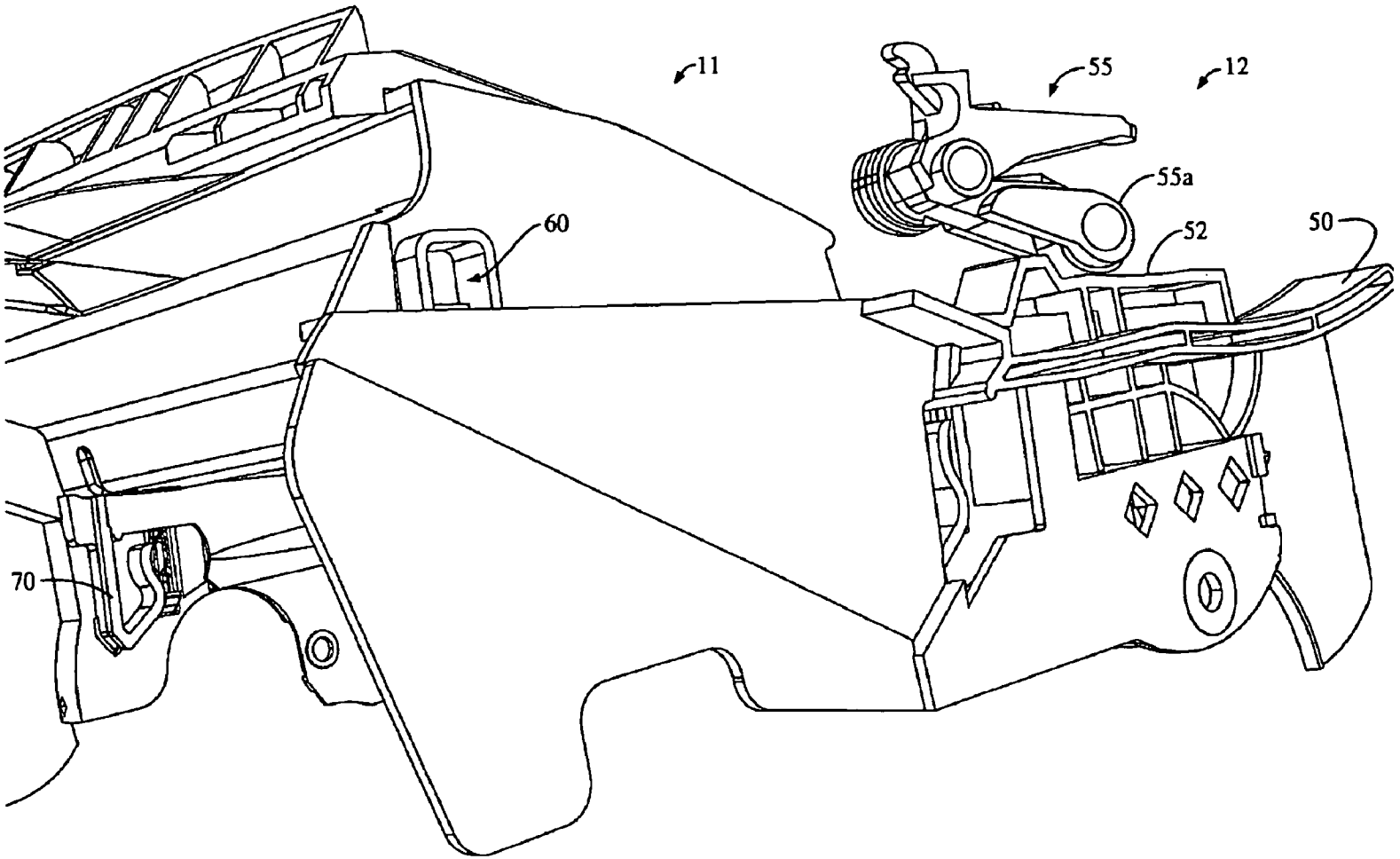
FIG. 11 is a rear perspective view of the waste bin, including a rear perspective view of a printer downward forcing roller assembly.
Figures 12A, 12B, 12C, 12D, 12E, 12F:
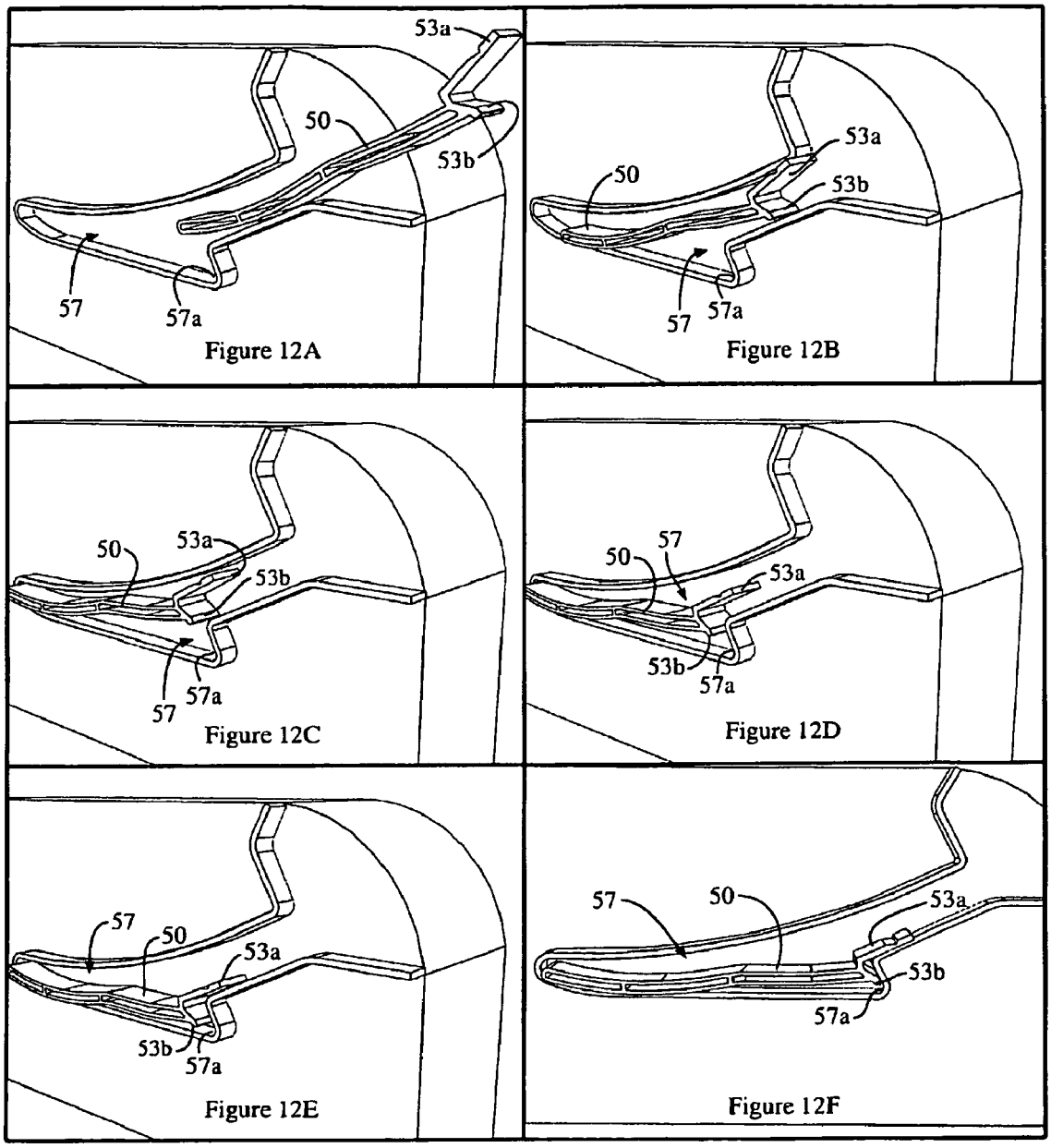
FIG. 12A is the first animation in a series of six animations depicting the insertion of a first embodiment of a planar wing into a printer guide groove.
FIG. 12B is the second animation in said series.
FIG. 12C is the third animation in said series.
FIG. 12D is the fourth animation in said series.
FIG. 12E is the fifth animation in said series.
FIG. 12F is the sixth animation in said series.

FIG. 11 is a rear perspective view of waste bin 12. Downward forcing wheel 55*a* that forms a part of downward forcing lever assembly 55 is depicted in rolling engagement with concavity 52.

FIGS. 12A-F provide an animation depicting the insertion of a planar wing 50 into receiving cavity 57 of a printer. The trailing end of planar wing 50 is bifurcated into upper section 53*a* and lower section 53*b* and performs a latch function when lower section 53*b* is fully received within catch cavity 57*a* at the trailing end of receiving cavity 57. The small size of lower section 53*b* reduces its contact area with receiving cavity 57, thereby making it easy to insert and remove toner cartridge 10 into and from the printer, respectively.

Figure 13:
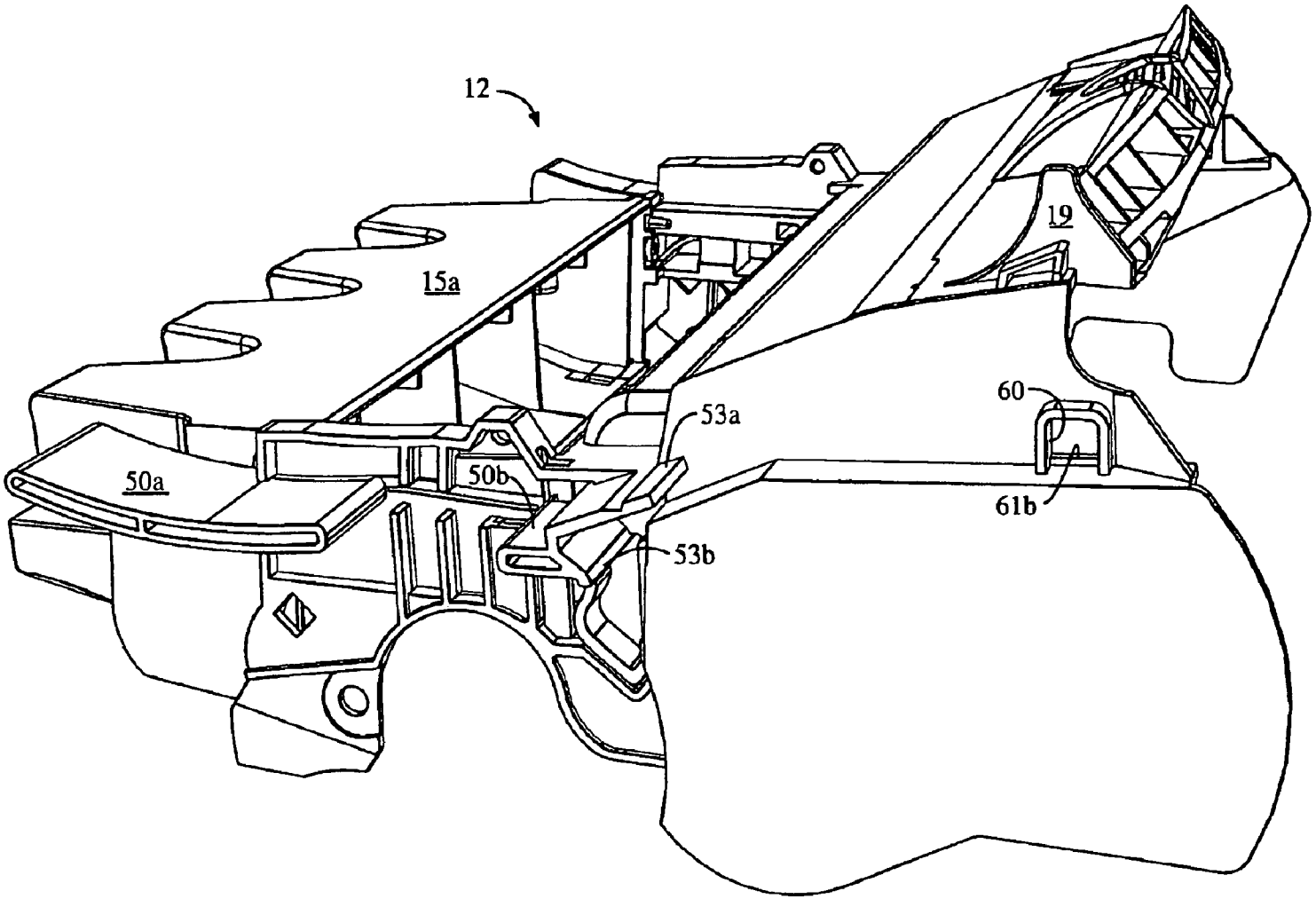
FIG. 13 is a side perspective view of the novel waste bin depicting a second embodiment of the novel planar wings.

FIG. 13 is a perspective view depicting an embodiment of planar wing 50 where said planar wing is discontinuous. The leading part is denoted 50*a* and the trailing part thereof is denoted 50*b*.

Figure 14:
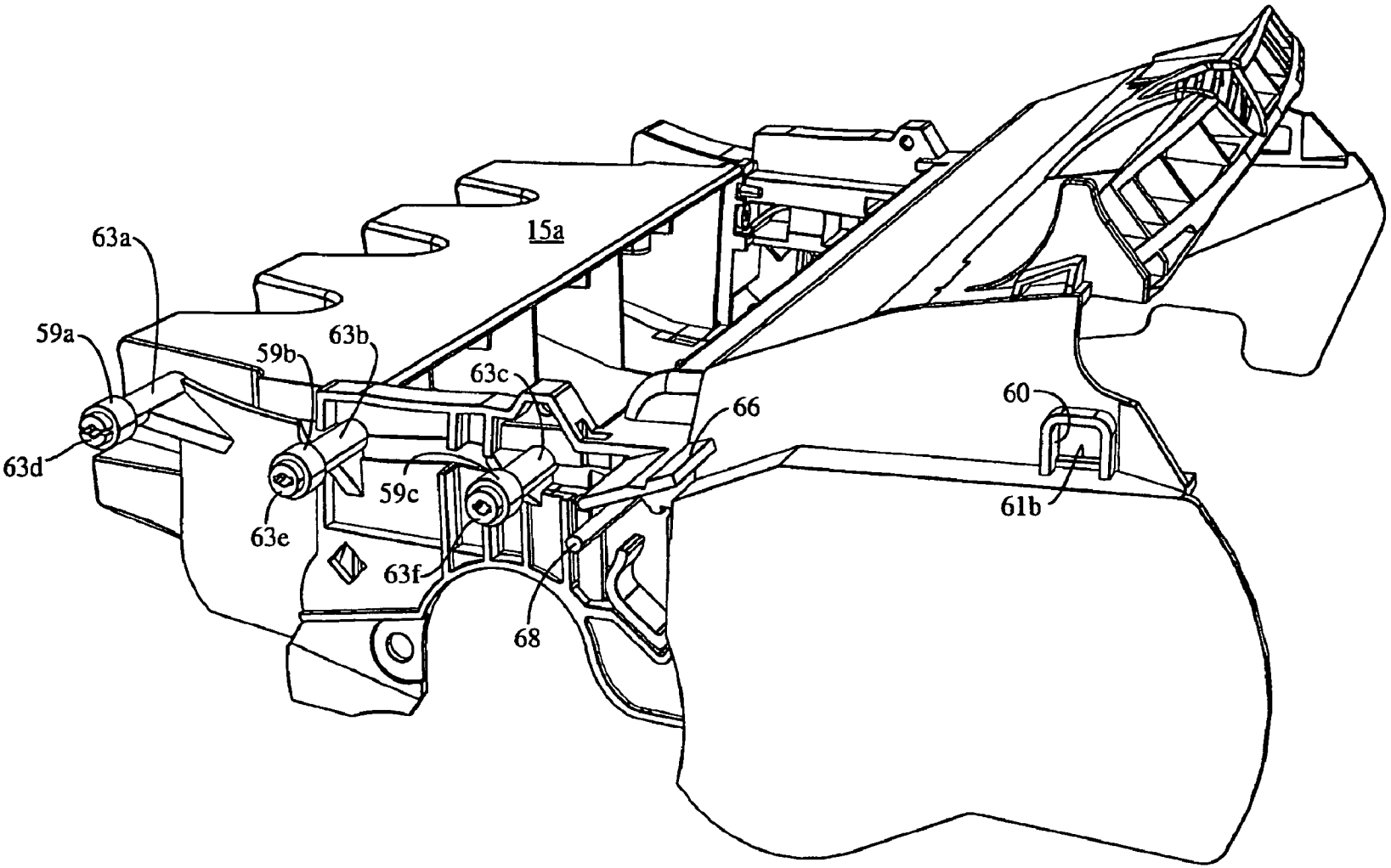
FIG. 14 is a side perspective view of the novel waste bin depicting a third embodiment of the novel planar wings.
Figures 15A, 15B, 15C, 15D, 15E, 15F:
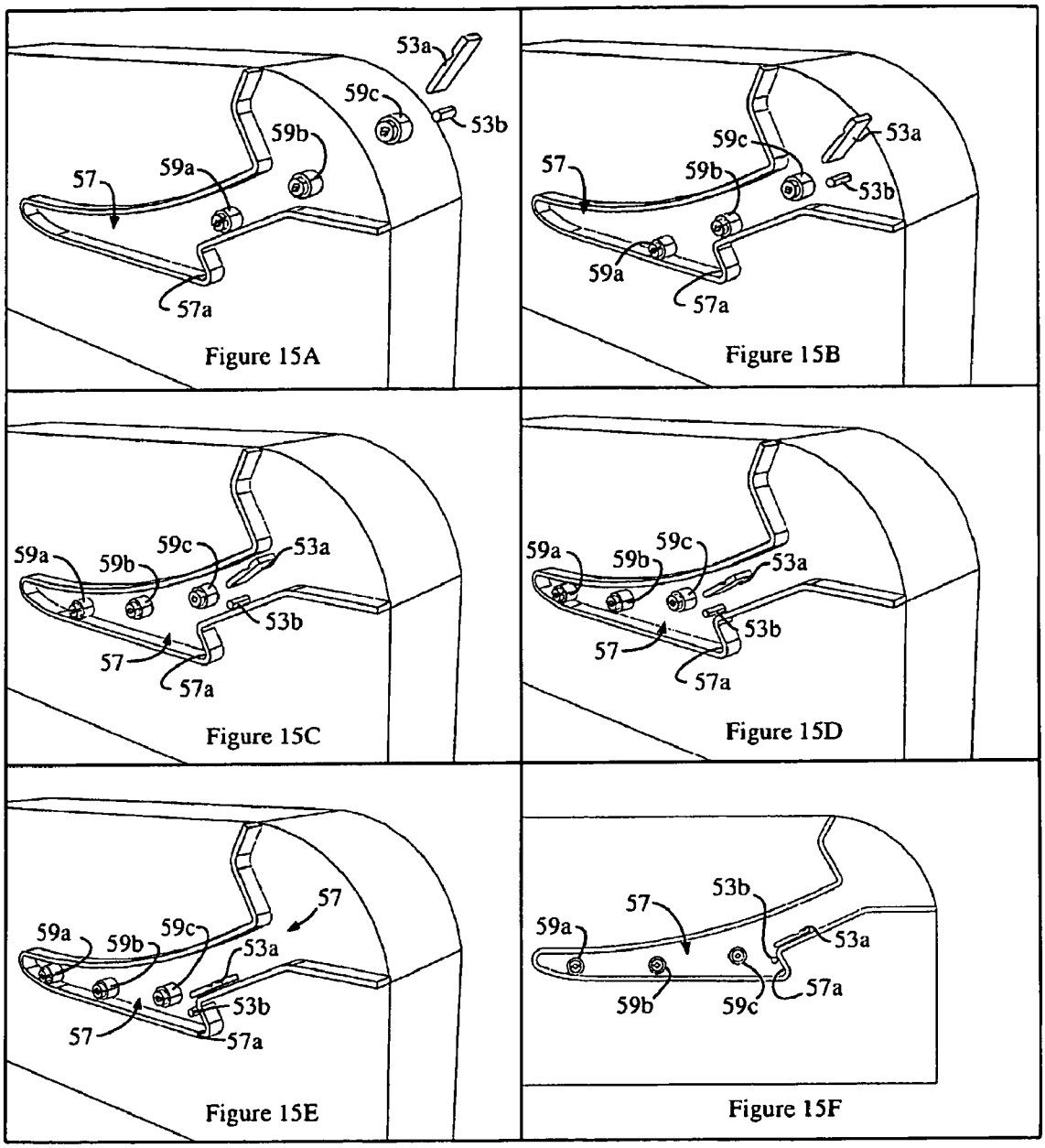
FIG. 15A is the first animation in a series of six animations depicting the insertion of the third embodiment of a planar wing into a printer guide groove.
FIG. 15B is the second animation in said series.
FIG. 15C is the third animation in said series.
FIG. 15D is the fourth animation in said series.
FIG. 15E is the fifth animation in said series.
FIG. 15F is the sixth animation in said series.

FIG. 14 is a perspective view depicting still another alternative embodiment where continuous planar wing 50 and discontinuous planar wings 50*a* and 50*b* are both replaced by a plurality of wheel assemblies. Wheels 59*a*, 59*b*, and 59*c* are mounted on axles 63*a*, 63*b*, and 63*c*, respectively. The axles are formed of a flexible and resilient material and are diametrically split as at 63*d*, 63*e*, and 63*f*, respectively. Thus, they are squeezed when the wheels are placed thereon so that when said axles are released from said squeeze, the axles expand and hold the wheels in place. Flat plate 66 and locating pin 68 collectively perform the function of parts 53*a*, 53*b* in the above-disclosed embodiments of planar wing 50.

FIGS. 15A-F depict how the assembly of FIG. 14 is inserted into printer receiving cavity 57.

These wheels provide support at key positions during installation, engagement and removal of the cartridge from the printer.

Figure 16A:
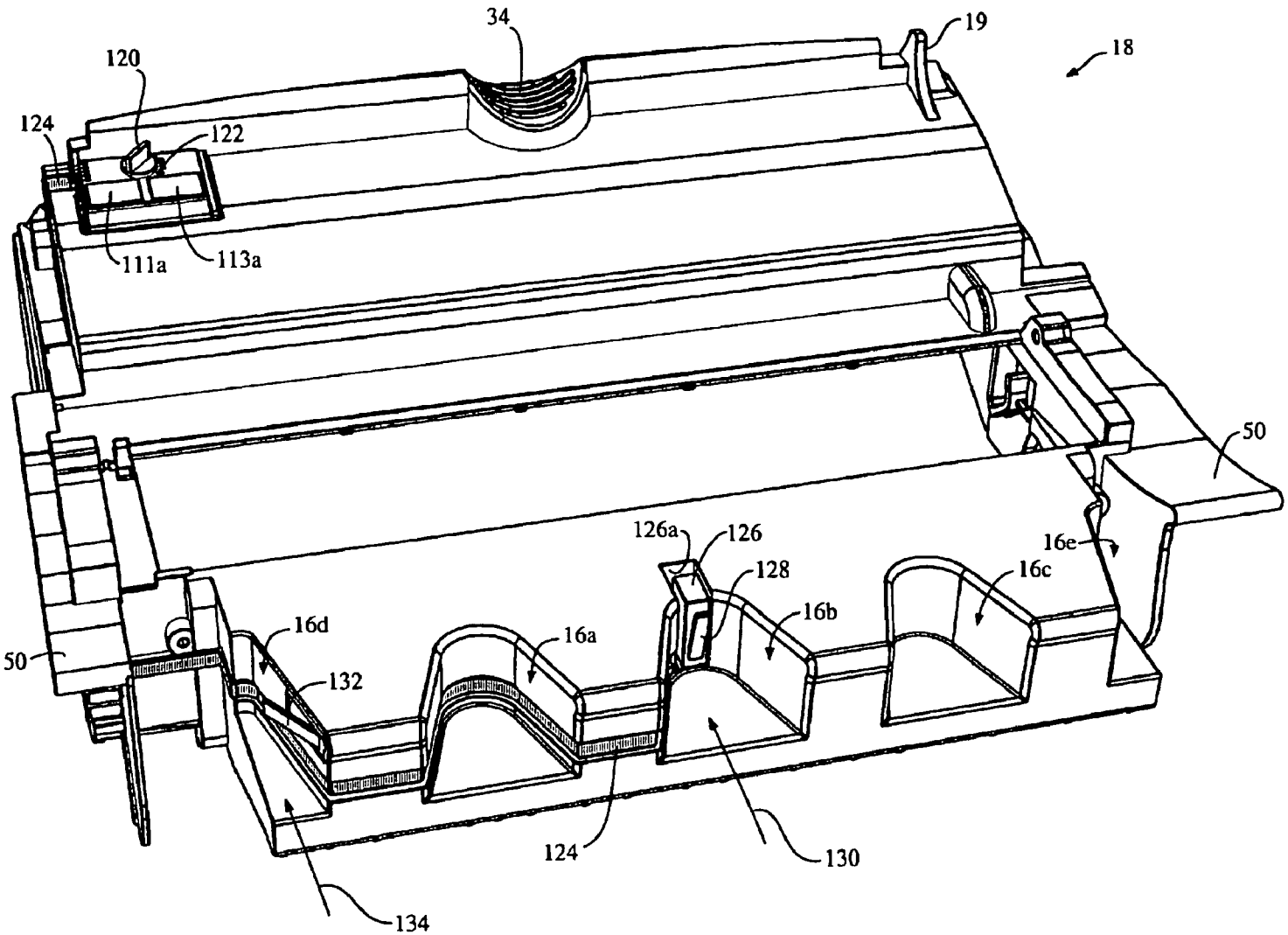
FIG. 16A is a top plan view of an embodiment having a dial setting for each printer brand with which the novel toner cartridge will operate.
Figure 16B:
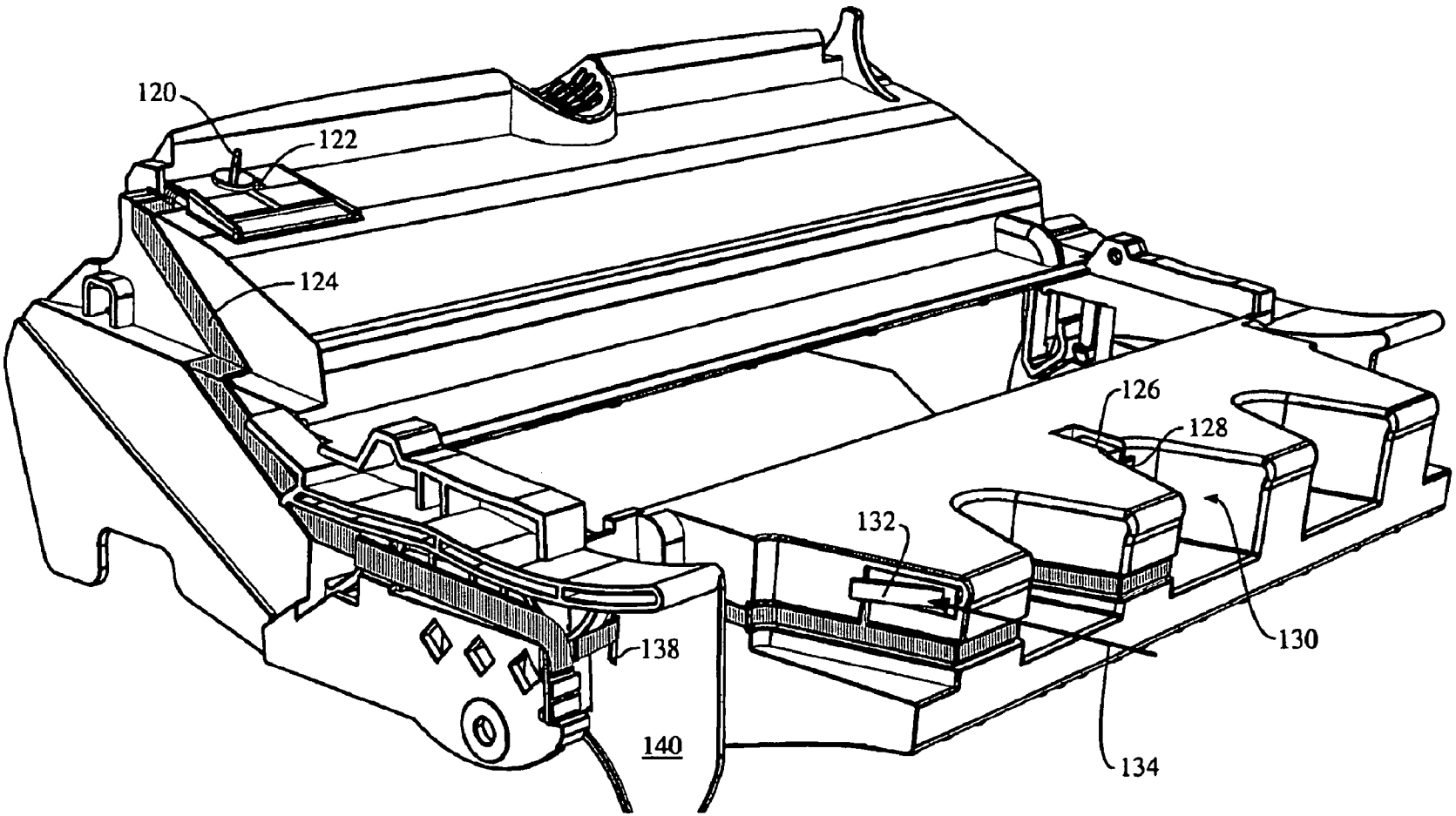
FIG. 16B is a perspective view of the embodiment of FIG. 16A.

FIGS. 16A and 16B depict an embodiment of the novel toner cartridge where two independently-generated electrical signals are used to activate a printer. Both signals are fed to a circuit board that activates the printer. One of the signals identifies a family of printers to which a printer belongs, and the other signal identifies the brand name of the printer within that family.

Rotatably mounted dial 120, also known as a brand selector switch, is mounted on circuit board 110*a*. It has a plurality of discrete settings, collectively denoted 122. Dial 120 enables a user to visually identify a printer by its brand name and to set dial 120 to a setting 122 that tells circuit board 110 what that brand name is.

A conductive ribbon 124 interconnects circuit board 110 and a microswitch having an actuator that is actuated when contacted by a protuberance formed in a printer. Thus, the protuberance depresses the actuator and the microswitch sends a signal that indicates the printer family through ribbon 124 to circuit board 110 that enables the operation of the cartridge in the printer. Selector switch 120*a* is also in electrical communication with circuit board 110. In this way, the signal carried to the circuit board by ribbon 124 tells circuit board 110 what family the printer belongs to and the user, by manipulating selector switch 120*a*, tells the circuit board the brand name of the printer within the family. So that the correct communication occurs, the brand and family information are then sent to an electronic device, not shown, that would be mounted on circuit board 110. This semi-automatic switching system allows a cartridge to determine within which particular printer it has been installed.

There are numerous possible positions for the microswitch and there may be any number and types of microswitches at differing positions. Moreover, the microswitch may be provided in many different forms. For example, depressible keypads of the type commonly used in microwave ovens, which may also be referred to as pressure-sensitive flexible printed circuit board switches, may be used in lieu of the switch depicted in said Figs. Moreover, the microswitch may take the form of an optical microswitch. All known microswitches are within the scope of this invention.

In the example of FIGS. 16A and 16B, microswitch 126 is positioned in a recess 126*a* at the bight of leading end recess 16*b* so that microswitch actuator 128 extends into said leading end recess. Accordingly, a force applied in the direction of directional arrow 130 activates actuator 128. Such force is applied by a protrusion or protuberance formed in the printer into which the novel toner cartridge is inserted. Depression of actuator 128 by said protuberance activates microswitch 126 and said microswitch sends a signal to circuit board 110.

Second switch actuator 132 is positioned in one of the outboard recesses. It operates in the same way as actuator 128, i.e., a force exerted in the direction of directional arrow 134 causes actuator 132 to close a switch and send a signal to circuit board 110.

The invention is not limited to this particular arrangement of microswitches because printer manufacturers may in the future change their respective printer structures. However, the principle of universality disclosed herein enables the designer of toner cartridges to change the switch positions or to add more switches as needed.

Figure 16C:
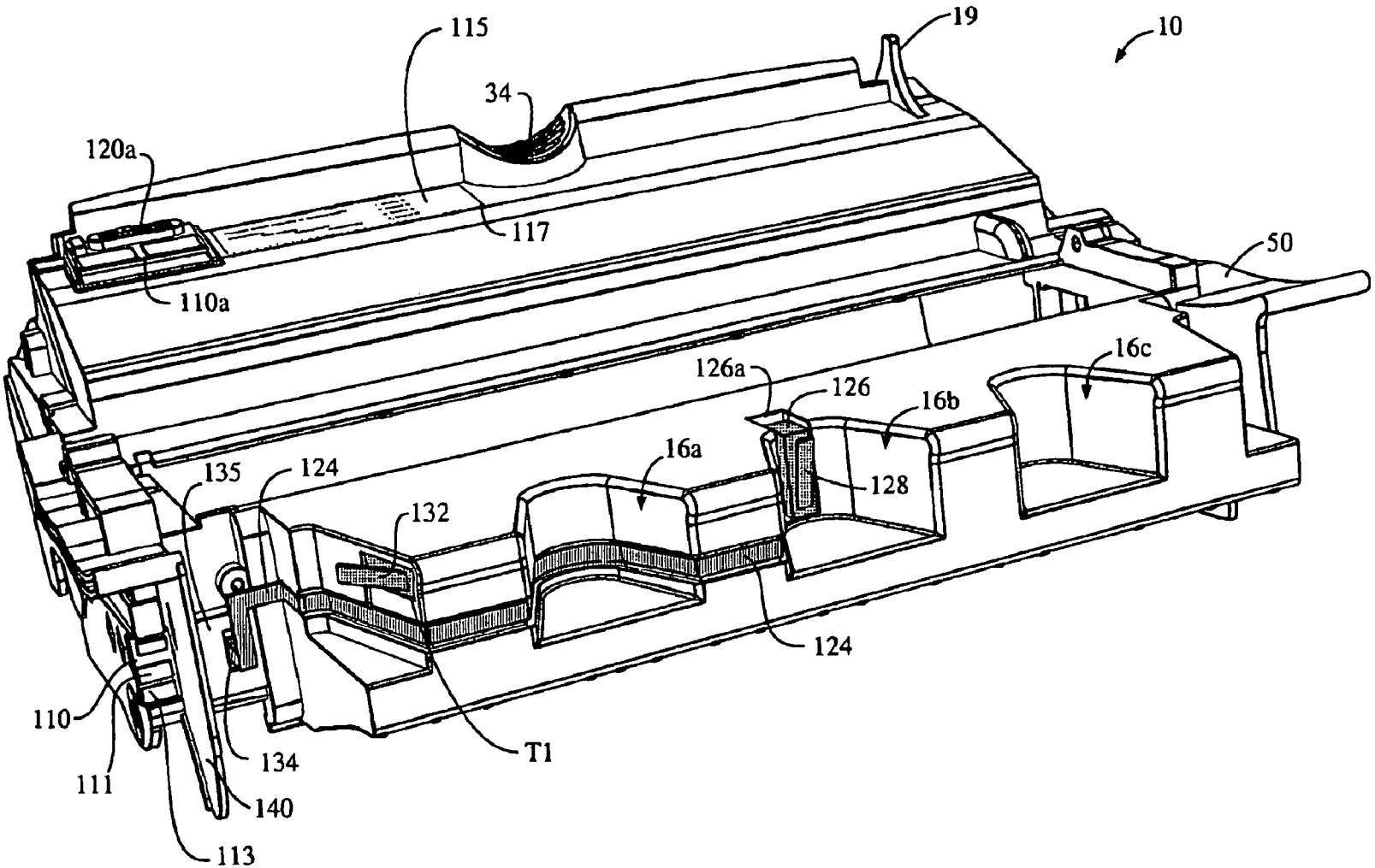
FIG. 16C is a front perspective view depicting a variation of the embodiments of FIGS. 16A and 16B.
Figure 16D:
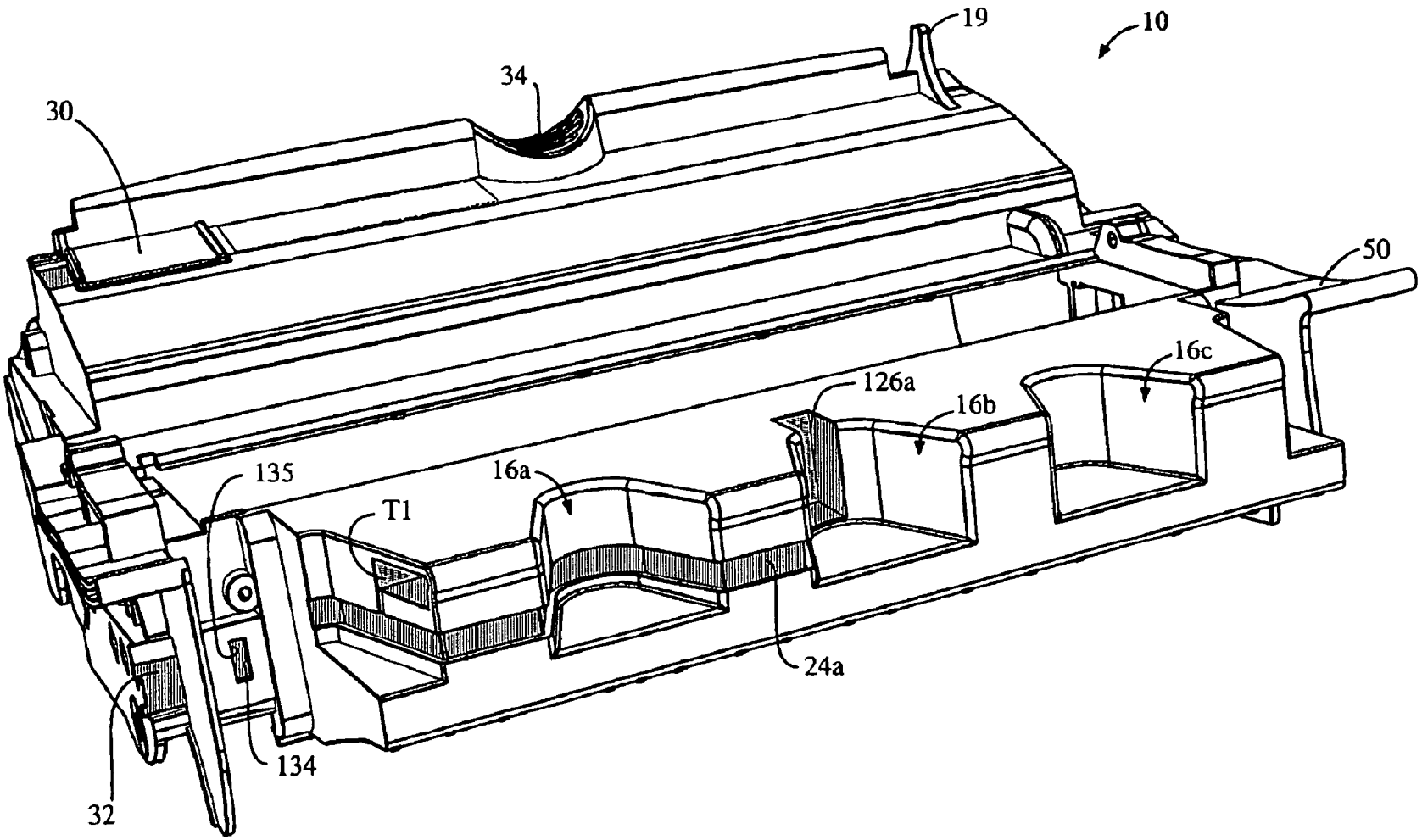
FIG. 16D is a perspective view of the embodiment of FIG. 16C but with a few parts removed to further illustrate the structure.

However, the two switch/switch actuator arrangement of FIGS. 16A-C is very powerful in that it enables the identification of all of the printer families mentioned above. Thus, it enables the identification of all printers in the 520, 620, and 630 family of printers. It also identifies all printers in the Se/T family of printers as well as printers having no circuit boards. It does not identify the brand name of a printer within a family, said function being performed by a user as disclosed above.

Figure 16E:
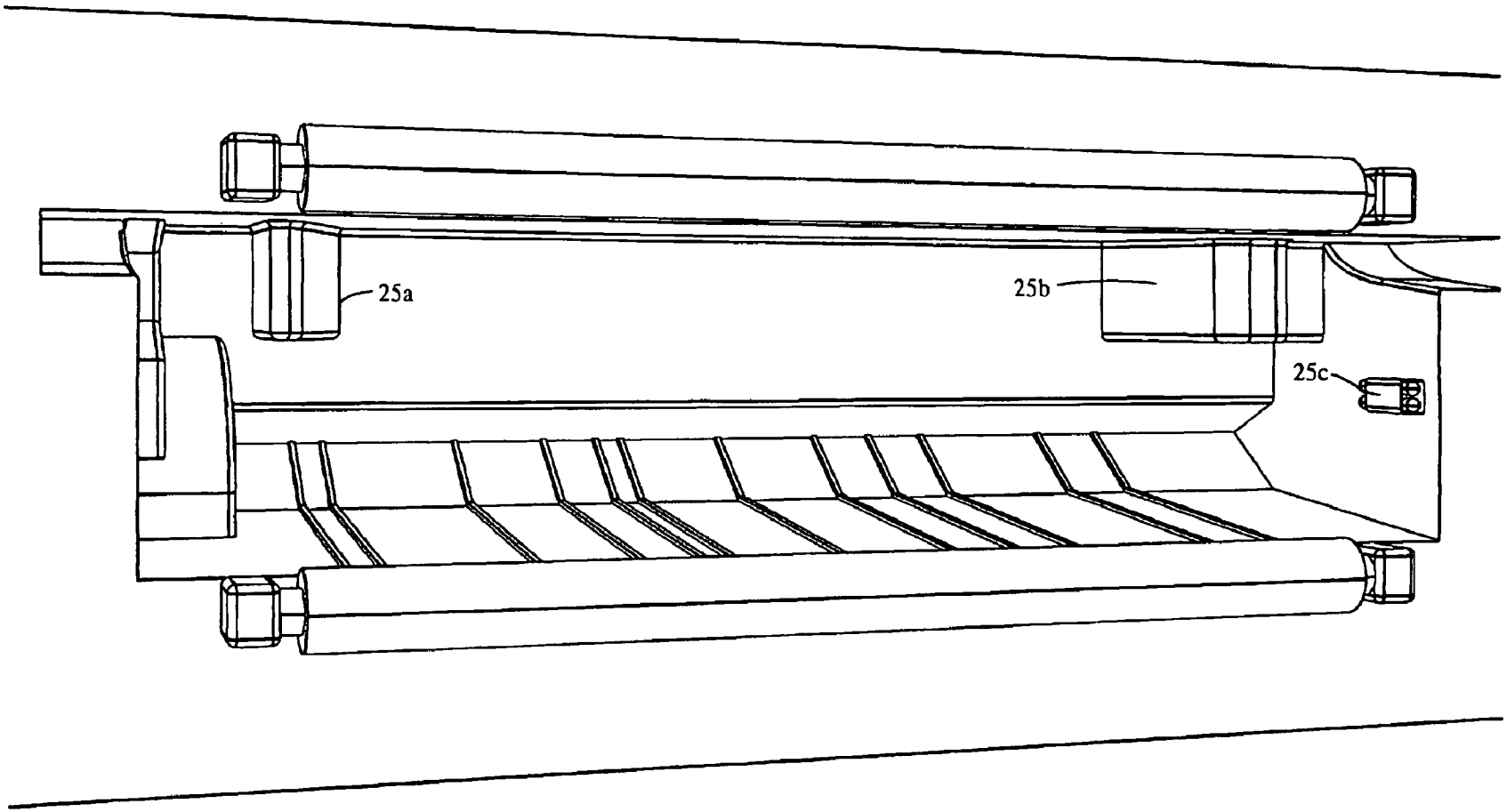
FIG. 16E is a perspective view of a toner cartridge-receiving cavity having a pair of outboard protrusions and outboard electrical contacts that mate with vertical front circuit boards.

More particularly, a toner cartridge-receiving printer cavity having a front-mounted, vertically disposed circuit board port and first and second protuberances 25*a*, 25*b* formed therein at opposite ends thereof as depicted in FIG. 16E is identified by contact with second switch actuator 132 which is positioned at the outboard edge of the novel universal waste bin as aforesaid. The switch associated with said actuator, when closed, sends a signal to the printer controller electronics, or universal printer chip that activates a family of printers having said arrangement of first and second protuberances. In this example, the signal would activate any member of the 620 family of printers.

More specifically, the signal will activate all of the following printers: Optra SE3455, Lexmark T620*, Lexmark T622*, IBM Infoprint 1130*, IBM Infoprint 1140*, Nashuatec P6015, Nashuatec P6230*, Nashuatec P6240*, Source Technologies ST915, Source Technologies ST920, Source Technologies ST925, Source Technologies ST935*, Source Technologies ST9130*, Source Technologies ST9140*, Source Technologies ST1130*, Source Technologies 1140*, Unisys UDS15, Unisys UDS20, Unisys UDS25, Unisys UDS35, Unisys UDS134*, Unisys UDS136*, Toshiba E-Studio 30P* and Toshiba E-Studio 40P*. All model numbers with an asterisk (*) use front-mounted, vertically-disposed circuit board contacts. The model numbers without an asterisk use horizontally-mounted circuit board contacts.

Figure 16F:
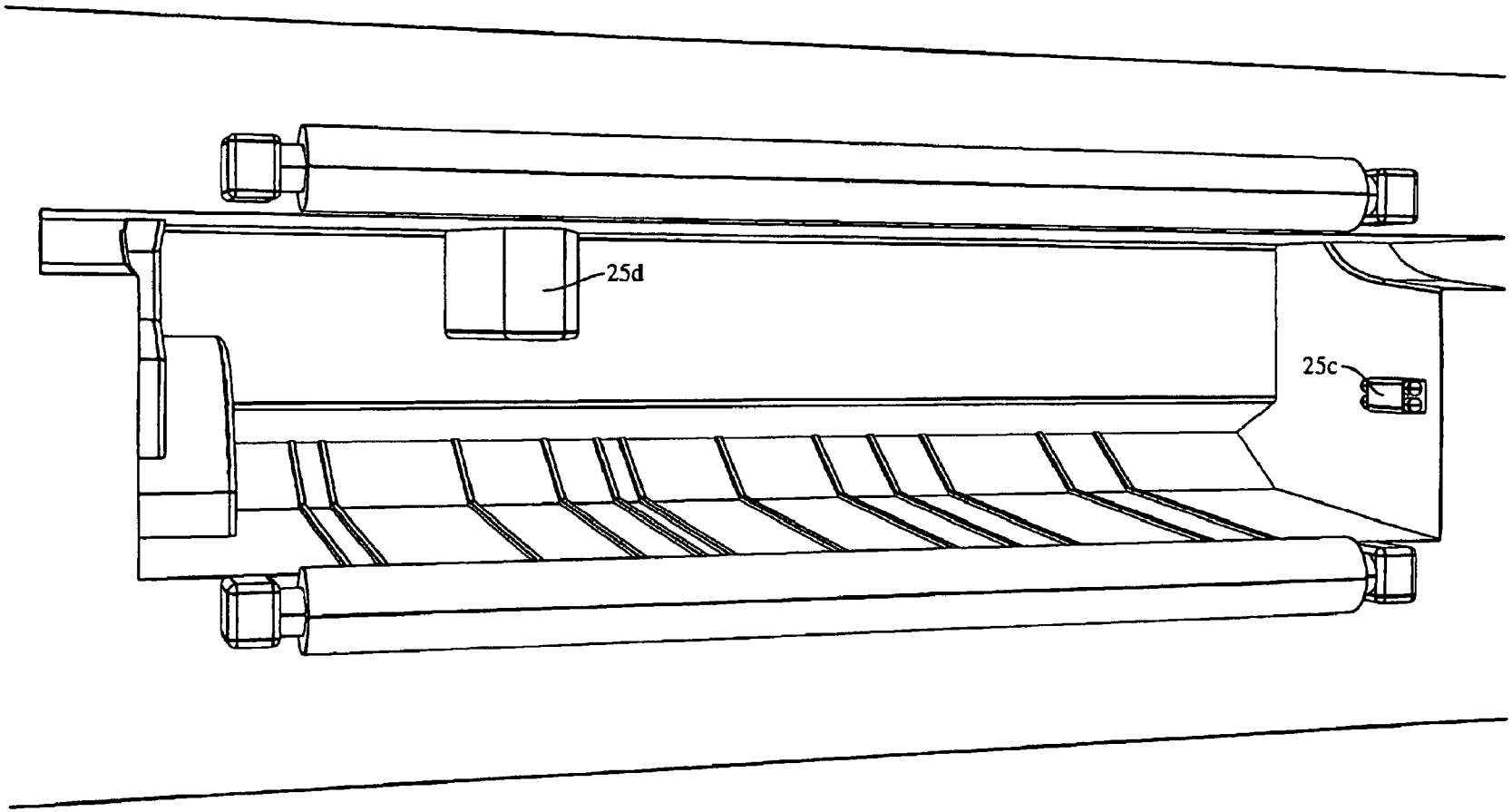
FIG. 16F is a perspective view of a toner cartridge-receiving cavity having a left-of center protrusion and outboard electrical contacts that mate with vertical front circuit boards.

A toner cartridge-receiving printer cavity having a front-mounted, vertically disposed circuit board port and a left of center protuberance 25*d* formed therein as depicted in FIG. 16F is identified by absence of contact with actuator switch 128 positioned in the center recess of the waste bin and by absence of contact with actuator switch 132 positioned in a recess formed in the outboard edge of the waste bin. The lack of communication from either of such switches indicates that the printer is a member of the 630 family of printers.

The toner cartridge-receiving cavity of FIG. 16F has utility with the following printers: Dell W5300n*, Lexmark T632*, Lexmark T634*, IBM Infoprint 1352*, IBM Infoprint 1372*, Source Technologies ST9340*, Source Technologies 1352*, Toshiba e-Studio 400P*, Unisys UDS 142*, and Unisys 144*. The asterisk (*) indicates that the printer uses front contacts, i.e., contacts that electrically engage vertically-mounted circuit boards.

Figure 16G:
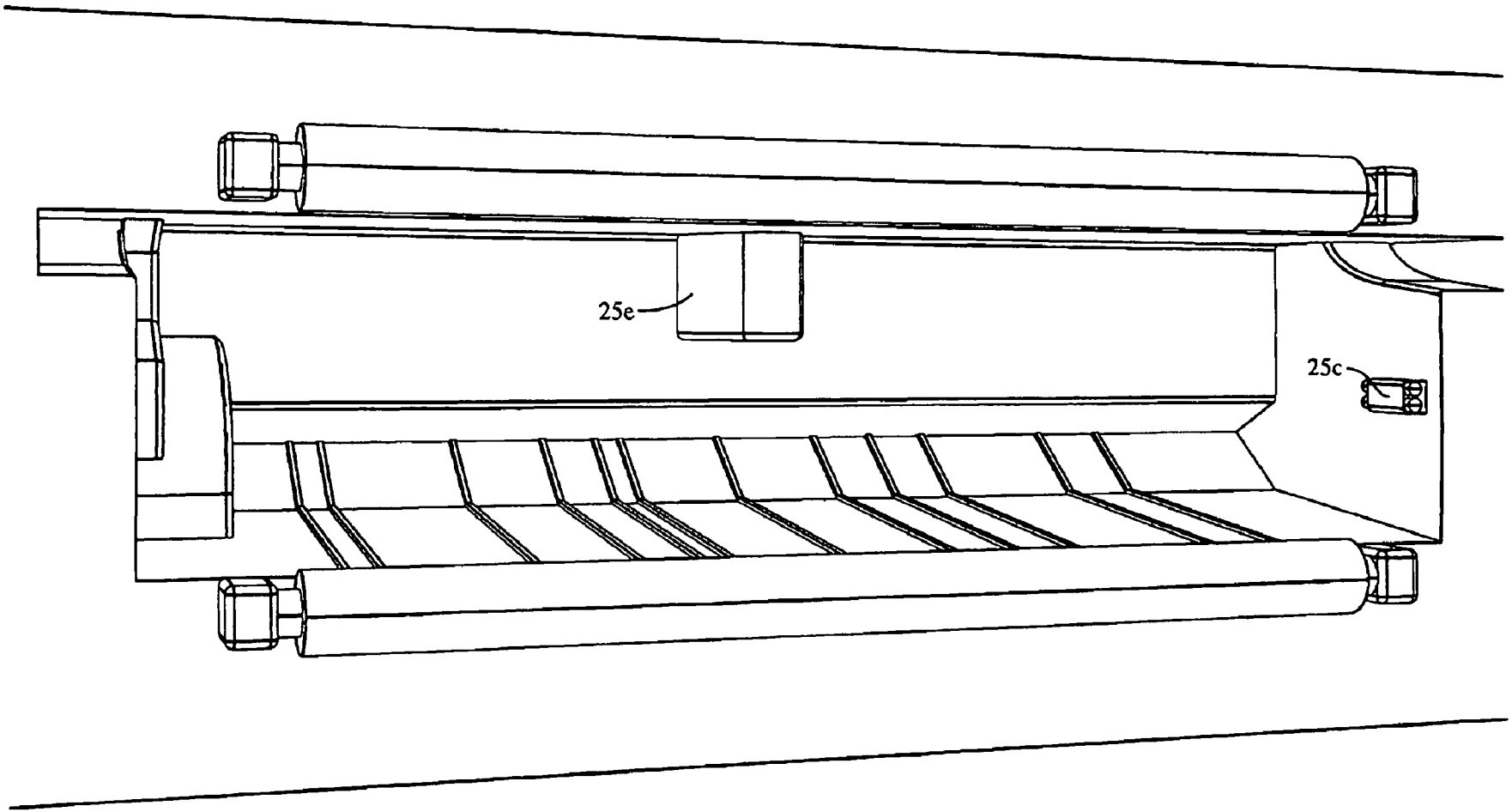
FIG. 16G is a perspective view of a toner cartridge-receiving cavity having a center protrusion and outboard electrical contacts that mate with vertical front circuit boards.

A toner cartridge-receiving printer cavity having a front-mounted, vertically disposed circuit board port and a centered protuberance 25*e* formed therein as depicted in FIG. 16G is identified by contact with actuator switch 128 positioned in the center recess of the waste bin. Switch 126, when closed, sends a signal to the printer controller electronics, or universal printer chip that activates any member of the 520 family of printers. Printers in this family would not activate second switch actuator 132. Thus, the 520 family is identified by the presence of a signal from first switch 126 and an absence of a signal from the switch actuated by actuator 132.

The toner cartridge-receiving cavity of FIG. 16G has utility with the following printer models: Lexmark T520*, Lexmark T522*, Nashuatec P6220*, Nashuatec P6225*, IBM Infoprint 1120*, IBM Infoprint 1125*, Source Technologies ST9120*, Source Technologies ST9125*, Source Technologies 1120*, Source Technologies 1125*, Unisys UDS130*, Unisys UDS 132*, Toshiba E-Studio 20P*, and Toshiba E-Studio 25P*, all of which use front contacts as indicated by the asterisk associated with each model.

Figure 16H:
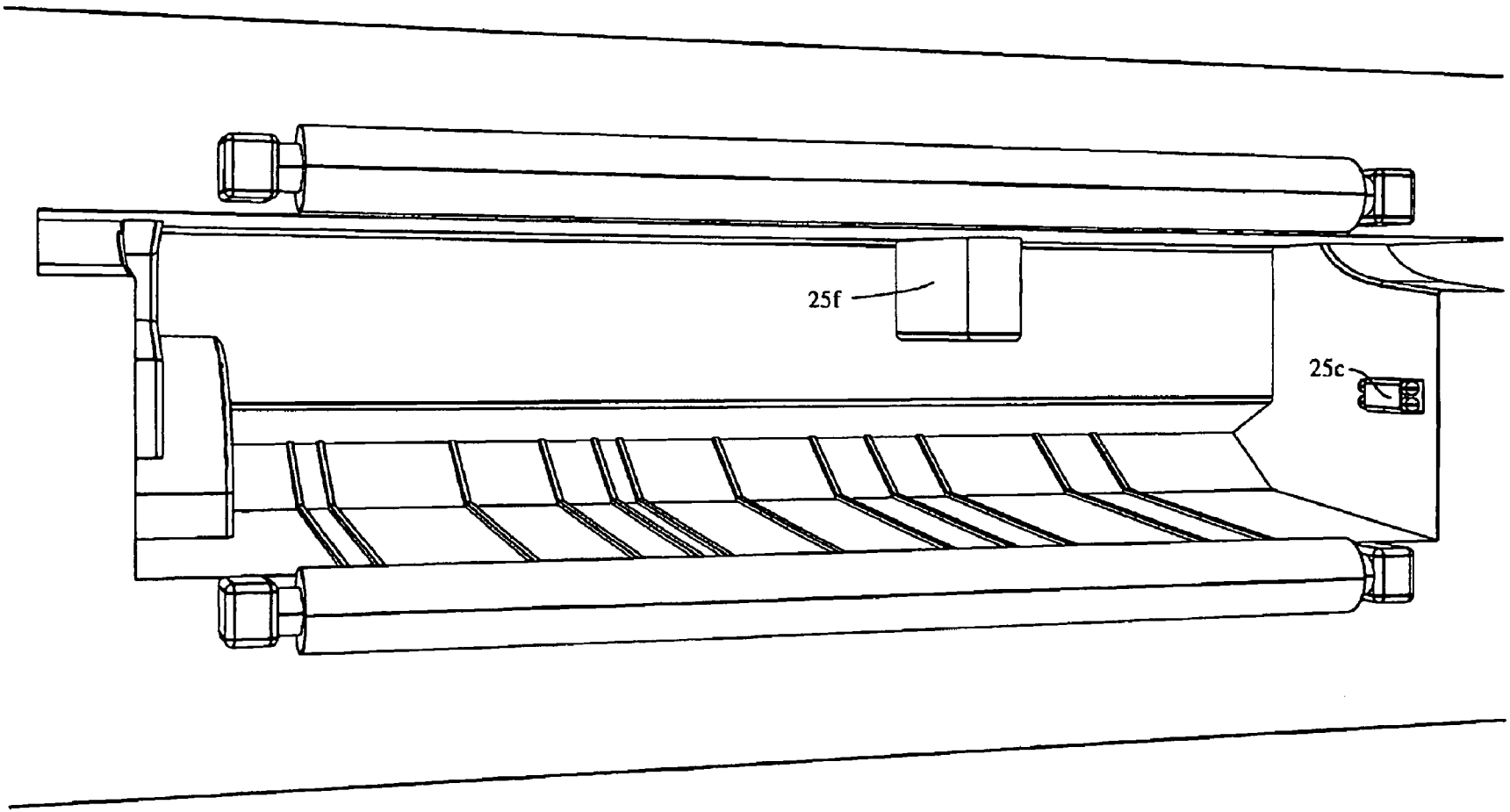
FIG. 16H is a perspective view of a toner cartridge-receiving cavity having a right-of center protrusion and outboard electrical contacts that mate with vertical front circuit boards.

A toner cartridge-receiving printer cavity having a front-mounted, vertically disposed circuit board port and a right of center protuberance 25*f* formed therein as depicted in FIG. 16H is identified by absence of contact with actuator switch 128 positioned in the center recess of the waste bin and by absence of contact with actuator switch 132 positioned in a recess formed in the outboard edge of the waste bin. The lack of communication from either of such switches indicates that the printer is also a member of the 630 family of printers.

The toner cartridge-receiving cavity of FIG. 16F has utility with the following printer models, all of which use front contacts as indicated by the asterisk associated with each model: Lexmark T630*, IBM 1332*, Dell M5200N*, Source Technologies 9335*, and Source Technologies 1332*.

A printer having a top-mounted, generally horizontally disposed circuit board takes precedence over any switch signals that might otherwise be communicated to denote a family of printers that singularly employ such horizontal circuit board mounting. In other words, signals from a switch or switches actuated by the presence of a particular arrangement of protuberances of the type that might be found in printers having front-mounted, vertical circuit boards are ignored if a top-mounted, generally horizontally disposed circuit board is detected. Any printer in the Se/T family of printers would thus be recognized.

Figure 16I:
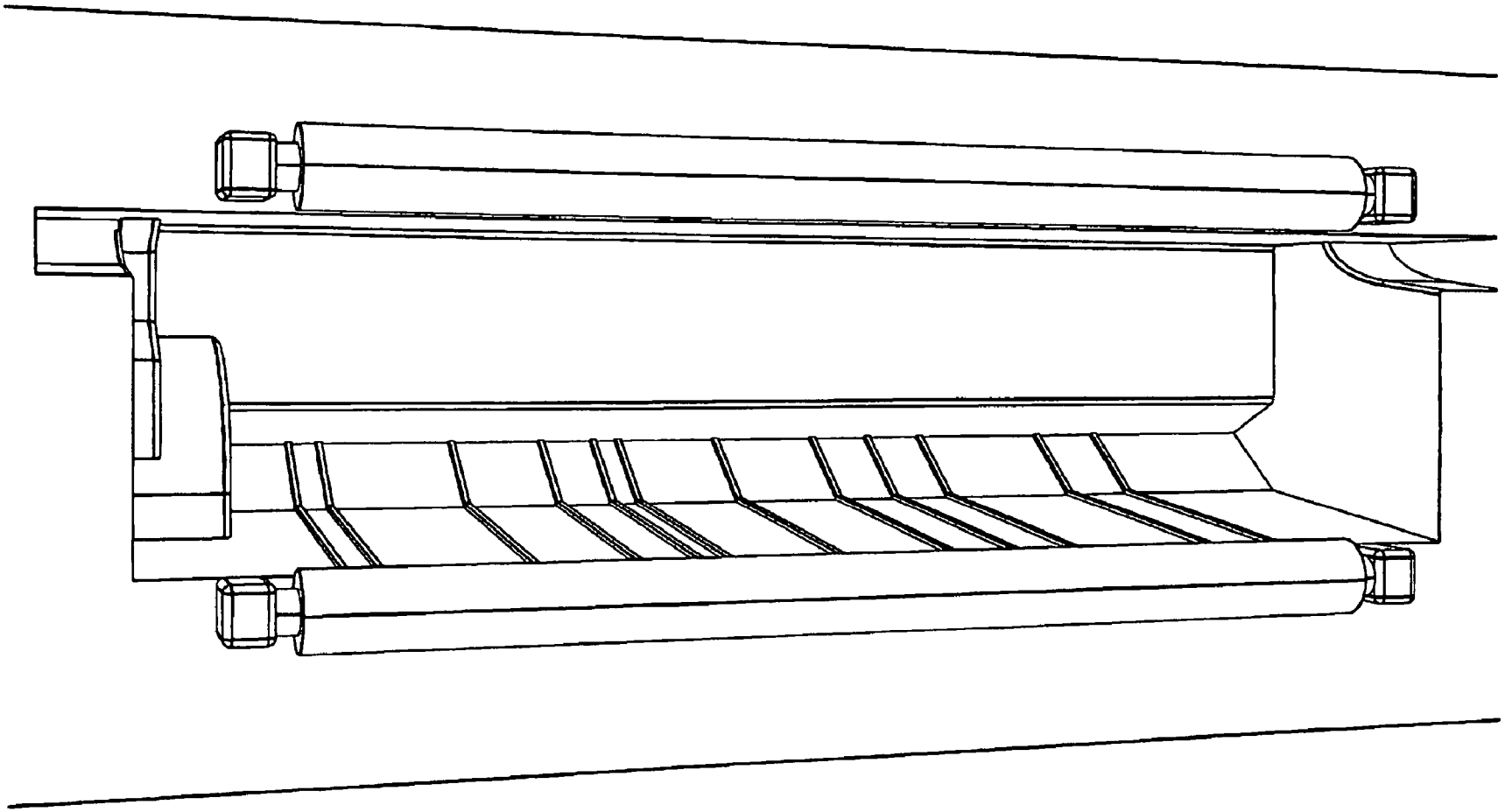
FIG. 16I is a perspective view of a toner cartridge-receiving cavity no protrusion and no outboard electrical contacts.

The novel universal waste bin of this invention is also compatible with printers having no circuit board ports, such as depicted in FIG. 16I. Such printers do not electrically communicate with their associated toner cartridges. A printer of such type requires no communication from its associated toner cartridge so there is no need for any switch to be actuated. Thus, signals that may be sent upon depression of switch actuators by a toner cartridge are ignored when a printer of this type is detected.

Printers having no circuit board ports include the Optra S, Optra S 1250, Optra S 1255, Optra S 1620, Optra S 1625, Optra S 1650, Optra S 1855, Optra S 2420, Optra S 2455, Unisys UDS 9712, Unisys UDS 9716, and Unisys UDS 9718.

As mentioned above, it is not enough to identify a printer just by the family to which it belongs. The 520 family includes printers sold under the brand names Lexmark®, Source Technologies®, Toshiba®, and IBM®. The 620 family includes printers sold under the same brand names as the 520 family, but the model numbers of the 620 family printers are different from the model numbers of the 520 family. Similarly, the 630 family includes the same printer brands as the 520 and 620 families, and with Dell® printers as well, but again with model numbers different from the model numbers of the 520 and 620 families.

Thus it is necessary for a user to identify the brand name of the printer after the family has been automatically identified in the manner disclosed above. The user need not know which family the printer belongs to because that is determined by the structure just disclosed. However, when the user identifies the brand name of the printer in a particular family, the electronic circuitry then knows both the family and the printer within that family and the printer may then be activated with the correct electrical handshake and other required data.

The printer selector switch 120 depicted in FIGS. 16A and 16B is of the rotary type. The printer selector switch 120*a* depicted in FIG. 16C is of the slide type, as is the switch depicted in FIGS. 17A and 17C. The invention is not limited to these two (2) types of selector switches. More particularly, in addition to rotary and slide-type selector switches, jumpers, button array, and other selector switches are within the scope of this invention.

Figure 17A:
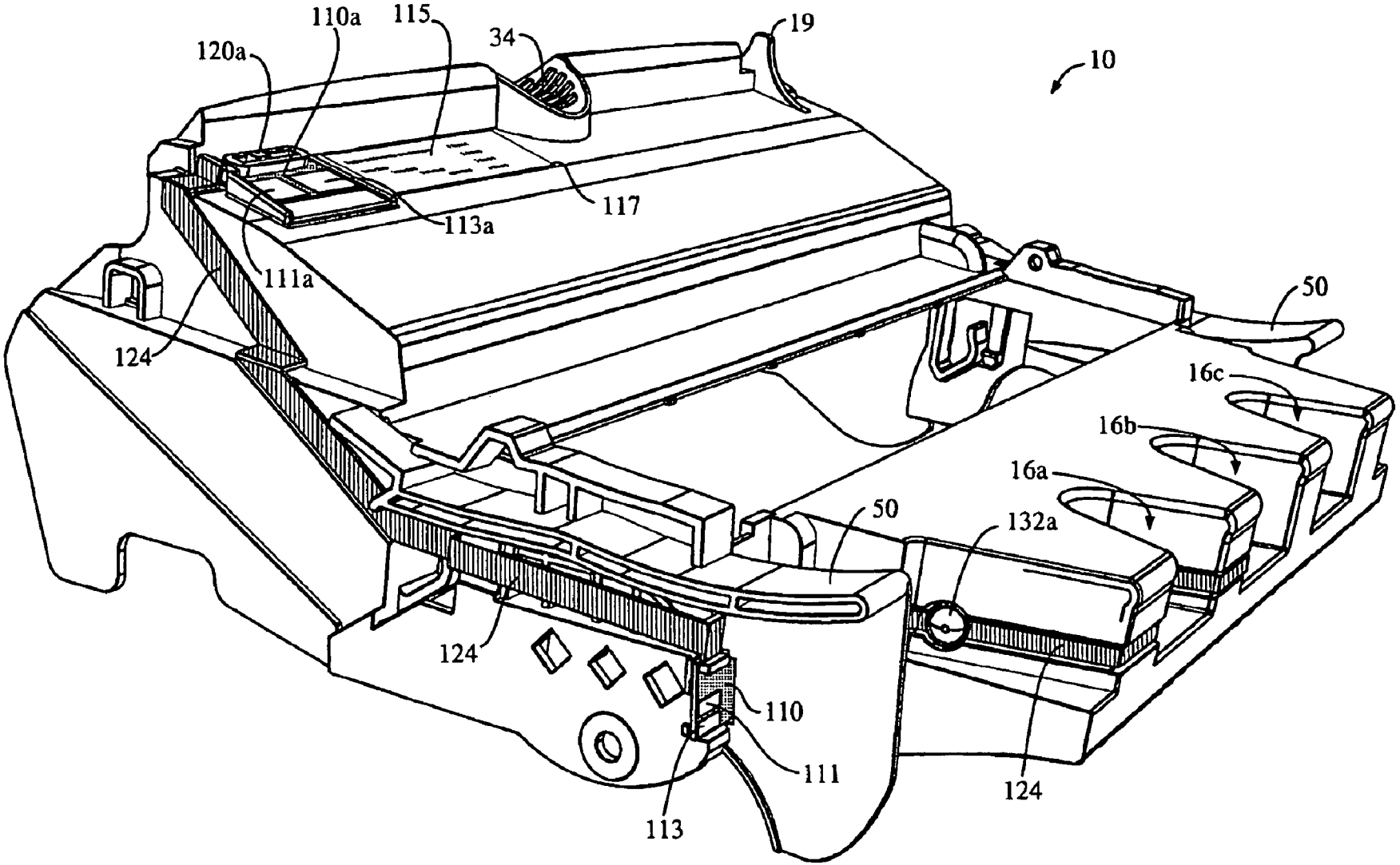
FIG. 17A is a perspective view of an embodiment having actuators of a type that is different from the actuators of the embodiment of FIGS. 16A and 16B.
Figure 17B:
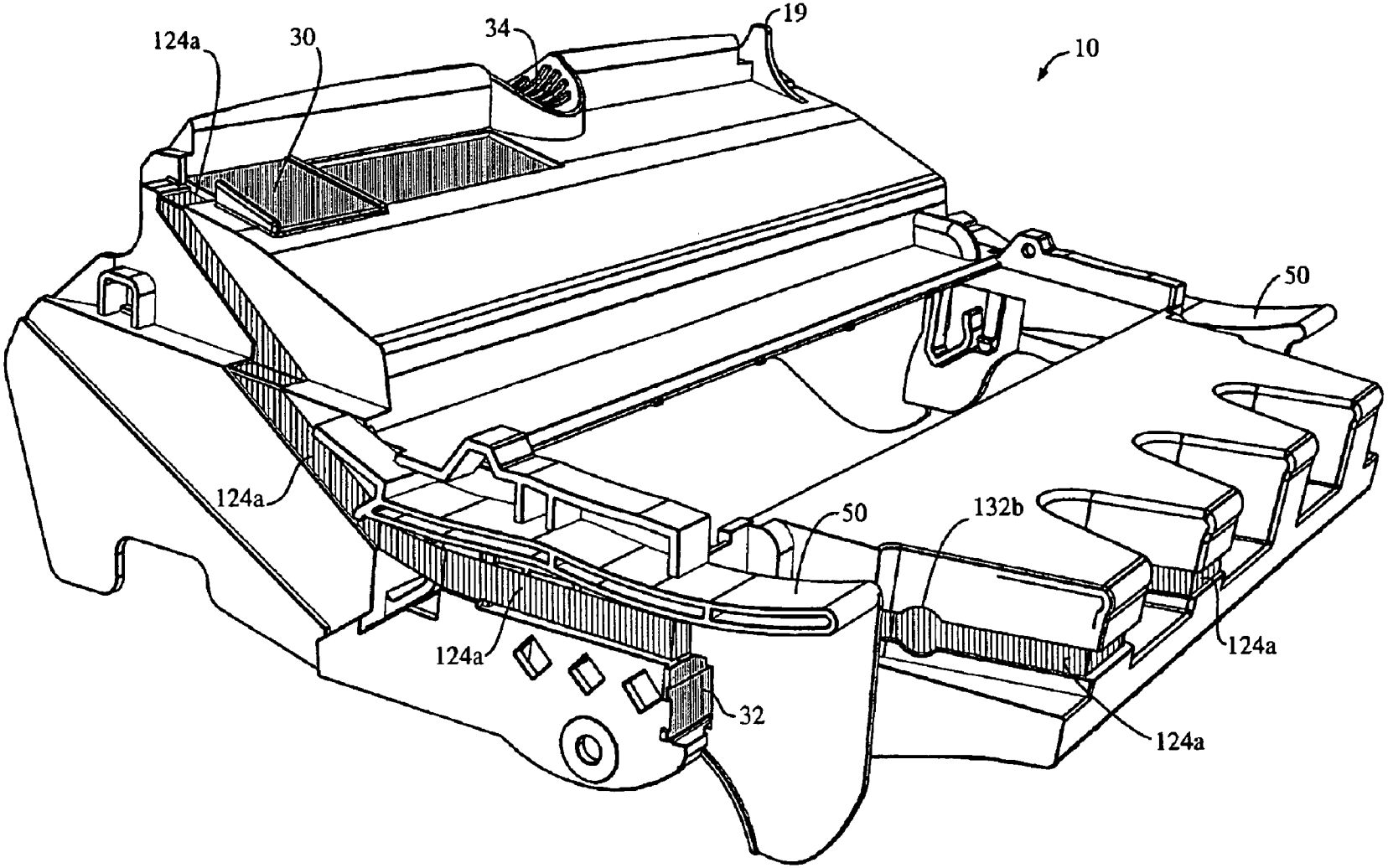
FIG. 17B is a perspective view of the embodiment of FIG. 17A but with a few parts removed to further illustrate the structure.
Figure 17C:
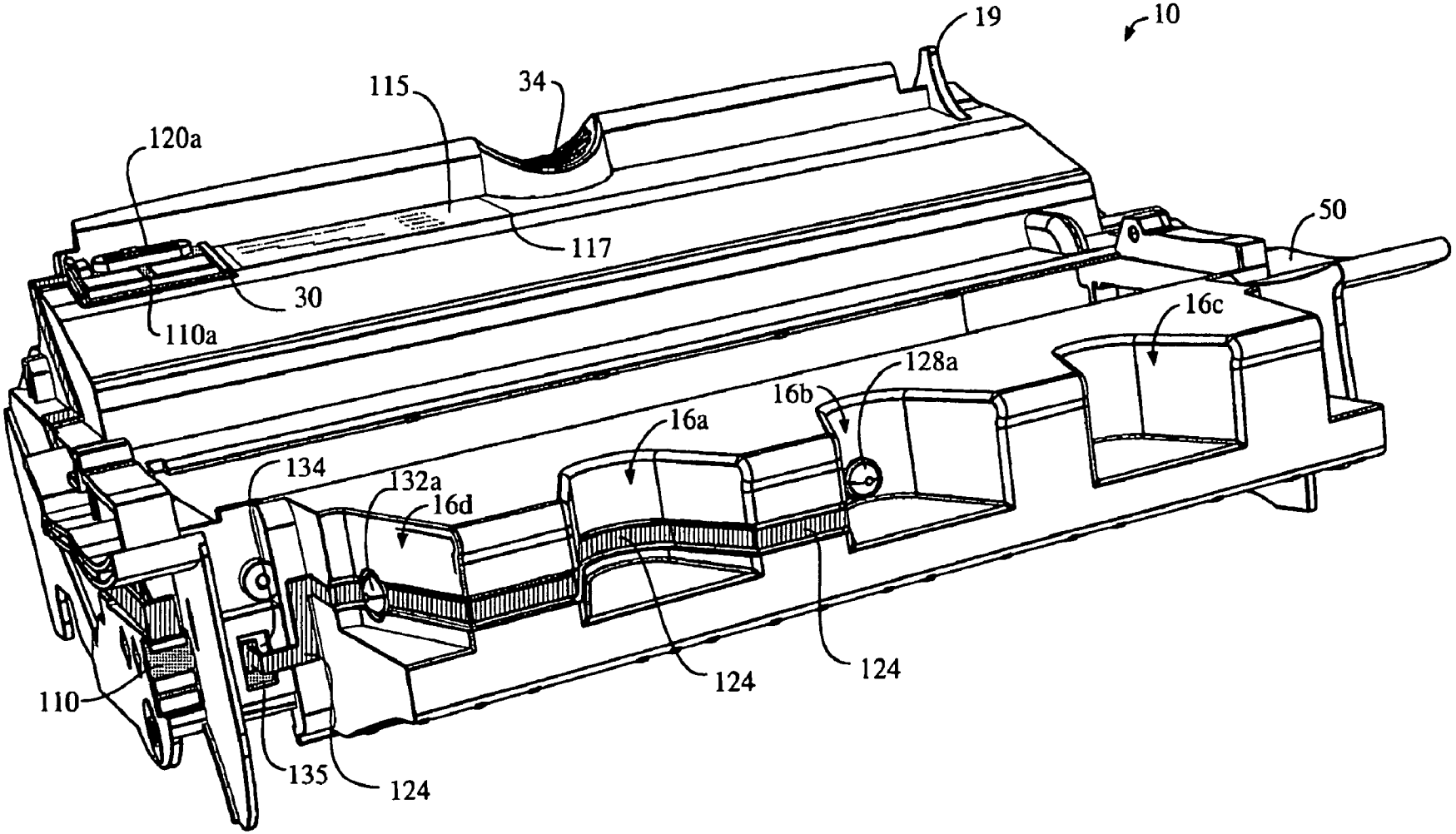
FIG. 17C is a front perspective view of the removable toner cartridge universal adapter of FIGS. 17A and 17B that shows further structural details.

FIGS. 17A and 17C depict the use of the above-mentioned pressure-sensitive flexible printed circuit board switches. They are denoted 128*a* and 132*a* to suggest that they are one of many substitute switches and switch actuators that may be used in lieu of actuators 128 and 132. FIG. 17A also better depicts ribbon cable 124. It should be understood, however, that ribbon cable 124 may be replaced by any equivalent conductor, including optical fibers, conventional wires, flexible circuit boards, and the like.

As perhaps best understood in connection with FIG. 17B, a channel 124*a* is formed in the novel toner cartridge to accommodate ribbon cable 124 or its equivalent. The recessed mounting provided by the channel prevents damage to conductor 124 during insertion of the toner cartridge into the printer.

Figure 17D:
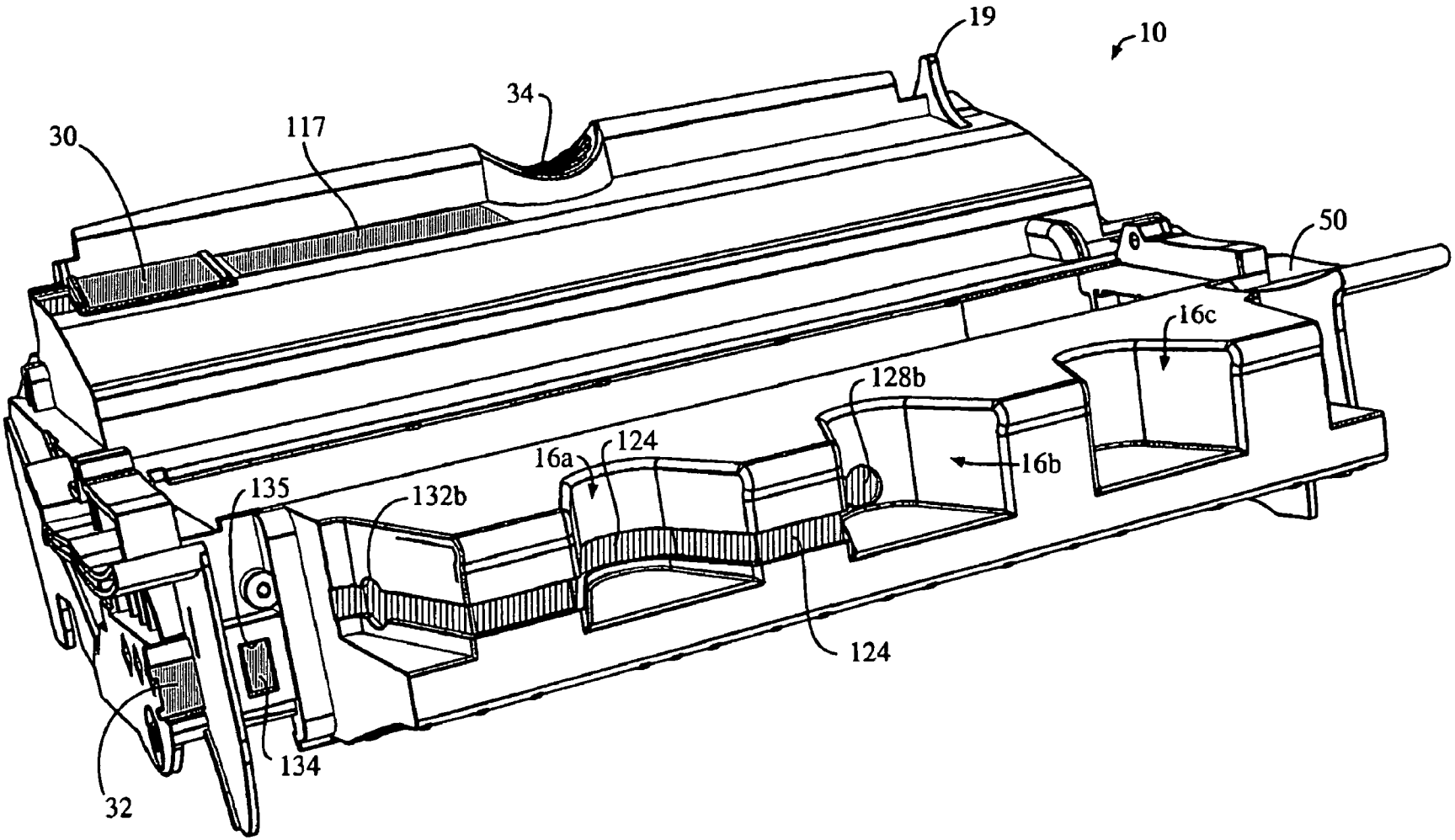
FIG. 17D is a perspective view of the embodiment of FIGS. 17A and 17C but with a few parts removed to further illustrate the structure.

As indicated in FIG. 17B, recess 132*b* accommodates switch actuator 132*a* and as indicated in FIG. 17D, recess 128*b* accommodates switch actuator 128*a*.

An opening 134 (FIGS. 17C and 17D) is formed in a vertical wall of waste bin 12 between the outboard edge of toner cartridge 10 and an outboard edge of the sculpted leading end of said waste bin. The opening is structurally reinforced about its perimeter as denoted by the reference numeral 135. Opening 134 enables ribbon cable 124, and its equivalents, to follow a path of travel from vertical circuit board 110 to switch actuators 126 and 132 and their equivalents where at least part of that path of travel is internal to toner cartridge 10.

Note in FIG. 16B that in the absence of opening 134, opening 138 must be formed in wall 140 to enable said ribbon cable to complete said path of travel.

Connection pads 111*a*, 113*a* are mounted on horizontally-mounted circuit board 110*a* and are adapted to make electrical contact with upper door-mounted electrical contacts that are provided on printers of the Se/T family.

Connection pads 111, 113 are mounted on vertically-mounted circuit board 110 and are adapted to make electrical contact with electrical contacts of the type provided on printers of the 520, 620, and 630 families.

Label 115 is mounted in recessed area 117 and provides instructions to the user. An example of typical instructions is provided in FIG. 17E. The invention is not limited to four brands of printers as indicated in the illustrative label of said FIG. 17E.

Figure 17E:
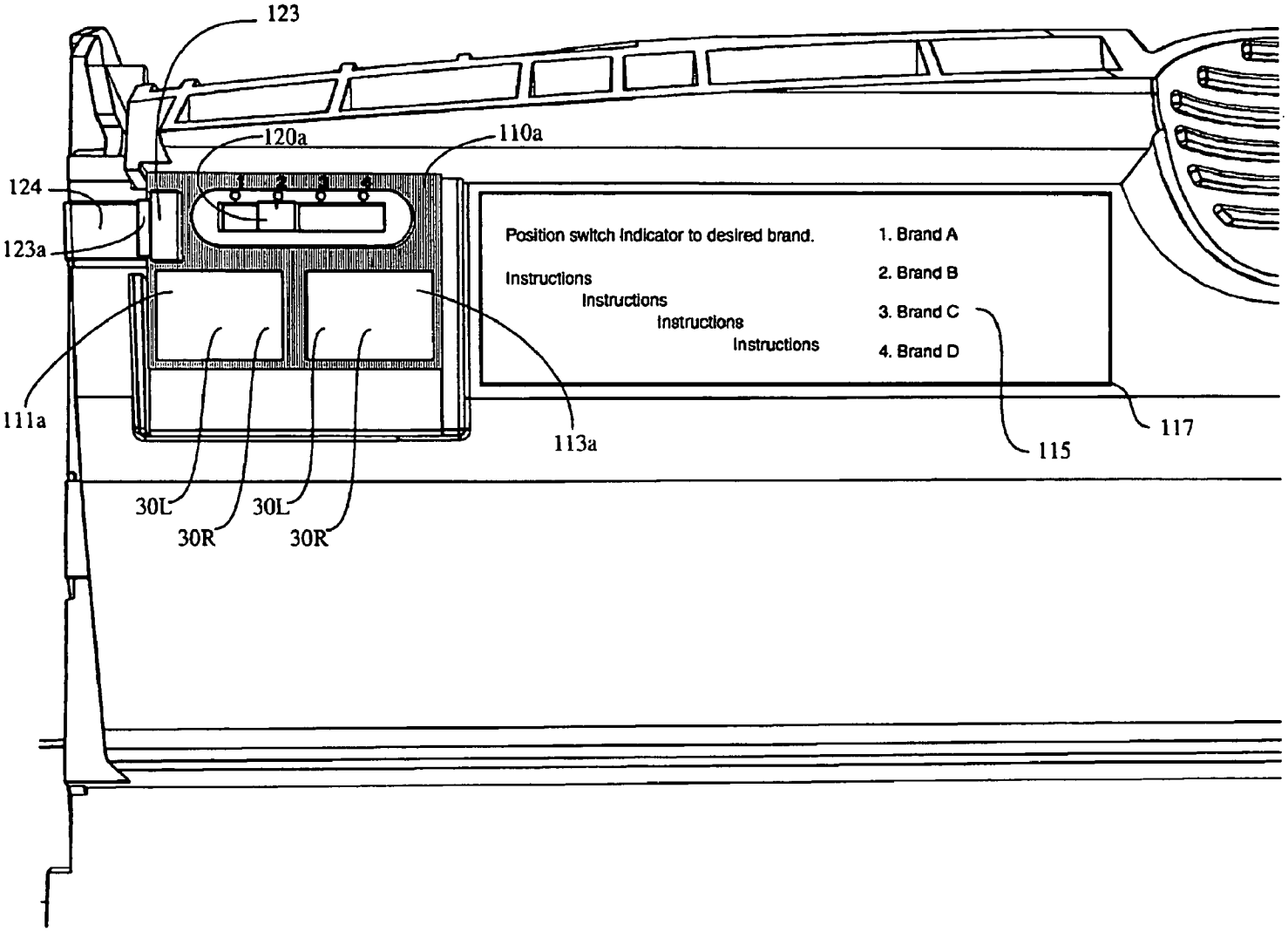
FIG. 17E is a top plan, detailed view of the horizontally-mounted circuit board and related parts.

FIG. 17E also provides a view that clearly depicts connector 123 that provides electrical communication between a first end of ribbon cable 124 and horizontal circuit board 110*a*. More particularly, terminal connector 123*a* is mounted to the end of ribbon cable 124 and said terminal connector 123*a* makes electrical contact with said connector 123.

Figure 17F:
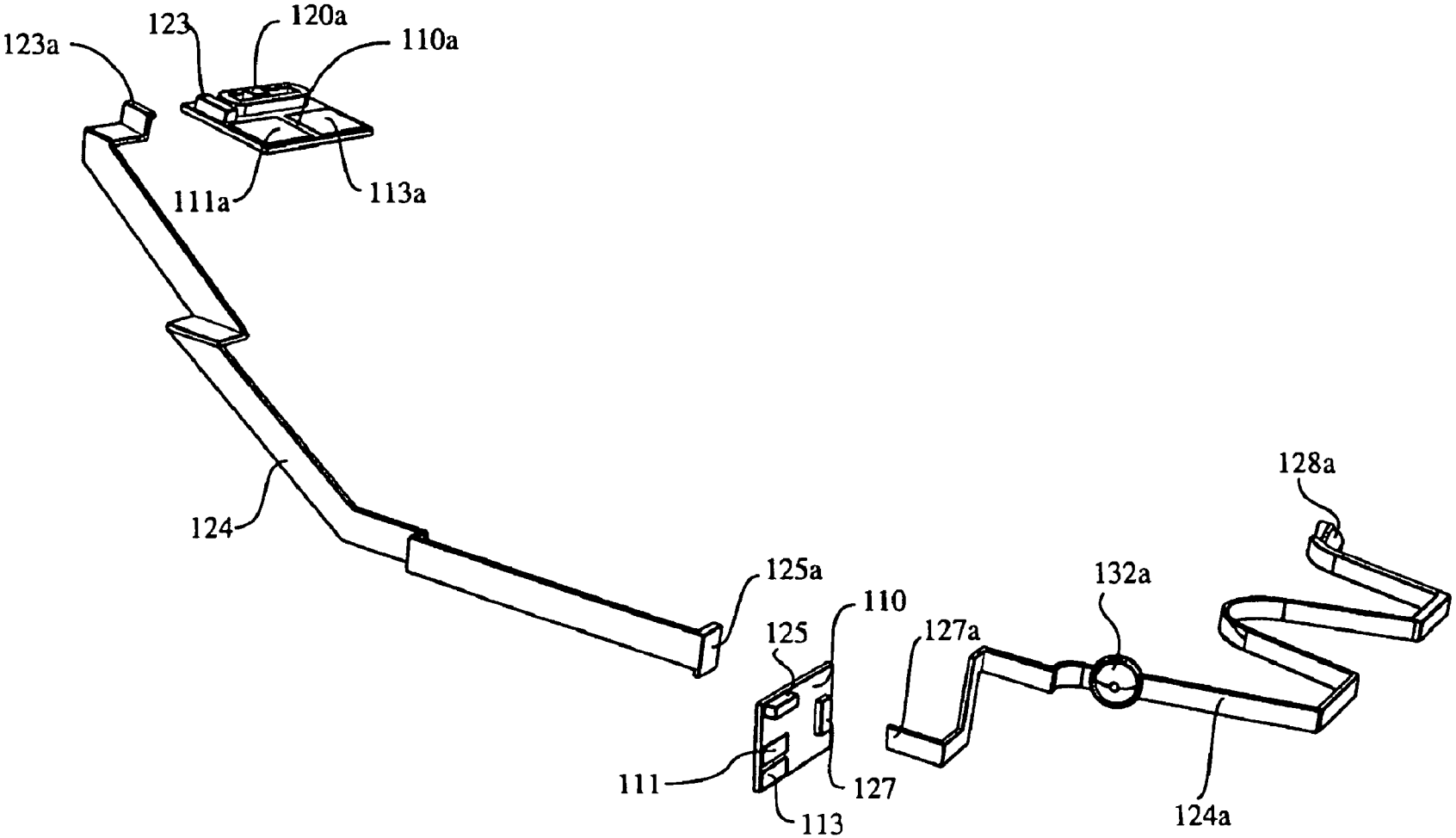
FIG. 17F is an exploded perspective view of the horizontally and vertically-mounted circuit boards and the ribbon cable that interconnects them to one another and to the strategically-positioned switch actuators of this invention.

A similar construction is employed at a second, opposite end of ribbon cable 124 as depicted in FIG. 17F where said ribbon cable is in electrical communication with vertically-mounted circuit board 110. Terminal connector 125*a* is mounted to the second end of ribbon cable 124 and said terminal connector 125*a* makes electrical contact with receiving connector 125 that is mounted to said circuit board 110.

As depicted in FIG. 17F, a similar connection is provided between ribbon cable 124*a* and vertical circuit board 110. Specifically, terminal connector 127*a* is mounted to a first end of ribbon cable 124*a* and said terminal connector 127*a* makes electrical contact with receiving connector 127 that is mounted to circuit board 110.

Figure 17G:
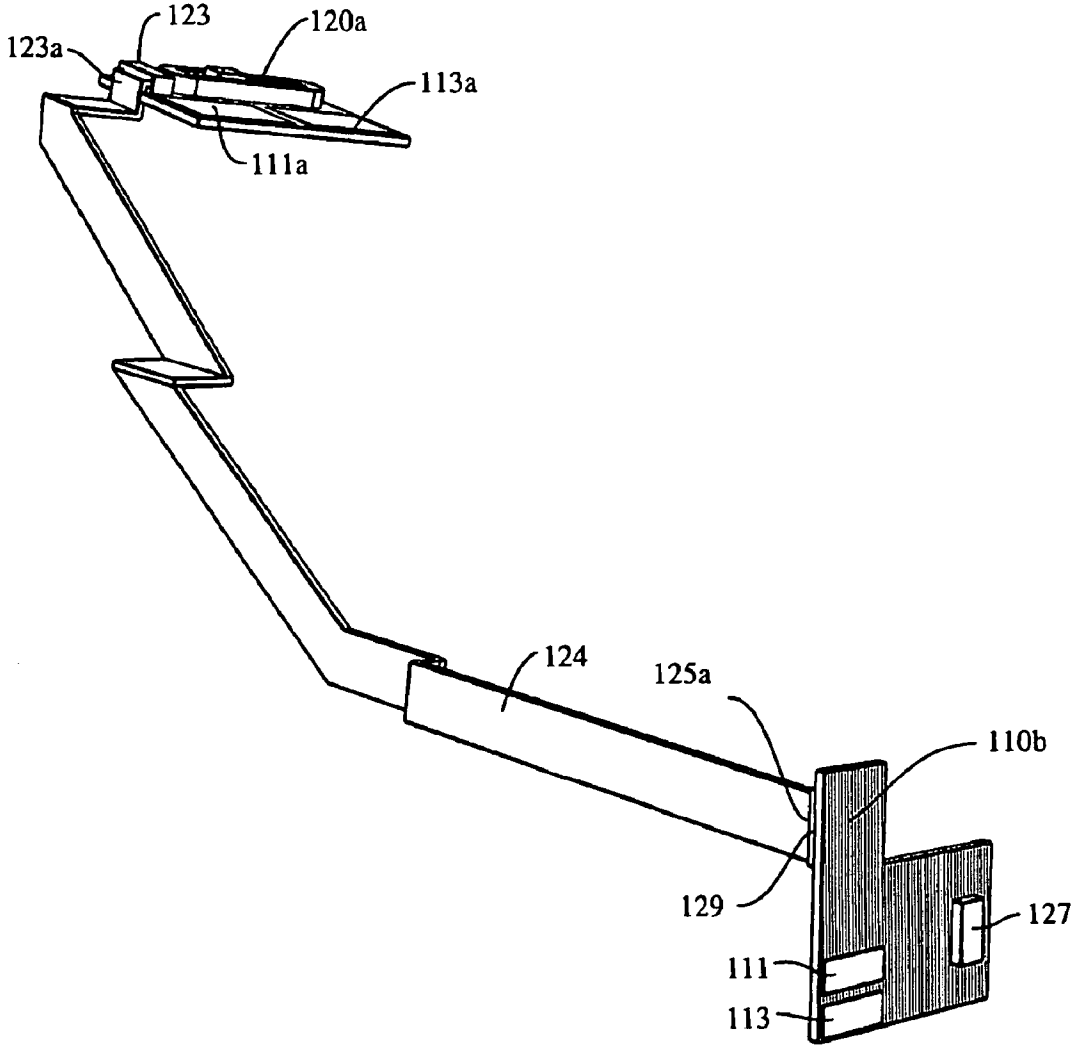
FIG. 17G is a perspective view depicting an alternative embodiment of the vertically-mounted circuit board.

"L"-shaped circuit board 110*a*, depicted in FIG. 17G, has utility because it provides a mount for vertically-disposed receiving connector 129 to which vertically-disposed terminal connector 125*a* may be secured in the absence of any bends in ribbon cable 124. Note in the embodiment of FIG. 17F that connectors 125 and 125*a* are horizontally and vertically disposed, respectively.

Figure 18A:
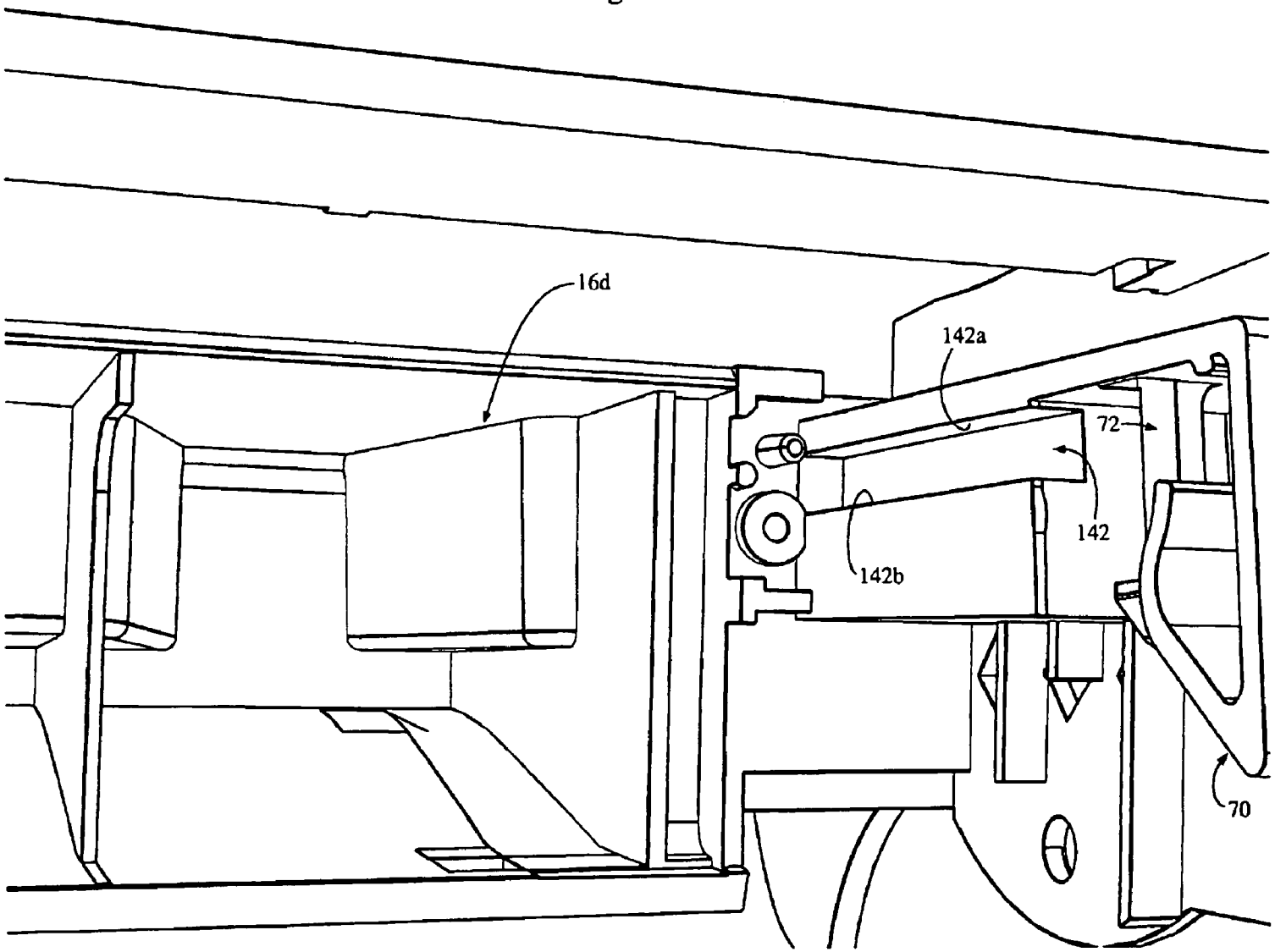
FIG. 18A is a perspective view depicting a slot formed in the inner and upper sidewall of the waste bin.
Figure 18B:
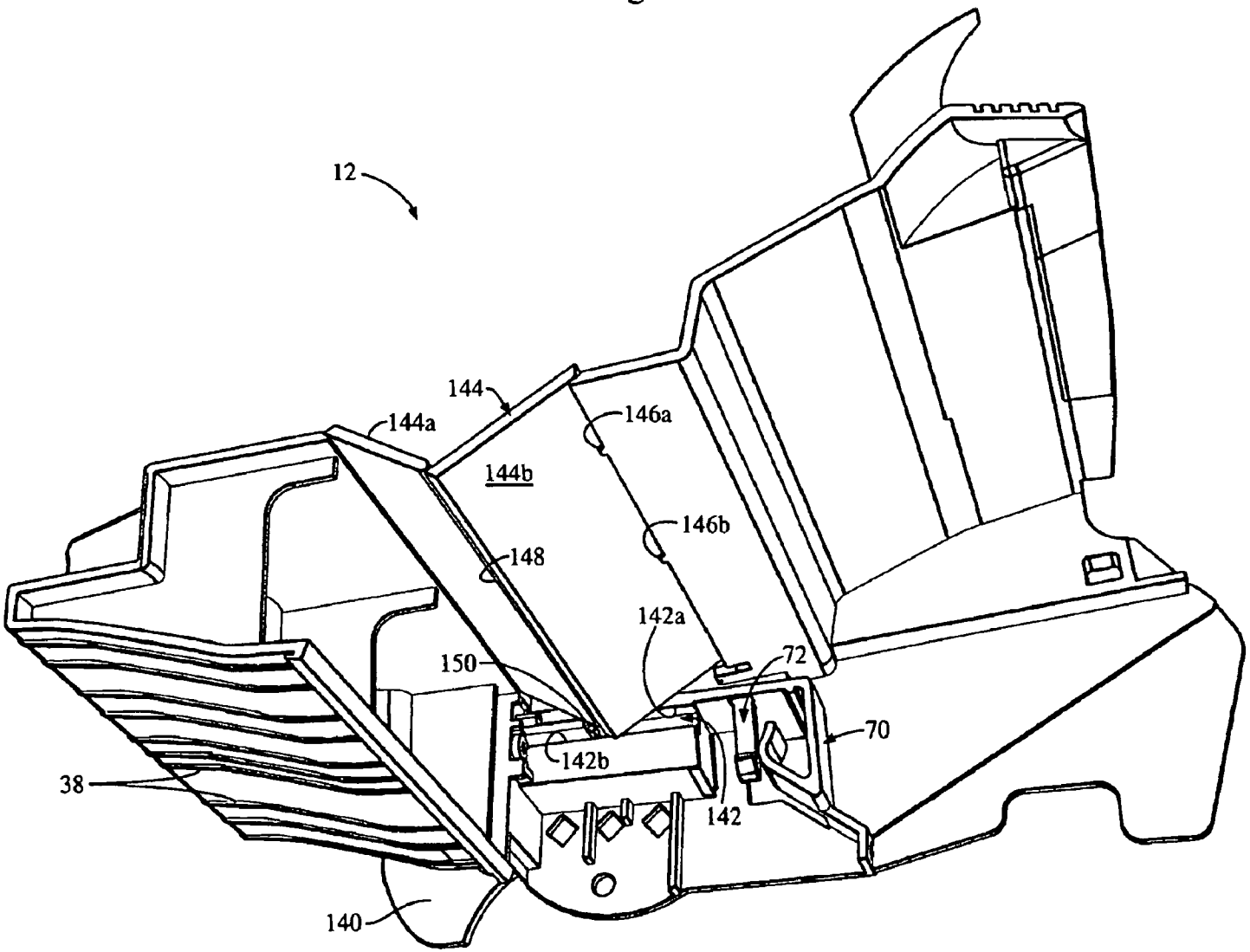
FIG. 18B is a cutaway perspective view depicting a bi-fold shutter having a center hinge that is constrained to move in the slot depicted in FIG. 18A.

FIGS. 18A and 18B depict a substantially horizontal slot 142 having a flat, horizontally disposed upper wall 142*a* and a flat, horizontally disposed lower wall 142*b*. Slot 142 is formed in an interior sidewall of the driven side of the waste bin between protrusion 16*a* and hopper wheel vertical lock 70.

As depicted in FIG. 18B, a novel upper shutter 144 is a bi-fold door having half parts 144*a*, 144*b*. Trailing half part 144*b* is hingedly connected as at 146*a*, 146*b* to the top wall of toner cartridge 12 and leading half part 144*a* is similarly connected to said toner cartridge top wall. The two half parts meet at folding line 148. Specifically, the trailing end of leading half 144*a* is hingedly connected to the leading end of trailing half 144*b*. Hinge 150 is in alignment with folding line 148 and extends from the driven side of shutter 144 into slot 142. Hinge 150 is therefore constrained to move within slot 142 as shutter 144 is opened and closed. More particularly, hinge 150 travels within slot 142 in a trailing-to-leading direction when shutter 144 is opened, and said hinge 150 travels within slot 142 in a leading-to-trailing direction when shutter 142 is closed. The driving side of shutter 144 is unconstrained.

In all of these exemplary constructions, it should be understood that the specific terminal connectors and receiving connectors disclosed herein may take many forms that are well-known in the electrical arts and all of such alternative forms are within the scope of this invention. For example, solder may be used to form the needed electrical connections.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

What is claimed is:

1. An imaging cartridge adapted to fit within the imaging cartridge receiving cavity of an imaging machine, comprising:

a body having a single shape, which is sculpted to mate with the imaging cartridge receiving cavity of a plurality of imaging machine families.

2. The imaging cartridge of claim 1, further comprising:

said body comprising a housing.

3. The imaging cartridge of claim 2, further comprising:

a hopper connected to said housing at an end of said housing.

4. The imaging cartridge of claim 2, further comprising:

said housing being a waste bin.

5. An imaging cartridge adapted to fit within the imaging cartridge receiving cavity of an imaging machine, comprising:

a housing positioned at an end of said imaging cartridge;

a hopper connected to said housing at an end of said housing;

said housing having an end sculpted in a single shape, which is adapted to mate with the imaging cartridge receiving cavity of a plurality of imaging machine families;

whereby said imaging cartridge mates with the imaging cartridge receiving cavity of a plurality of imaging machine families.

6. The imaging cartridge of claim 5, further comprising:

said housing being a waste bin.

7. The imaging cartridge of claim 5, further comprising:

said housing positioned at the leading end of said imaging cartridge;

said hopper connected to said housing at a trailing end of said housing; and said housing having a leading end sculpted to mate with the imaging cartridge receiving cavity of a plurality of imaging machine families.

8. An imaging cartridge adapted to fit within the imaging cartridge receiving cavity of an imaging machine, comprising:

a body having a single shape, which is sculpted to mate with the imaging cartridge receiving cavity of at least three imaging machine families.

9. The imaging cartridge of claim 8, further comprising:

said body comprising a housing.

10. The imaging cartridge of claim 9, further comprising:

a hopper connected to said housing at an end of said housing.

11. The imaging cartridge of claim 9, further comprising:

said housing being a waste bin.

12. An imaging cartridge adapted to fit within the imaging cartridge receiving cavity of an imaging machine, comprising:

a body having an end;

said end comprising a plurality of recesses in one configuration, which mates with the imaging cartridge receiving cavity of a plurality of imaging machine families.

* * * * *